US010593495B2

(12) United States Patent
Yoneda et al.

(10) Patent No.: US 10,593,495 B2
(45) Date of Patent: Mar. 17, 2020

(54) FUSE ELEMENT, FUSE DEVICE, PROTECTIVE DEVICE, SHORT-CIRCUIT DEVICE, SWITCHING DEVICE

(71) Applicant: DEXERIALS CORPORATION, Tokyo (JP)

(72) Inventors: Yoshihiro Yoneda, Tochigi (JP); Yuji Furuuchi, Tochigi (JP); Kazuyuki Sakakibara, Aichi (JP)

(73) Assignee: DEXERIALS CORPORATION, Tokyo (JP)

( * ) Notice: Subject to any disclaimer, the term of this patent is extended or adjusted under 35 U.S.C. 154(b) by 143 days.

(21) Appl. No.: 15/579,356

(22) PCT Filed: Jun. 4, 2016

(86) PCT No.: PCT/JP2016/066702
§ 371 (c)(1),
(2) Date: Dec. 4, 2017

(87) PCT Pub. No.: WO2016/195108
PCT Pub. Date: Dec. 8, 2016

(65) Prior Publication Data

US 2019/0228936 A1 Jul. 25, 2019

(30) Foreign Application Priority Data

Jun. 4, 2015 (JP) ..... 2015-114341
Jun. 3, 2016 (JP) ..... 2016-111763

(51) Int. Cl.
*H01H 37/76* (2006.01)
*H01H 85/08* (2006.01)
(Continued)

(52) U.S. Cl.
CPC ..... *H01H 37/761* (2013.01); *H01H 37/04* (2013.01); *H01H 85/08* (2013.01);
(Continued)

(58) Field of Classification Search
CPC ..... H01H 85/06; H01H 85/08; H01H 85/11; H01H 85/12; H01H 85/143; H01H 37/04; H01H 37/761; H01H 2037/046
(Continued)

(56) References Cited

U.S. PATENT DOCUMENTS 4,150,354 A * 4/1979 Namitokov ..... H01H 85/06 337/290
4,315,235 A * 2/1982 Jacobs, Jr. ..... H01H 85/08 337/161
(Continued)

FOREIGN PATENT DOCUMENTS

CN 2248392 Y 2/1997
CN 104185889 A 12/2014
(Continued)

OTHER PUBLICATIONS

EPO machine translation of Taguchi JP 2010092729 (Year: 2010).*
(Continued)

*Primary Examiner* — Jacob R Crum
(74) *Attorney, Agent, or Firm* — Oliff PLC

(57) ABSTRACT

A fuse element comprises a low melting point metal layer, a first high melting point metal layer having a higher melting point than a melting point of the low melting point metal layer, and a restricting portion including a high melting point material having a higher melting point than a melting point of the low melting point metal layer and configured to restrict flow of the low melting point metal or deformation of a layered body constituted by the first high melting point metal layer and the low melting point metal layer.

35 Claims, 46 Drawing Sheets

(51) Int. Cl.
*H01H 85/143* (2006.01)
*H01H 37/04* (2006.01)
*H01H 85/12* (2006.01)

(52) U.S. Cl.
CPC ..... *H01H 85/12* (2013.01); *H01H 85/143* (2013.01); *H01H 2037/046* (2013.01)

(58) Field of Classification Search
USPC ..... 337/404
See application file for complete search history.

(56) References Cited

U.S. PATENT DOCUMENTS

| | | | | | |
|---|---|---|---|---|---|
| 5,847,635 | A * | 12/1998 | Kudo | H01H 85/0417 | 337/198 |
| 6,075,434 | A * | 6/2000 | Rueckling | H01H 85/11 | 29/623 |
| 2005/0001710 | A1* | 1/2005 | Mukai | H01H 37/761 | 337/297 |
| 2005/0040926 | A1* | 2/2005 | Ely | H01H 85/11 | 337/159 |
| 2010/0176910 | A1* | 7/2010 | Knab | H01H 37/761 | 337/290 |
| 2015/0084734 | A1 | 3/2015 | Yoneda | | |
| 2016/0240342 | A1 | 8/2016 | Yoneda | | |

FOREIGN PATENT DOCUMENTS

| | | | | |
|---|---|---|---|---|
| JP | S56-134438 | A | 10/1981 | |
| JP | 2010092729 | A * | 4/2010 | H01H 85/08 |
| JP | 2013-229293 | A | 11/2013 | |
| TW | 201515042 | A | 4/2015 | |

OTHER PUBLICATIONS

EPO machine translation of Yoneda 2015 TW 201515042 (Year: 2015).*
Sep. 4, 2018 Office Action issued in Chinese Patent Application No. 201680028866.0.
Aug. 9, 2016 International Search Report submitted within International Patent Application No. PCT/JP2016/066702.
May 10, 2019 Office Action issued in Chinese Patent Application No. 201680028866.0.

* cited by examiner

FUSE ELEMENT, FUSE DEVICE, PROTECTIVE DEVICE, SHORT-CIRCUIT DEVICE, SWITCHING DEVICE

TECHNICAL FIELD

The present invention relates to a fuse element, mounted in a current path, that fuses to cut off or short-circuit the current path under its own heat build-up or heat build-up of a heat source when current greater than a current rating flows in the current path, and particularly relates to a fuse element in which variations in fusing characteristics are suppressed even with reflow mounting, as well as to a fuse device, a protective device, a short-circuit device, and a switching device using the fuse element.

The present application claims priority based upon Japanese Patent Application No. 2015-114341, filed in Japan on Jun. 4, 2015, and Japanese Patent Application No. 2016-111763, filed in Japan on Jun. 3, 2016, and hereby incorporates the application by reference.

BACKGROUND ART

Fuse elements that fuse under their own heat build-up when current greater than a current rating flows and cut off the current path have been used in the related art. For example, holder-type fuses in which solder is enclosed within a glass tube, chip fuses in which an Ag electrode is printed on the surface of a ceramic substrate, screw-in or plug-in type fuses in which a partially-thinned copper electrode is incorporated into a plastic case, and the like are often used as fuse elements.

However, problems have been identified with the above known fuse elements, namely that the elements cannot be reflow surface mounted, the rated currents are low, and the speed at which the fuse blows drops in a case where the size is increased to increase the current rating.

Meanwhile, in the case of a fast-acting fuse device for reflow mounting, a high-melting point solder that contains Pb and has a melting point of 300° C. or higher is generally preferable with respect to the fusing characteristics, such that the solder is not melted by the reflow heat. However, in RoHS directives and the like, Pb-containing solder is permitted only in limited situations, and the demand for Pb-free solders is expected to intensify in the future.

Based on such demand, a fuse element 100 in which a high melting point metal layer 102 such as silver or copper is layered on a low melting point metal layer 101 such as Pb-free solder is used, as illustrated in FIG. 45. According to this fuse element 100, reflow surface mounting is possible, which provides superior mountability on a fuse device; a high melting point metal covering is used, which raises the current rating and makes it possible to handle high currents; and furthermore, an erosion effect arises in the high melting point metal at the time of fusing due to the low melting point metal, which makes it possible to break the current path.

CITATION LIST

Patent Literature

Patent Document 1: JP 2013-229293 A

SUMMARY OF INVENTION

Technical Problem

In recent years, applications of fuse devices using fuse elements have expanded from electronic devices to high-current applications such as industrial machinery, electric bicycles, electric motorcycles, cars, and the like, and further higher current ratings and lower resistances are being demanded. Thus, fuse elements are also seeing increased surface areas.

However, when reflow mounting a fuse element having a large surface area or reflow mounting a fuse device using such a fuse element, the low melting point metal constituting the inner layer melts, and as illustrated in FIG. 46, the fuse element 100 deforms due to outflow onto the electrode or inflow of the mounting solder supplied onto the electrode. This is because the broader surface area gives the fuse element 100 a lower rigidity, and thus the element collapses and bulges locally due to tension arising as the low melting point metal melts. Such collapsing and bulging appears as waves throughout the fuse element 100 as a whole.

In the fuse element 100 that has deformed in this manner, the resistance value drops in places that have expanded due to the low melting point metal agglomerating, and conversely rises in places where the low melting point metal has flowed out, producing variations in the resistance value. As a result, prescribed fusing characteristics cannot be maintained, that is, the element will not fuse at a prescribed temperature or current, it will take time for the element to fuse, or conversely, the element will fuse at less than the prescribed temperature or current value.

Accordingly, an objective of the present invention is to provide a fuse element in which deformation of the fuse element is prevented even with reflow mounting so that the fuse element can maintain stable fusing characteristics, as well as a fuse device, a protective device, a short-circuit device, and a switching device using such a fuse element.

Solution to Problem

To solve the above-described problems, a fuse element according to an aspect of the present invention includes a low melting point metal layer, a first high melting point metal layer layered on the low melting point metal layer and having a higher melting point than a melting point of the low melting point metal layer, and a restricting portion including a high melting point material having a higher melting point than a melting point of the low melting point metal layer and configured to restrict flowing of the low melting point metal or deformation of a layered body constituted by the first high melting point metal layer and the low melting point metal layer.

Additionally, a fuse device according to an aspect of the present invention includes an electrically insulating substrate, a first electrode and a second electrode formed on the electrically insulating substrate, and a fuse element including a low melting point metal layer and a first high melting point metal layer having a higher melting point than a melting point of the low melting point metal layer and connected across the first electrode and the second electrode, the low melting point metal layer and the first high melting point metal layer being layered. The fuse element includes a restricting portion including a high melting point material having a higher melting point than a melting point of the low melting point metal layer and configured to restrict flowing of the low melting point metal or deformation of a layered body constituted by the first high melting point metal layer and the low melting point metal layer.

Additionally, a protective device according to an aspect of the present invention includes an electrically insulating substrate, a first electrode and a second electrode formed on the electrically insulating substrate, a heat source formed on the electrically insulating substrate or within the electrically insulating substrate, a heat source connection electrode electrically connected to the heat source, and a fuse element including a low melting point metal layer and a first high melting point metal layer having a higher melting point than a melting point of the low melting point metal layer and connected across the first electrode and the second electrode and the heat source connection electrode, the low melting point metal layer and the first high melting point metal layer being layered. The fuse element includes a restricting portion including a high melting point material having a higher melting point than a melting point of the low melting point metal layer and configured to restrict flowing of the low melting point metal or deformation of a layered body constituted by the first high melting point metal layer and the low melting point metal layer.

Additionally, a short-circuit device according to an aspect of the present invention includes a first electrode, a second electrode provided adjacent to the first electrode, a fusible electrical conductor supported by the first electrode and configured to agglomerate across the first electrode and the second electrode and short-circuit the first electrode and the second electrode by melting, and a heat source configured to heat the fusible electrical conductor. The fusible electrical conductor includes a low melting point metal layer and a first high melting point metal layer having a higher melting point than a melting point of the low melting point metal layer, the low melting point metal layer and the first high melting point metal layer being layered, and a restricting portion including a high melting point material having a higher melting point than a melting point of the low melting point metal layer and configured to restrict flowing of the low melting point metal or deformation of a layered body constituted by the first high melting point metal layer and the low melting point metal layer.

Additionally, a switching device according to an aspect of the present invention includes an electrically insulating substrate, a first heat source and a second heat source formed on the electrically insulating substrate or within the electrically insulating substrate, a first electrode and a second electrode provided adjacent to each other on the electrically insulating substrate, a third electrode provided on the electrically insulating substrate and electrically connected to the first heat source, a first fusible electrical conductor connected across the first electrode and the third electrode, a fourth electrode provided on the electrically insulating substrate and electrically connected to the second heat source, a fifth electrode provided adjacent to the fourth electrode on the electrically insulating substrate, and a second fusible electrical conductor connected from the second electrode to the fifth electrode across the fourth electrode. The first fusible electrical conductor and the second fusible electrical conductors include a low melting point metal layer and a first high melting point metal layer having a higher melting point than a melting point of the low melting point metal layer, the low melting point metal layer and the first high melting point metal layer being layered, and a restricting portion including a high melting point material having a higher melting point than a melting point of the low melting point metal layer and configured to restrict flowing of the low melting point metal or deformation of a layered body constituted by the first high melting point metal layer and the low melting point metal layer. The second fusible electrical conductor is melted by electric heating of the second heat source and breaks a path between the second electrode and the fifth electrode. The first fusible electrical conductor is melted by electric heating of the first heat source and causes a short-circuit between the first electrode and the second electrode.

Advantageous Effects of Invention

According to the present invention, a restricting portion can keep deformation of a fuse element within a set range in which variations in fusing characteristics are suppressed.

BRIEF DESCRIPTION OF DRAWINGS

FIG. 15A illustrates before a fuse element has fused and FIG. 15B illustrates after the fuse element has fused.

FIG. 17A illustrates before a fuse element has fused and FIG. 17B illustrates after the fuse element has fused.

FIG. 21A illustrates before a fuse element has fused and FIG. 21B illustrates after the fuse element has fused.

FIG. 25A illustrates before a fuse element has fused and FIG. 25B illustrates after the fuse element has fused.

DESCRIPTION OF EMBODIMENTS

A fuse element, a fuse device, a protective device, a short-circuit device, and a switching device to which the present technique is applied will be described in detail with reference to the drawings. Note that the present technique is not to be considered as being limited to the embodiments described below; of course, various alterations could be made, provided that there is no deviation from the gist of the present technique. Moreover, the drawings are only to be considered as being schematic; in some cases, the ratios of the dimensions illustrated are different from those actually employed. The concrete dimensions and the like needs to be determined with reference to the following explanation. Furthermore, of course, there are portions for which the relationships and ratios between the mutual dimensions are different between the various drawings.

Fuse Element

A fuse element to which the present technique is applied will be described first. A fuse element 1 to which the present technique is applied is used as a fusible electrical conductor of a fuse device, a protective device, a short-circuit device, and a switching device, which will be described later, and fuses under its own heat build-up (Joule heat) when current greater than a current rating flows, or fuses by heat build-up of a heat source. Although the following will describe a case in which the fuse element 1 is installed in a fuse device 20 as an example of the configuration of the fuse element 1, the same effects are achieved in the case where the fuse element 1 is installed in a protective device, a short-circuit device, and a switching device, which will be described later.

Figure 1A:
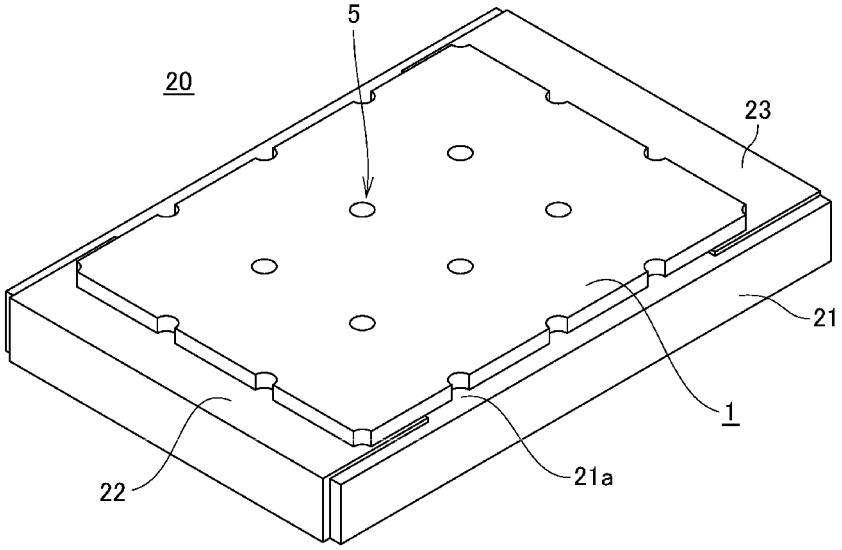
FIG. 1A is a perspective view of a top surface side of a fuse device without a cover component.
Figure 1B:
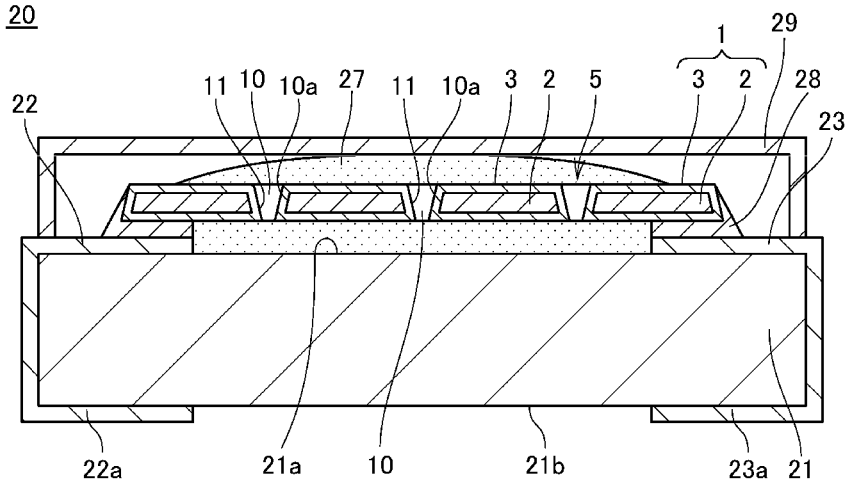
FIG. 1B is a cross-sectional view of the fuse device.

The fuse element 1 is formed having a substantially rectangular shape with an overall thickness of approximately 100 for example, and as illustrated in FIGS. 1A and 1B, is soldered to first and second electrodes 22 and 23 provided on an electrically insulating substrate 21 of the fuse device 20. The fuse element 1 includes a low melting point metal layer 2 constituting an inner layer and a first high melting point metal layer 3 having a higher melting point than that of the low melting point metal layer 2 and constituting an outer layer, and is provided with restricting portions 5 that restrict deformation of the fuse element 1 by suppressing the flow of the low melting point metal that has melted during reflow heating.

An alloy having, for example, Ag and Cu, or Ag or Cu, as its main component is favorably used as the first high melting point metal layer 3, and the first high melting point metal layer 3 has a melting point high enough so as not to melt even when the fuse element 1 is mounted onto the electrically insulating substrate 21 using a reflow furnace.

A raw material commonly called "Pb-free solder", such as Sn or an alloy that takes Sn as its main component, can be used favorably as the low melting point metal layer 2. The melting point of the low melting point metal layer 2 does not absolutely have to be higher than the temperature of the reflow furnace, and the low melting point metal layer 2 may melt at approximately 200° C. The low melting point metal layer 2 may use Bi, In, or an alloy containing Bi or In, that melts at an even low temperature of approximately from 120° C. to 140° C.

Restricting Portions

As illustrated in FIG. 1B, the restricting portions 5 are formed by covering at least part of side surfaces 10*a* of one or more holes 10 provided in the low melting point metal layer 2 with a high melting point metal 11 that is continuous with the first high melting point metal layer 3. The holes 10 can be formed by, for example, piercing the low melting point metal layer 2 with a pointed object such as a pin or subjecting the low melting point metal layer 2 to a pressing process using a metal mold. The holes 10 are formed in a prescribed pattern, such as a quadrangular lattice form or a hexagonal lattice form, that is uniform across the entire surface of the low melting point metal layer 2.

Like the raw material constituting the first high melting point metal layer 3, the raw material constituting the second high melting point metal layer 11 has a melting point high enough so that the second high melting point metal layer 11 does not melt at the reflow temperature. From the standpoint of manufacturing efficiency, it is preferable that the second high melting point metal layer 11 be formed of the same raw material as the first high melting point metal layer 3 during the process of forming the first high melting point metal layer 3.

As illustrated in FIG. 1B, this fuse element 1 is placed so as to bridge the first and second electrodes 22 and 23 provided on the electrically insulating substrate 21 of the fuse device 20, and is then subjected to reflow heating. The fuse element 1 is soldered to the first and second electrodes 22 and 23 using connection solder 28 as a result. The fuse device 20 on which the fuse element 1 has been mounted is furthermore placed on an outside circuit board of various types of electronic devices, and is reflow mounted.

Here, the first high melting point metal layer 3 that does not melt even at the reflow temperature is layered on the low melting point metal layer 2 as an outer layer, and the restricting portions 5 are provided as well. Accordingly, even in a case where the fuse element 1 is repeatedly exposed to a high-temperature environment, such as when being reflow-mounted to the electrically insulating substrate 21 of the fuse device 20 or when the fuse device 20 using the fuse element 1 is reflow-mounted onto an outside circuit board, the restricting portions 5 can keep deformation of the fuse element 1 within a constant range at which variations in the fusing characteristics are suppressed. As such, the fuse element 1 can be reflow-mounted even in a case where the surface area thereof has been increased, which makes it possible to improve the mounting efficiency. The fuse element 1 can also achieve an improvement in the current rating in the fuse device 20.

In other words, the fuse element 1 includes the holes 10 provided in the low melting point metal layer 2 and the restricting portions 5 covering the side surfaces 10*a* of the holes 10 with the second high melting point metal layer 11, and thus even in a case where the fuse element 1 is exposed, by an outside heat source such as a reflow furnace, to a high-heat environment greater than or equal to the melting point of the low melting point metal layer 2 for a short amount of time, the second high melting point metal layer 11 covering the side surfaces 10*a* of the holes 10 suppresses a situation in which the melted low melting point metal flows, and also supports the first high melting point metal layer 3 constituting the outer layer. Accordingly, the fuse element 1 can suppress a situation in which the melted low melting point metal agglomerates due to tension and expands, or the melted low melting point metal flows out and becomes thinner, and as a result, collapsing or bulging locally arises.

Accordingly, the fuse element 1 can prevent variations in a resistance value caused by deformations such as local collapsing or bulging arising at the temperature used during reflow mounting, and can maintain fusing characteristics in which the fuse element 1 fuses at a prescribed temperature or current and in a prescribed amount of time. Additionally, the fuse element 1 can maintain the fusing characteristics even when repeatedly exposed to the reflow temperature, such as when the fuse device 20 is reflow-mounted onto an outside circuit board after the fuse element 1 has been reflow-mounted onto the electrically insulating substrate 21 of the fuse device 20, which makes it possible to improve the mounting efficiency.

As will be described later, in the case where the fuse element 1 is manufactured by being cut from a large element sheet, the low melting point metal layer 2 is exposed from the side surfaces of the fuse element 1, and those side surfaces make contact with the first and second electrodes 22 and 23 provided on the electrically insulating substrate 21 of the fuse device 20 via the connection solder 28. In this case too, with the fuse element 1, a situation in which the melted low melting point metal flows is suppressed by the restricting portions 5, and thus a situation in which the melted connection solder 28 is suctioned from the side surfaces, causing an increase in the volume of the low melting point metal and a local decrease in the resistance value, will not arise.

Additionally, the fuse element 1 is configured with the low resistance first high melting point metal layer 3 layered thereon, which makes it possible to greatly reduce the conductor resistance compared to fusible electrical conductors of the related art using lead-based high melting point solders, and greatly increase the rated current compared to chip fuses of the related art and the like having the same size. A smaller size than that of chip fuses of the related art having the same rated current can also be achieved.

Furthermore, the fuse element 1 includes the low melting point metal layer 2 having a lower melting point than that of the first high melting point metal layer 3, such that the fuse element 1 begins melting from the melting point of the low melting point metal layer 2 under the self-produced heat build-up from overcurrent and can therefore fuse quickly. For example, in the case where the low melting point metal layer 2 is constituted of an Sn—Bi-based alloy, an In—Sn-based alloy, or the like, the fuse element 1 begins melting from a low temperature of approximately 140° C. or 120° C. The melted low melting point metal layer 2 erodes (solder erosion) the first high melting point metal layer 3, and thus, the first high melting point metal layer 3 melts at a lower temperature than its own melting point. Accordingly, the fuse element 1 can be fused even more quickly by using the effect of the low melting point metal layer 2 eroding the first high melting point metal layer 3.

Through-Holes/Closed-Ended Holes

Figure 2A:
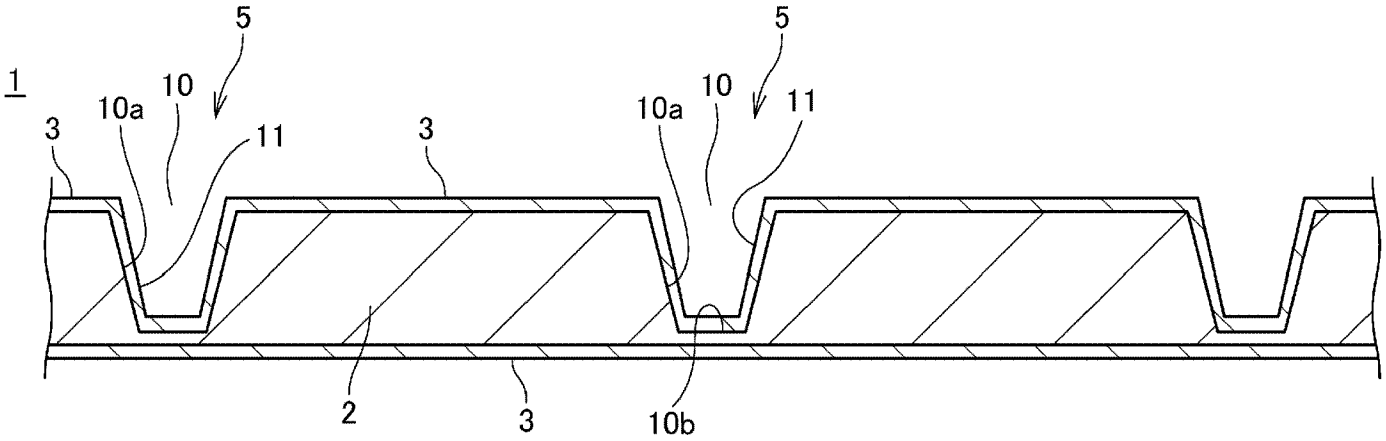
FIG. 2A is a cross-sectional view of a fuse element, in which closed-ended holes are formed, before reflow mounting.

The holes 10 may be formed as through-holes passing through the low melting point metal layer 2 in the thickness direction thereof, as illustrated in FIG. 1B, or as closed-ended holes, as illustrated in FIG. 2A. In the case where the holes 10 are formed as through-holes, the second high melting point metal layer 11 covering the side surfaces 10*a* of the holes 10 is continuous with the first high melting point metal layer 3 layered on the front and rear surfaces of the low melting point metal layer 2.

Figure 2B:
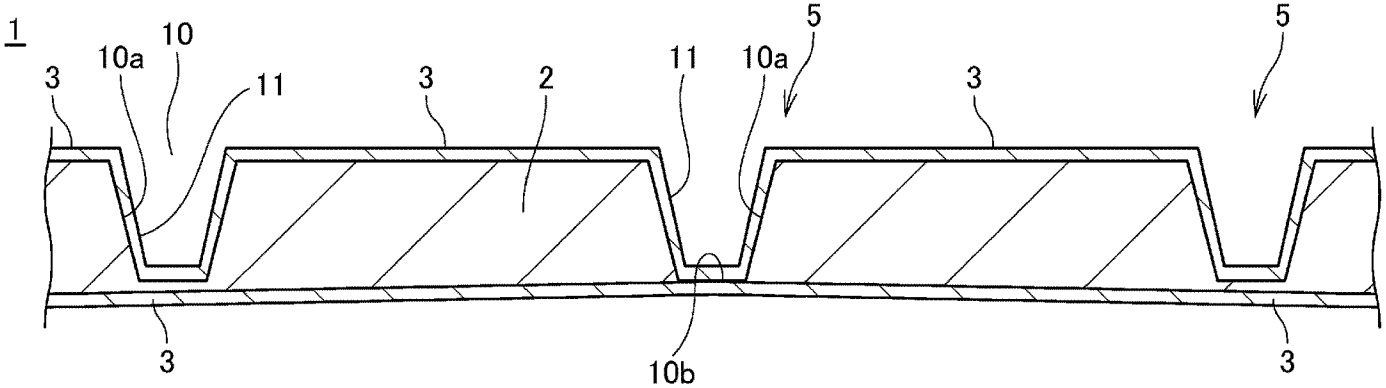
FIG. 2B is a cross-sectional view of the fuse element illustrated in FIG. 2A after reflow mounting.

In the case where the holes 10 are formed as closed-ended holes, it is preferable that the holes 10 be covered by the second high melting point metal layer 11 as far as bottom surfaces 10*b*, as illustrated in FIG. 2A. With the fuse element 1, even in the case where the holes 10 are formed as closed-ended holes and the low melting point metal flows due to the reflow heating, that flow is suppressed, and the first high melting point metal layer 3 constituting the outer layer is supported, by the second high melting point metal layer 11 covering the side surfaces 10*a* of the holes 10. Thus, as illustrated in FIG. 2B, there are only slight variations in the thickness of the fuse element 1, which do not result in variations in the fusing characteristics.

Filling of High Melting Point Metal

Figure 3A:
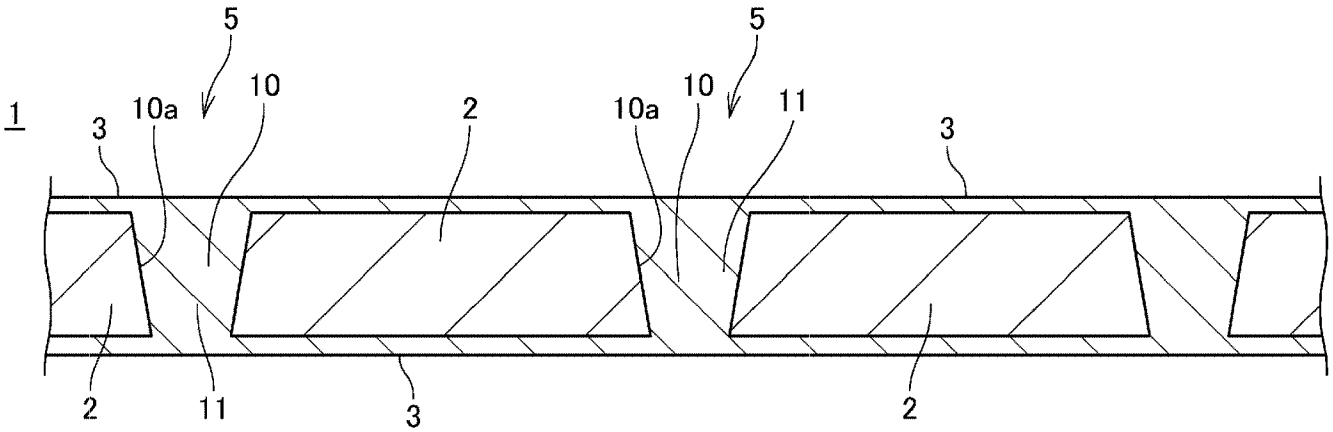
FIG. 3A is a cross-sectional view of a fuse element in which through-holes are filled by a second high melting point metal layer.
Figure 3B:
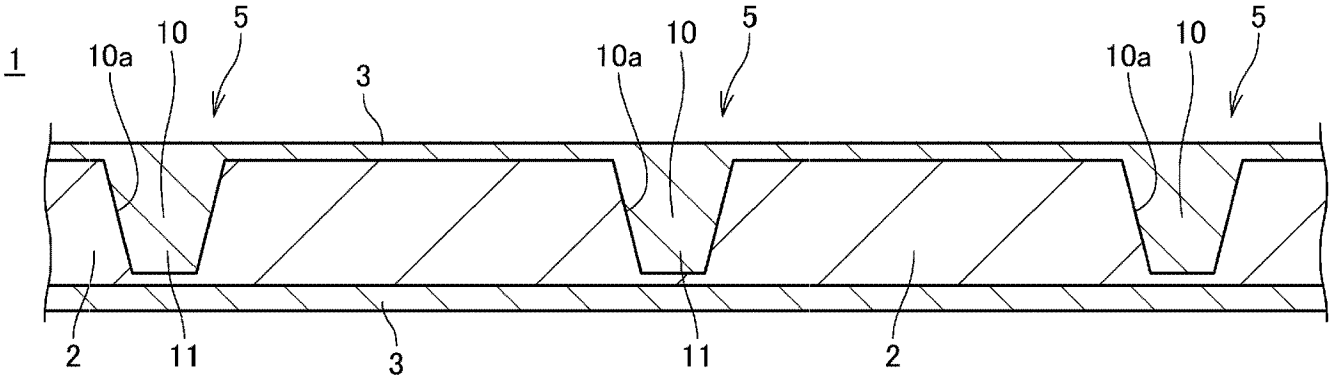
FIG. 3B is a cross-sectional view of a fuse element in which closed-ended holes are filled by the second high melting point metal layer.

As illustrated in FIGS. 3A and 3B, the holes 10 may be filled by the second high melting point metal layer 11. When the holes 10 are filled by the second high melting point metal layer 11, the fuse element 1 can increase the strength of the restricting portions 5 supporting the first high melting point metal layer 3 constituting the outer layer so as to further suppress deformation of the fuse element 1, and can also increase the current rating by achieving a lower resistance.

As will be described later, when, for example, the first high melting point metal layer 3 is formed through electroplating or the like on the low melting point metal layer 2 in which the holes 10 are formed, the second high melting point metal layer 11 can be formed at the same time, and the inside of the holes 10 can be filled with the second high melting point metal layer 11 by adjusting the diameters of the holes, the plating conditions, and the like.

Cross-Sectional Shape

Figure 4A:
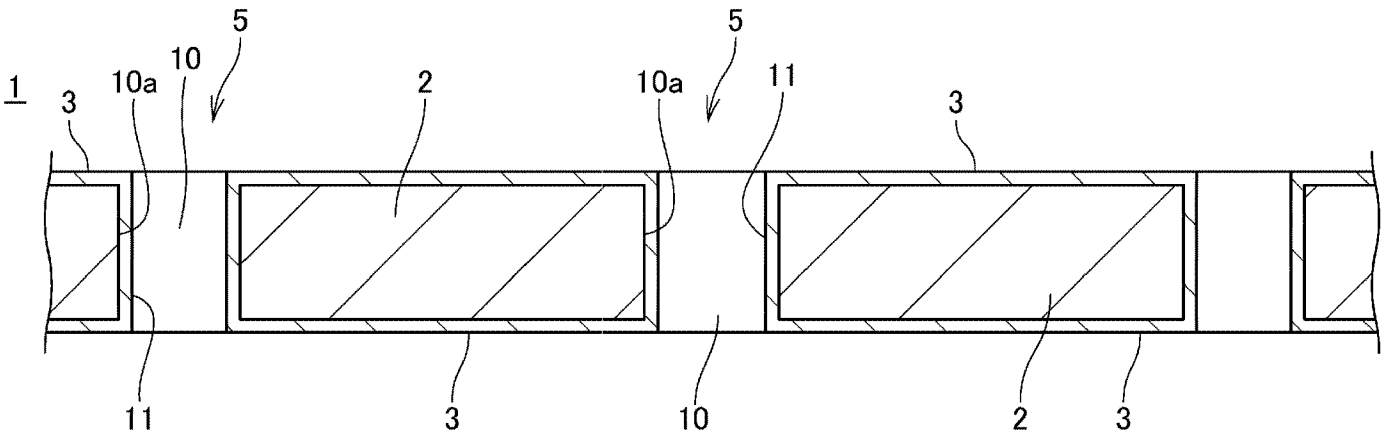
FIG. 4A is a cross-sectional view of a fuse element provided with through-holes having a rectangular cross-section.
Figure 4B:
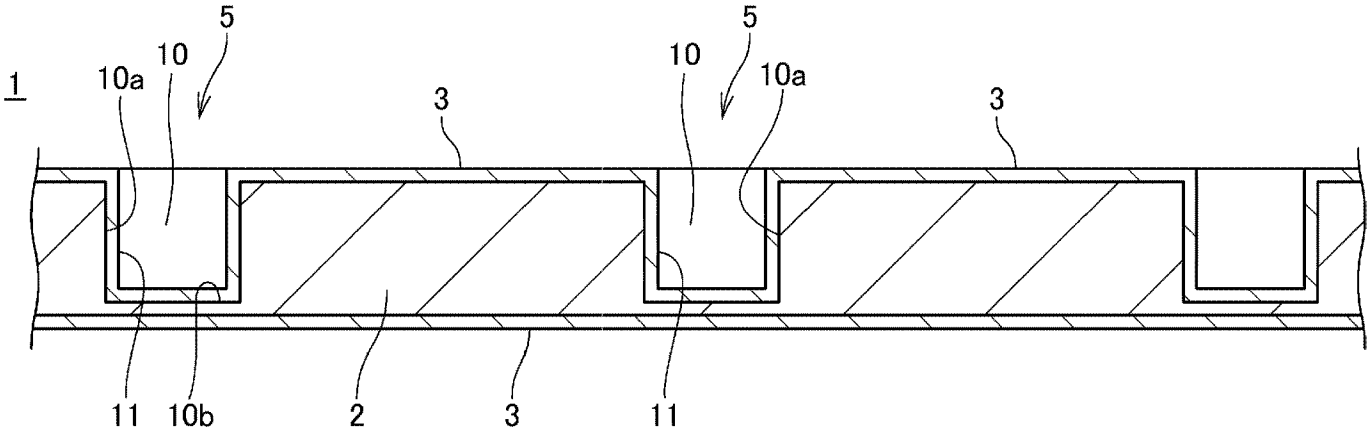
FIG. 4B is a cross-sectional view of a fuse element provided with closed-ended holes having a rectangular cross-section.

As illustrated in FIG. 1A, the holes 10 may be formed having a tapered cross-sectional shape. The holes 10 can be formed by, for example, piercing the low melting point metal layer 2 with a pointed object such as a pin, and can thus be formed having a tapered cross-sectional shape corresponding to the shape of the pointed object. Additionally, as illustrated in FIGS. 4A and 4B, the holes 10 may be formed having a rectangular cross-sectional shape. The holes 10 having a rectangular cross-sectional shape can be formed in the fuse element 1 by, for example, subjecting the low melting point metal layer 2 to a pressing process using a mold corresponding to holes 10 having a rectangular cross-sectional shape.

Partial Covering of High Melting Point Metal Layer

Figure 5:
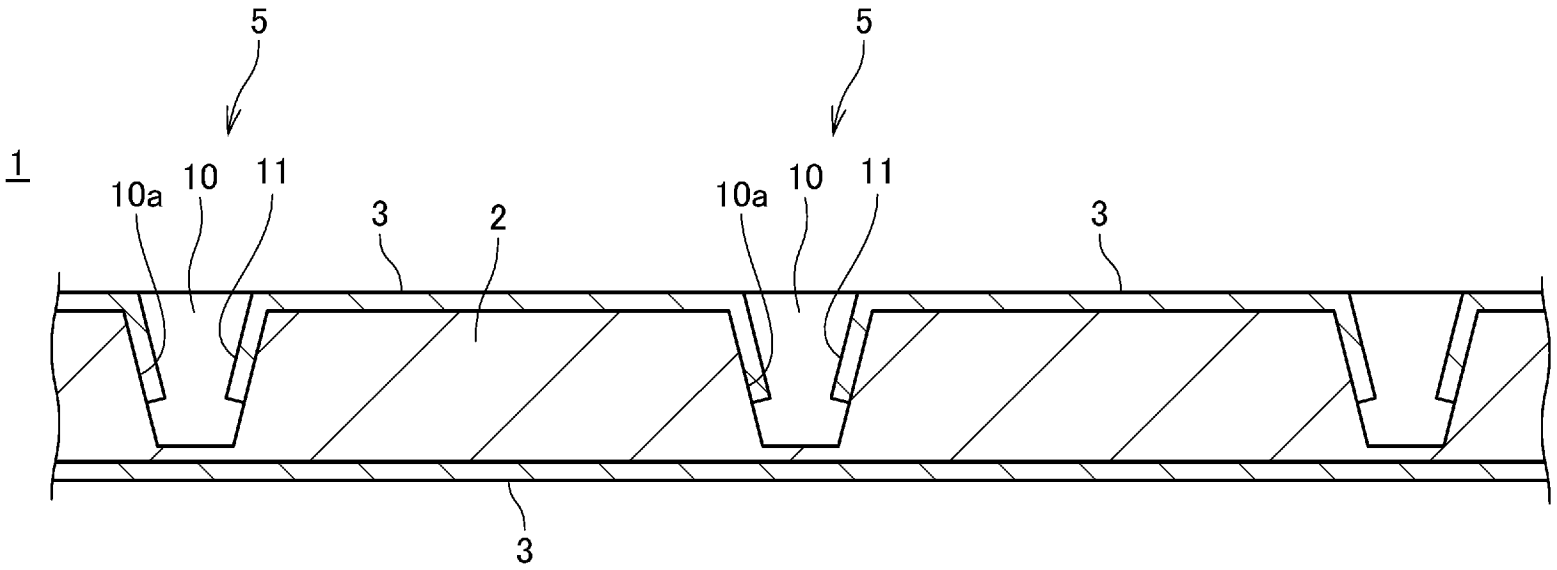
FIG. 5 is a cross-sectional view of a fuse element in which the second high melting point metal layer is provided as far as upper sides of the ends of hole openings.

Note that with the restricting portions 5, it is sufficient for at least part of the side surfaces 10*a* of the holes 10 to be covered by the second high melting point metal layer 11 continuous with the first high melting point metal layer 3, and as illustrated in FIG. 5, the second high melting point metal layer 11 may cover up to upper sides of the side surfaces 10*a*. Additionally, with the restricting portions 5, the holes 10 may be formed or pass through by piercing a layered body constituted by the low melting point metal layer 2 and the first high melting point metal layer 3 with a pointed object from the top of the first high melting point metal layer 3 such that some of the first high melting point metal layer 3 is pushed onto the side surfaces 10*a* of the holes 10 to serve as the second high melting point metal layer 11.

As illustrated in FIG. 5, by layering the second high melting point metal layer 11 continuous with the first high melting point metal layer 3 onto the ends of the side surfaces 10*a* of the holes 10, the second high melting point metal layer 11 layered onto the side surfaces 10*a* of the holes 10 suppresses flowing of the melted low melting point metal and supports the first high melting point metal layer 3 on the end sides of the openings, and thus local collapsing or expansion of the fuse element 1 can be suppressed.

Figure 6A:
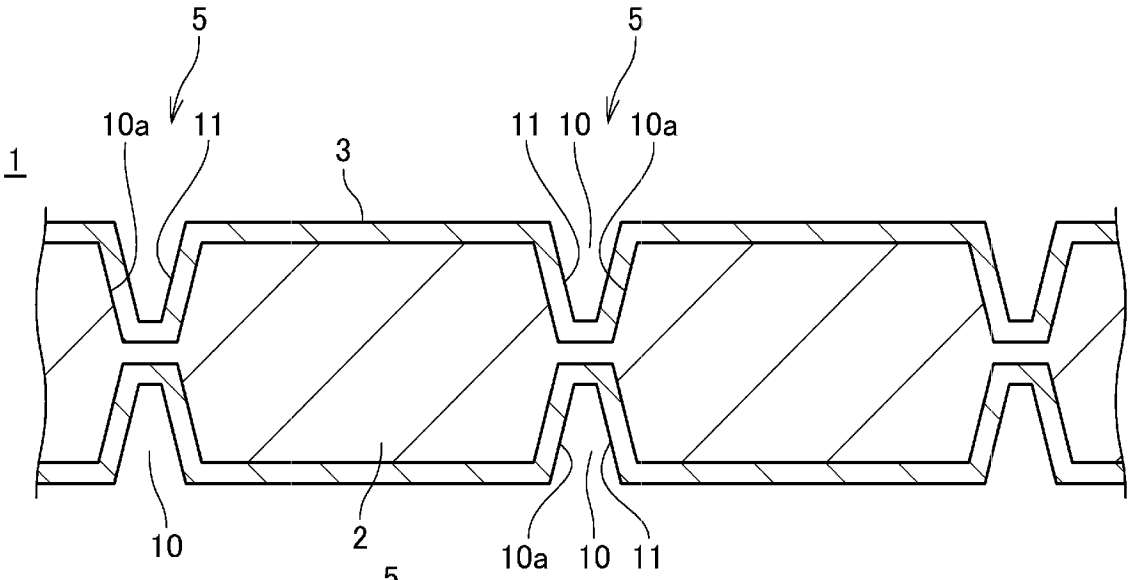
FIG. 6A is a cross-sectional view of a fuse element in which closed-ended holes are formed opposite each other.
Figure 6B:
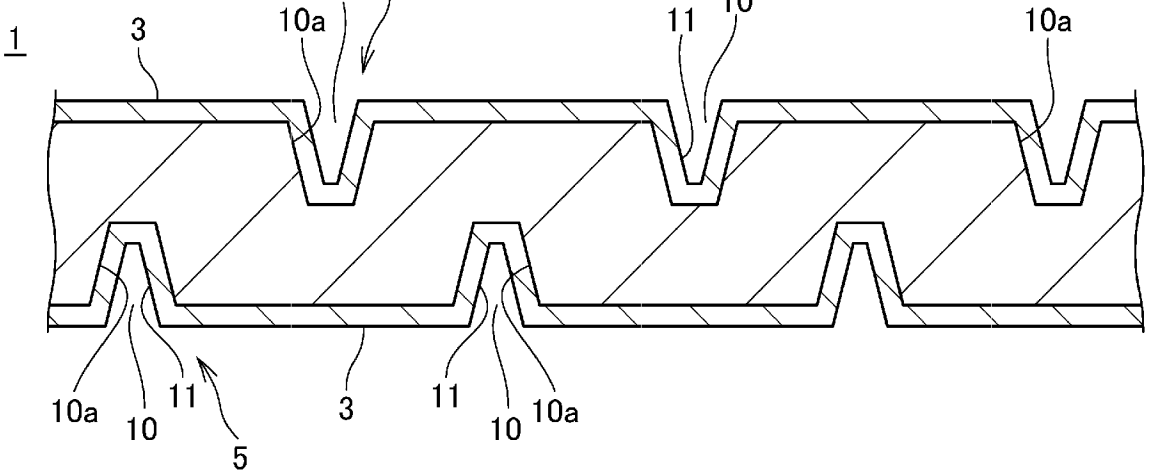
FIG. 6B is a cross-sectional view of a fuse element in which closed-ended holes are formed not opposite each other.

Additionally, as illustrated in FIG. 6A, the restricting portions 5 may be formed by forming the holes 10 as closed-ended holes so that the holes in one surface of the low melting point metal layer 2 and in another surface of the low melting point metal layer 2 are opposite each other. Alternatively, as illustrated in FIG. 6B, the restricting portions 5 may be formed by forming the holes 10 as closed-ended holes so that the holes in the one surface of the low melting point metal layer 2 and in the other surface of the low melting point metal layer 2 are not opposite each other. Even in a case where closed-ended holes 10 are formed in both surfaces of the low melting point metal layer 2 so as to be opposite or not opposite each other, flowing of the melted low melting point metal is restricted by the second high melting point metal layer 11 covering the side surfaces 10*a* of the holes 10, and the first high melting point metal layer 3 constituting the outer layer is supported. Accordingly, the fuse element 1 can suppress a situation in which the melted low melting point metal agglomerates due to tension and expands, or the melted low melting point metal flows out and becomes thinner, and as a result, collapsing or bulging locally arises.

From the standpoint of manufacturing efficiency, it is preferable that the holes 5 of the restricting portions 5 have diameters of a size at which a plating liquid for covering the side surfaces 10*a* of the holes 10 with the second high melting point metal layer 11 through electroplating can flow thereinto, such as a minimum hole diameter of greater than or equal to 50 μm, and more preferable from 70 to 80 μm. Although the maximum diameter of the holes 10 can be set as appropriate in light of the plating limit of the second high melting point metal layer 11, the thickness of the fuse element 1, and the like, an initial resistance value tends to rise in a case where the hole diameter is too large.

Additionally, with the restricting portions 5, it is preferable that the depth of the holes 10 be greater than or equal to 50% of the thickness of the low melting point metal layer 2. In a case where the holes 10 are shallower than this, flowing of the melted low melting point metal cannot be suppressed, and the fusing characteristics will vary due to deformation in the fuse element 1.

Additionally, with the restricting portions 5, it is preferable that the holes 10 formed in the low melting point metal layer 2 be formed at a prescribed density, such as one or more every 15×15 mm.

Additionally, with the restricting portions 5, it is preferable that the holes 10 be formed in an area of the fuse element 1 that fuses during overcurrent. The fuse element 1 fuses at an area that is not supported by the first and second electrodes 22 and 23 of the fuse device 20 and thus has a relatively low rigidity, and as such, that area deforms easily due to flowing of the low melting point metal. Accordingly, forming the holes 10 in the area of the fuse element 1 that fuses and covering the side surfaces 10*a* with the second high melting point metal layer 11 makes it possible to suppress flowing of the low melting point metal in the area that fuses and prevent deformation.

Additionally, with the restricting portions 5, it is preferable that the holes 10 be provided in at least a central portion of the fuse element 1. The fuse element 1 is supported by the first and second electrodes 22 and 23 on both end portions, and the central portion, which is furthest from the outer perimeter, has the lowest rigidity and therefore deforms easily. As such, providing the holes 10, in which the side surfaces 10*a* are covered by the second high melting point metal layer 11, in the central portion of the fuse element 1 makes it possible to increase the rigidity of the central portion and effectively prevent deformation.

Additionally, with the restricting portions 5, a difference in the number or density of the holes 10 on both sides of a line passing through the center of the fuse element 1 may be less than or equal to 50%. In other words, with the restricting portions 5, to distribute the plurality of holes 10 throughout the fuse element 1 and ensure that the effects of the restricting portions 5 act in a substantially uniform manner across the entire surface of the fuse element 1, a difference in the number or density of the holes 10 on both sides of the line passing through the center of the fuse element 1 is set to be within 50%. For example, in the case where three of the holes 10 are arranged uniformly across the entire surface of the fuse element 1 in order to achieve balance with three-point support, the difference in the number or density of the holes 10 on both sides of the line passing through the center of the fuse element 1 is 50%. Setting the difference in the number or density of the holes 10 on both sides of the line passing through the center of the fuse element to less than or equal to 50% makes it possible to increase the overall rigidity of the fuse element 1 and effectively prevent deformation.

Method for Manufacturing Fuse Element 1

The fuse element 1 can be manufactured by first forming the holes 10 constituting the restricting portions 5 in the low melting point metal layer 2, and then depositing the high melting point metal onto the low melting point metal layer 2 using a plating technique. The fuse element 1 can be efficiently manufactured and easily used by, for example, manufacturing an element film by forming the prescribed holes 10 in a long solder foil and plating the surface thereof with Ag, and then cutting the element film to size when the element film is to be used.

With a fuse element of the related art constituted only of a layered structure including a low melting point metal layer and a high melting point metal layer, the inflow of the connection solder 28 and outflow of the low melting point metal from the cut surfaces cannot be avoided. As such, it is necessary to carry out a process such as bending both end portions or process an outer housing side of the fuse device in order to prevent contact between the cut surfaces and the connection solder 28, which results in problems such as an increase in the number of manufacturing steps and difficulties in making the fuse device smaller.

With respect to this point, with the fuse element 1, the restricting portions 5 suppress a situation in which the melted low melting point metal flows, even in a case where the low melting point metal layer 2 is exposed from the cut surfaces. As such, inflow of the connection solder 28 and outflow of the low melting point metal from the cut surfaces can be suppressed, and variations in the resistance value and the fusing characteristics caused by variations in the thickness can be prevented. Accordingly, it is not necessary to bend both end portions where the cut surfaces are exposed, process the outer housing of the fuse device 20, or the like, which makes it possible to improve the manufacturing efficiency and make the fuse device smaller.

Even in a case where a thin-film formation technique such as vapor deposition or another known layering technique is used for the fuse element 1, the fuse element 1 in which the low melting point metal layer 2 and the first high melting point metal layer 3 are layered can be formed.

Note that in the fuse element 1, an anti-oxidation film (not illustrated) may be formed on the surface of the first high melting point metal layer 3 constituting the outer layer. Even in a case where, for example, a Cu plating layer is formed as the first high melting point metal layer 3, further covering the first high melting point metal layer 3 constituting the outer layer with the anti-oxidation film makes it possible for the fuse element 1 to prevent Cu oxidation. The fuse element 1 can therefore prevent a situation in which the fusing time is lengthened due to Cu oxidation, and ensure fusing in a short amount of time.

Additionally, an inexpensive but easily oxidizing metal such as Cu can be used for the first high melting point metal layer 3, and thus the fuse element 1 can be formed without using an expensive raw material such as Ag.

The same raw material as the low melting point metal layer 2 can be used for the anti-oxidation film on the high melting point metal, such as Pb-free solder using Sn as its main component. The anti-oxidation film can be formed by plating the surface of the first high melting point metal layer 3 with tin. The anti-oxidation film can also be formed through Au plating or preflux.

Element Sheet

The fuse element 1 may be cut to a desired size from a large element sheet. In other words, a large element sheet may be formed from a layered body constituted of the low melting point metal layer 2 and the first high melting point metal layer 3 in which the restricting portions 5 have been formed uniformly across the entire surface, and a plurality of the fuse elements 1 may be formed by being cut out from the element sheet at desired sizes. The restricting portions 5 are formed uniformly across the entire surface of each fuse element 1 cut out from the element sheet, and thus a situation in which the melted low melting point metal flows is suppressed by the restricting portions 5, even in a case where the low melting point metal layer 2 is exposed from the cut surfaces. As such, inflow of the connection solder 28 and outflow of the low melting point metal from the cut surfaces can be suppressed, and variations in the resistance value and the fusing characteristics caused by variations in the thickness can be prevented.

With the above-described manufacturing method that first manufactures an element film by forming the prescribed holes 10 in a long solder foil and carries out electroplating on the surface thereof, and then cuts that element film into prescribed lengths, the size of the fuse element 1 has been limited by the width of the element film, and it has thus been necessary to manufacture the element film on a size-by-size basis.

However, forming a large element sheet makes it possible to cut out the fuse element 1 at a desired size, which increases the freedom of the sizes.

Additionally, in a case where a long solder foil is subjected to electroplating, the first high melting point metal layer 3 is plated more thickly at side edge parts with respect to the longitudinal direction in which the electrical field concentrates, which has made it difficult to obtain a fuse element 1 having a uniform thickness. The fusing characteristics have changed depending on how these thick parts of the fuse element 1 are arranged in the fuse device, which limits how the fuse element 1 can be arranged.

However, forming a large element sheet makes it possible to avoid the thick parts when cutting out the fuse element 1, which makes it possible to obtain a fuse element 1 having a uniform thickness across the entire surface thereof. Accordingly, with the fuse element 1 cut out from the element sheet, the fusing characteristics do not change depending on the arrangement, which provides a high freedom of arrangement and stable fusing characteristics.

High Melting Point Particles

Figure 7:
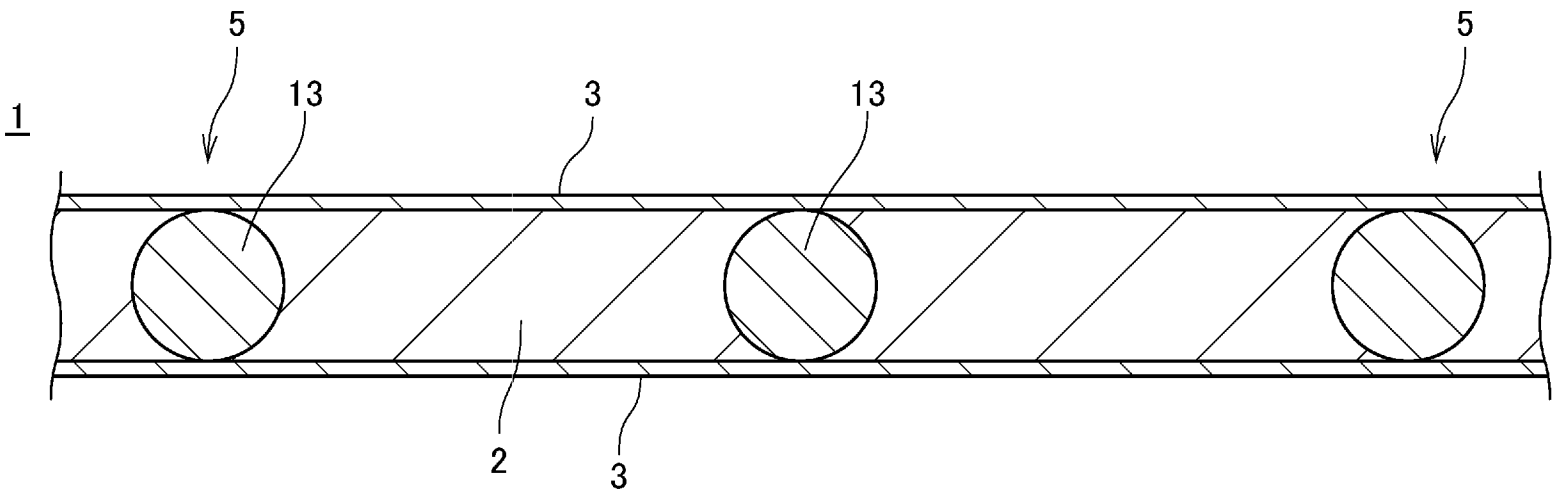
FIG. 7 is a cross-sectional view of a fuse element in which first high melting point particles are dispersed throughout the low melting point metal layer.

As illustrated in FIG. 7, in the fuse element 1, the restricting portions 5 may be formed by dispersing first high melting point particles 13, having a higher melting point than that of the low melting point metal layer 2, throughout the low melting point metal layer 2. A material having a melting point high enough so as not to melt even at the reflow temperature is used for the first high melting point particles 13; particles constituted of metals such as Cu, Ag, and Ni, alloys containing those metals, glass particles, ceramic particles, and the like can be used. No limitation is placed on the shape of the first high melting point particles 13, which may be spherical, flake-shaped, or the like. Metals and alloys have a higher specific gravity than that of glass or ceramics, and thus first high melting point particles 13 constituted thereof have good familiarity and superior dispersiveness.

The restricting portions 5 are formed by first distributing the first high melting point particles 13 in the low melting point metal raw material and then molding the raw material into a film shape, for example, in order to form the low melting point metal layer 2 in which the first high melting point particles 13 are dispersed in a single layer, and then layering the first high melting point metal layer 3. With the restricting portions 5, the first high melting point particles 13 may be brought into close contact with the first high melting point metal layer 3 by pressing the fuse element 1 in the thickness direction thereof after layering the first high melting point metal layer 3. As such, with the restricting portions 5, the first high melting point metal layer 3 is supported by the first high melting point particles 13, and thus even in the case where the low melting point metal has melted due to reflow heating, flowing of the low melting point metal is suppressed, and the first high melting point metal layer 3 is supported, by the first high melting point particles 13, which makes it possible to suppress the occurrence of local collapsing or expansion in the fuse element 1.

Figure 8A:
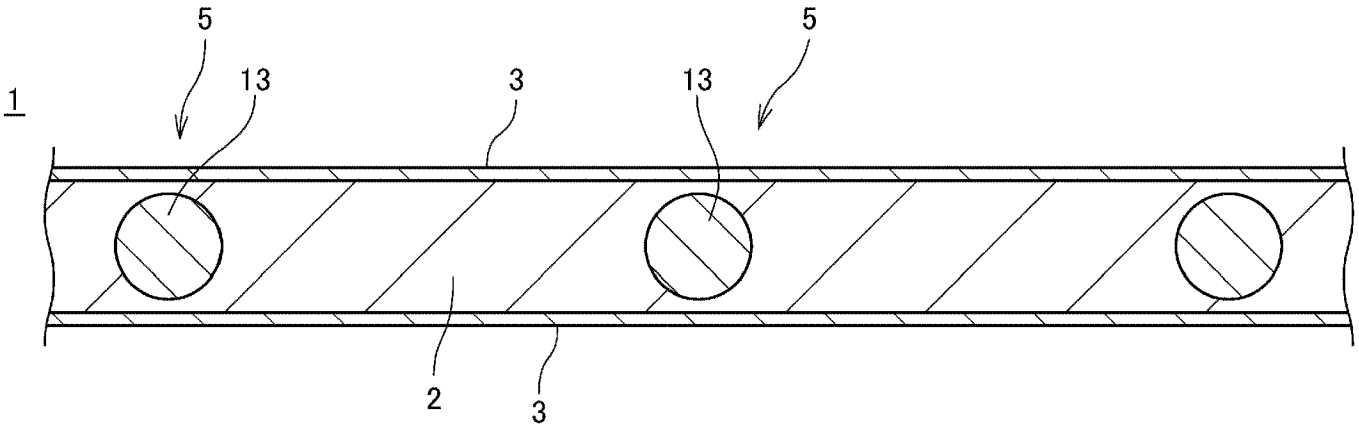
FIG. 8A is a cross-sectional view of a fuse element, in which first high melting point particles having a smaller particle size than the thickness of the low melting point metal layer are dispersed throughout the low melting point metal layer, before reflow mounting.
Figure 8B:
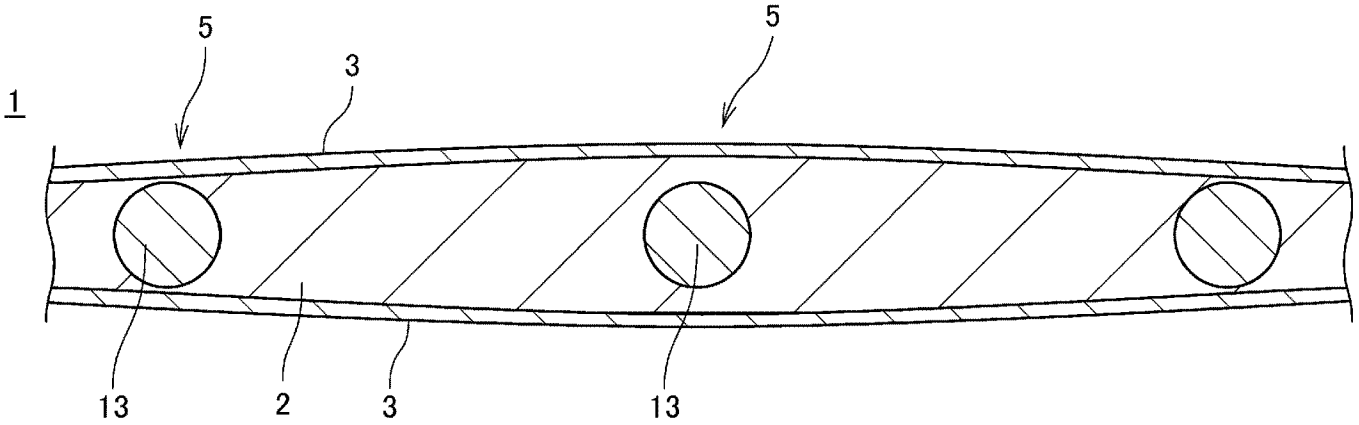
FIG. 8B is a cross-sectional view of the fuse element illustrated in FIG. 8A after reflow mounting.

Additionally, with the restricting portions 5, the first high melting point particles 13 having a particle size smaller than the thickness of the low melting point metal layer 2 may be distributed in the low melting point metal layer 2, as illustrated in FIG. 8A. In this case too, as illustrated in FIG. 8B, with the restricting portions 5, flowing of the melted low melting point metal can be suppressed, and the first high melting point metal layer 3 can be supported, by the first high melting point particles 13, which makes it possible to suppress the occurrence of local collapsing or expansion in the fuse element 1.

Figure 9:
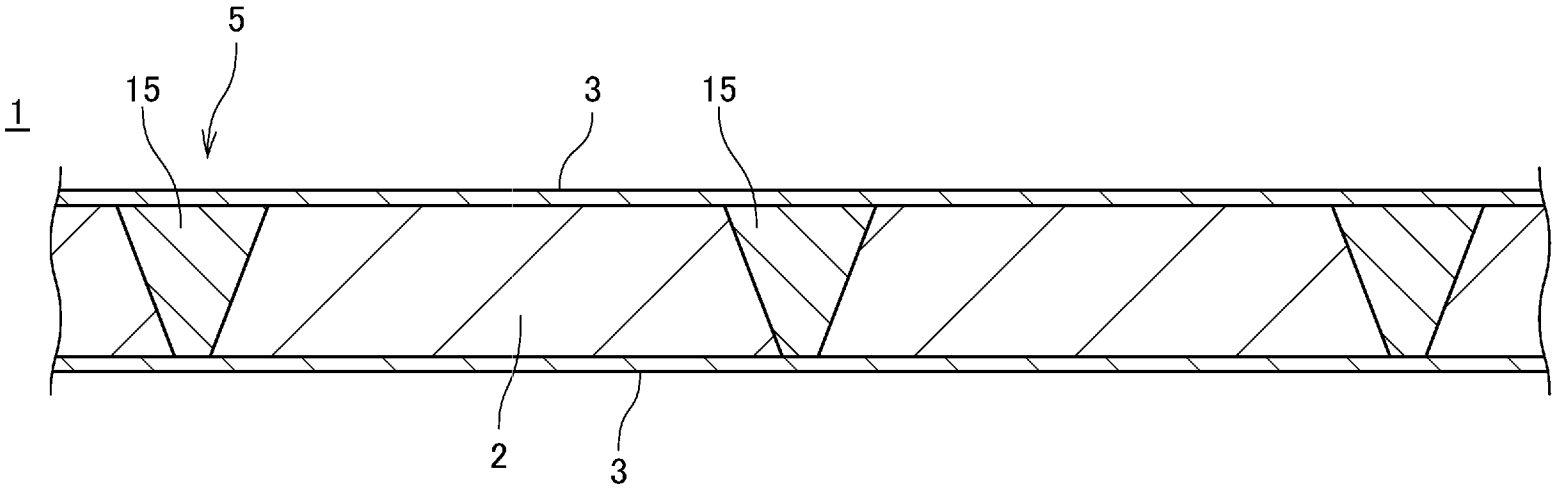
FIG. 9 is a cross-sectional view of a fuse element in which second high melting point particles are pressed into the low melting point metal layer.

As illustrated in FIG. 9, in the fuse element 1, the restricting portions 5 may be formed by pressing second high melting point particles 15, having a higher melting point than that of the low melting point metal layer 2, into the low melting point metal layer 2. The same material as a material used for the above-described first high melting point particles 13 can be used for the second high melting point particles 15.

The restricting portions 5 are formed by first pressing and embedding the second high melting point particles 15 in the low melting point metal layer 2 and then layering the first high melting point metal layer 3. At this time, it is preferable that the second high melting point particles 15 penetrate through the low melting point metal layer 2 in the thickness direction thereof. As such, with the restricting portions 5, the first high melting point metal layer 3 is supported by the second high melting point particles 15, and thus even in the case where the low melting point metal has melted due to reflow heating, flowing of the low melting point metal is suppressed, and the first high melting point metal layer 3 is supported, by the second high melting point particles 15, which makes it possible to suppress the occurrence of local collapsing or expansion in the fuse element 1.

Figure 10:
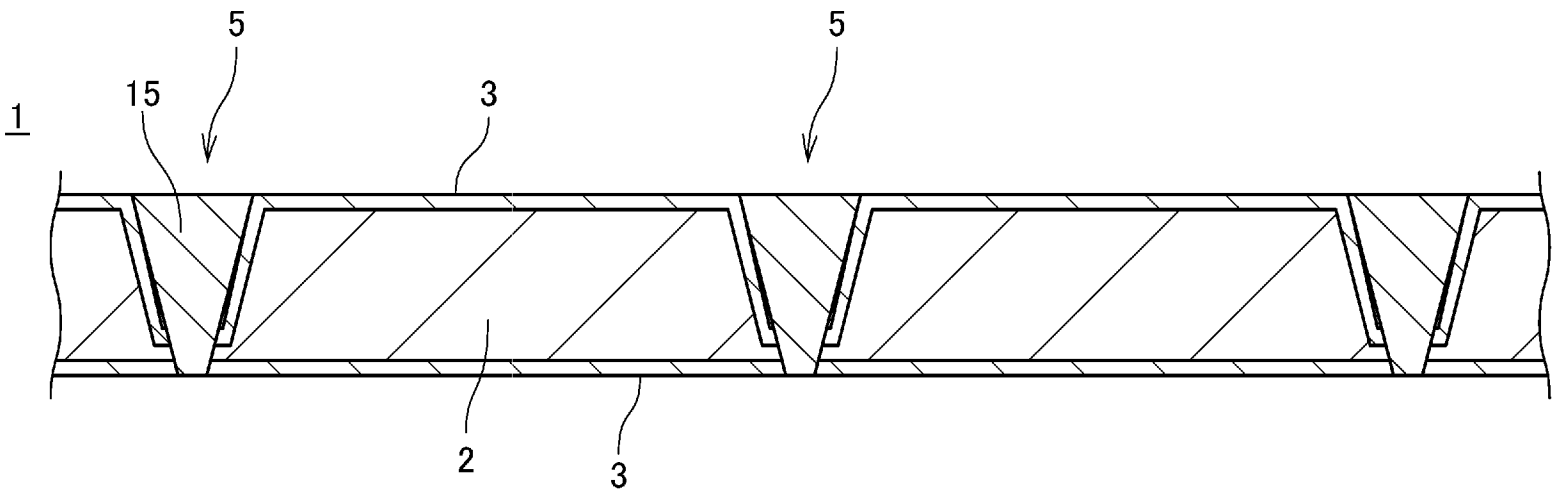
FIG. 10 is a cross-sectional view of a fuse element in which second high melting point particles are pressed into a first high melting point metal layer and the low melting point metal layer.

As illustrated in FIG. 10, in the fuse element 1, the restricting portions 5 may be formed by pressing the second high melting point particles 15, having a higher melting point than that of the low melting point metal layer 2, into the first high melting point metal layer 3 and the low melting point metal layer 2.

The restricting portions 5 are formed by pressing the second high melting point particles 15 into the layered body constituted of the low melting point metal layer 2 and the first high melting point metal layer 3 and thus embedding the second high melting point particles 15 in the low melting point metal layer 2. At this time, it is preferable that the second high melting point particles 15 penetrate through the low melting point metal layer 2 and the first high melting point metal layer 3 in the thickness directions thereof. As such, with the restricting portions 5, the first high melting point metal layer 3 is supported by the second high melting point particles 15, and thus even in the case where the low melting point metal has melted due to reflow heating, flowing of the low melting point metal is suppressed, and the first high melting point metal layer 3 is supported, by the second high melting point particles 15, which makes it possible to suppress the occurrence of local collapsing or expansion in the fuse element 1.

Note that with the restricting portions 5, the holes 10 may be formed in the low melting point metal layer 2, the second high melting point metal layer 11 may be layered, and the second high melting point particles 15 may then be inserted into the holes 10.

Figure 11:
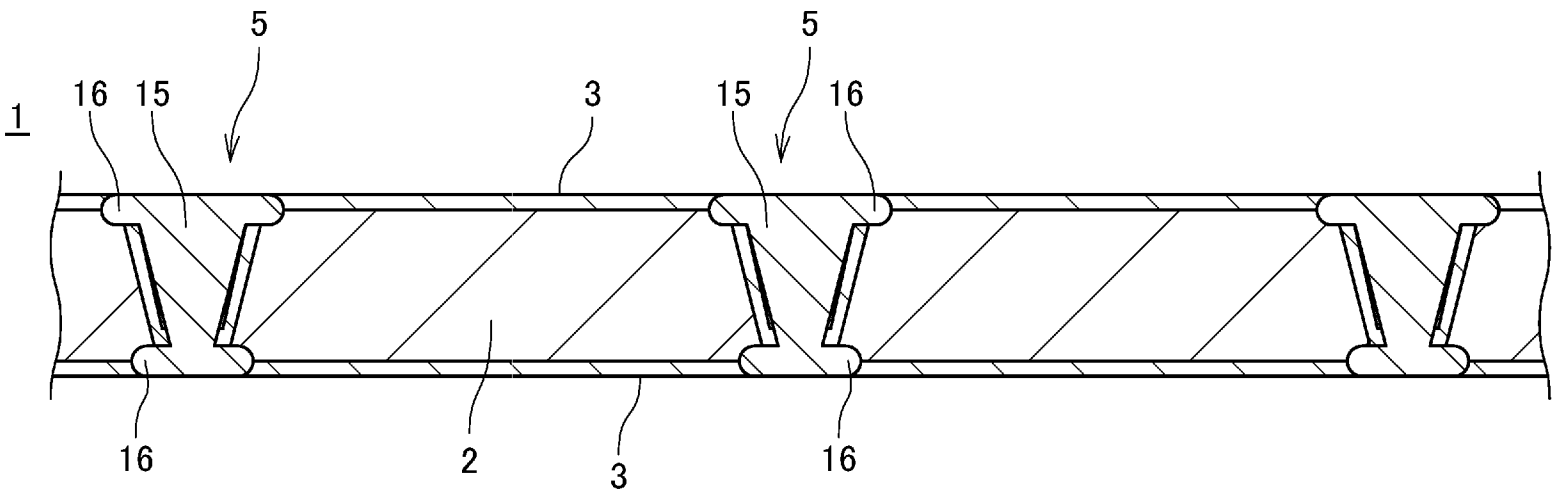
FIG. 11 is a cross-sectional view of a fuse element in which protruding rim portions are formed on both ends of the second high melting point particles.

Additionally, in the restricting portions 5, the second high melting point particles 15 may be provided with protruding rim portions 16 that bond to the first high melting point metal layer 3, as illustrated in FIG. 11. The protruding rim portions 16 can be formed by, for example, pressing the first high melting point particles 13 into the first high melting point metal layer 3 and the low melting point metal layer 2 and then flattening both ends of the second high melting point particles 15 by pressing the fuse element 1 in the thickness direction. As such, the first high melting point metal layer 3 is bonded to the protruding rim portions 16 of the second high melting point particles 15 and is thus more strongly supported by the restricting portions 5, so that even in the case where the low melting point metal has melted due to reflow heating, flowing of the low melting point metal is suppressed by the second high melting point particles 15 and the first high melting point metal layer 3 is supported by the protruding rim portions 16, which makes it possible to further suppress the occurrence of local collapsing or expansion in the fuse element 1.

Figure 12:
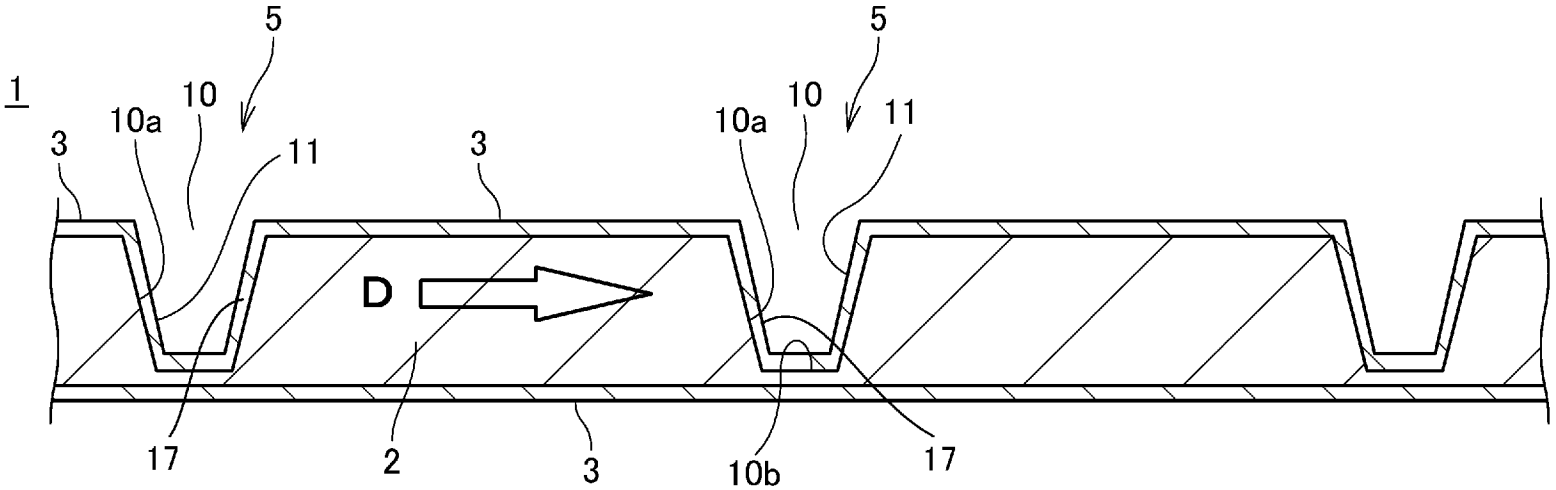
FIG. 12 is a cross-sectional view of a fuse element in which a restricting surface is formed by covering side surfaces of holes with the second high melting point metal layer.

Additionally, the restricting portions 5 may have surfaces not parallel with the direction in which the melted low melting point metal flows, or surfaces that are not the same as the first high melting point metal layer 3, as illustrated in FIG. 12. The restricting portions 5 have restricting surfaces 17 in which at least part of the side surfaces 10*a* of the one or more holes 10 provided in the low melting point metal layer 2, and preferably as far as the bottom surfaces 10*b* of the holes 10, are covered by the second high melting point metal layer 11 continuous with the first high melting point metal layer 3, so that a surface covered by the second high melting point metal layer 11 is not parallel with a flow direction D of the low melting point metal. This restricts flowing of the melted low melting point metal or restricts deformation of the layered body constituted by the first high melting point metal layer 3 and the low melting point metal layer 2. Additionally, the second high melting point metal layer 11 formed on the side surfaces 10*a* of the holes 10 provided in the low melting point metal layer 2 is continuous with the first high melting point metal layer 3 layered on the low melting point metal layer 2, and thus the restricting surfaces 17 are not the same surfaces as the first high melting point metal layer 3.

With the fuse element 1 formed in a plate shape, the low melting point metal flows in planar directions, and thus providing the restricting surfaces 17 that are not parallel with the flow direction D within the low melting point metal layer 2 makes it possible to restrict flowing of the melted low melting point metal or restrict deformation of the layered body constituted by the first high melting point metal layer 3 and the low melting point metal layer 2. Note that the restricting surfaces 17 can be formed through a process similar to that in the restricting portions 5 described above.

With the restricting surfaces 17, at least part of the side surfaces 10*a* of the holes 10 may be covered by the second high melting point metal layer 11, and the holes 10 may be filled by the second high melting point metal layer 11 (see FIG. 3). Additionally, the restricting surfaces 17 may be formed on the side surfaces of the holes 10 formed having a tapered cross-sectional shape, or may be formed on the side surfaces of the holes 10 formed having a rectangular cross-sectional shape (see FIG. 4).

Additionally, with the restricting surfaces 17, at least part of the side surfaces 10*a* of the holes 10 may be covered by the second high melting point metal layer 11 continuous with the first high melting point metal layer 3, or only the upper sides of the side surfaces 10*a* may be covered by the second high melting point metal layer 11 (see FIG. 5). Additionally, the holes 10 in which the restricting surfaces 17 are formed may be formed as closed-ended holes, and may be formed in the one surface and the other surface of the low melting point metal layer 2 so as to be opposite or not opposite each other. (See FIGS. 6A and 6B).

Figure 13:
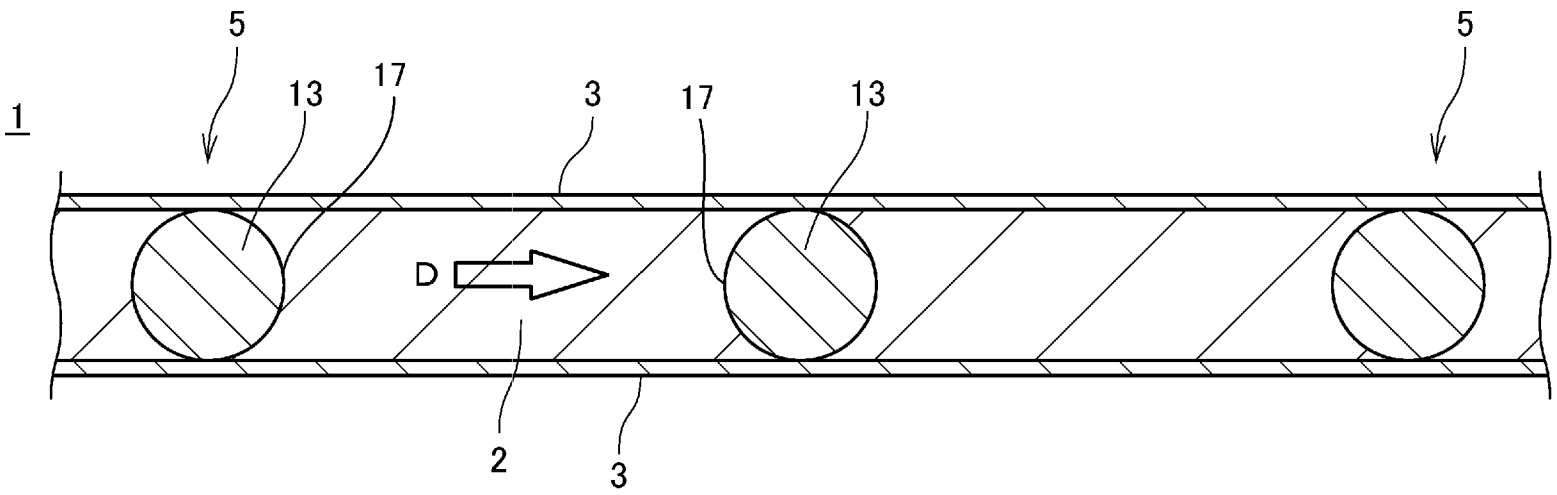
FIG. 13 is a cross-sectional view of a fuse element in which a restricting surface is formed by dispersing the first high melting point particles throughout the low melting point metal layer.

Additionally, in the fuse element 1, the first high melting point particles 13 having a higher melting point than that of the low melting point metal layer 2 may be distributed throughout the low melting point metal layer 2 such that surfaces of the first high melting point particles 13 not parallel to the flow direction D of the low melting point metal serve as the restricting surfaces 17, as illustrated in FIG. 13. The first high melting point particles 13 are distributed throughout the low melting point metal layer 2, or are brought into close contact with the first high melting point metal layer 3 by pressing in the thickness direction after layering the first high melting point metal layer 3. In either case, the restricting surfaces 17 that are not parallel to the flow direction D of the low melting point metal are not the same surface as the first high melting point metal layer 3.

With the fuse element 1, flowing of the melted low melting point metal is restricted, or deformation in the layered body constituted by the first high melting point metal layer 3 and the low melting point metal layer 2 is restricted, by the restricting surfaces 17 provided on the first high melting point particles 13. Note that in the fuse element 1, first high melting point particles 13 having a smaller particle size than the thickness of the low melting point metal layer 2 may be distributed throughout the low melting point metal layer 2.

Figure 14:
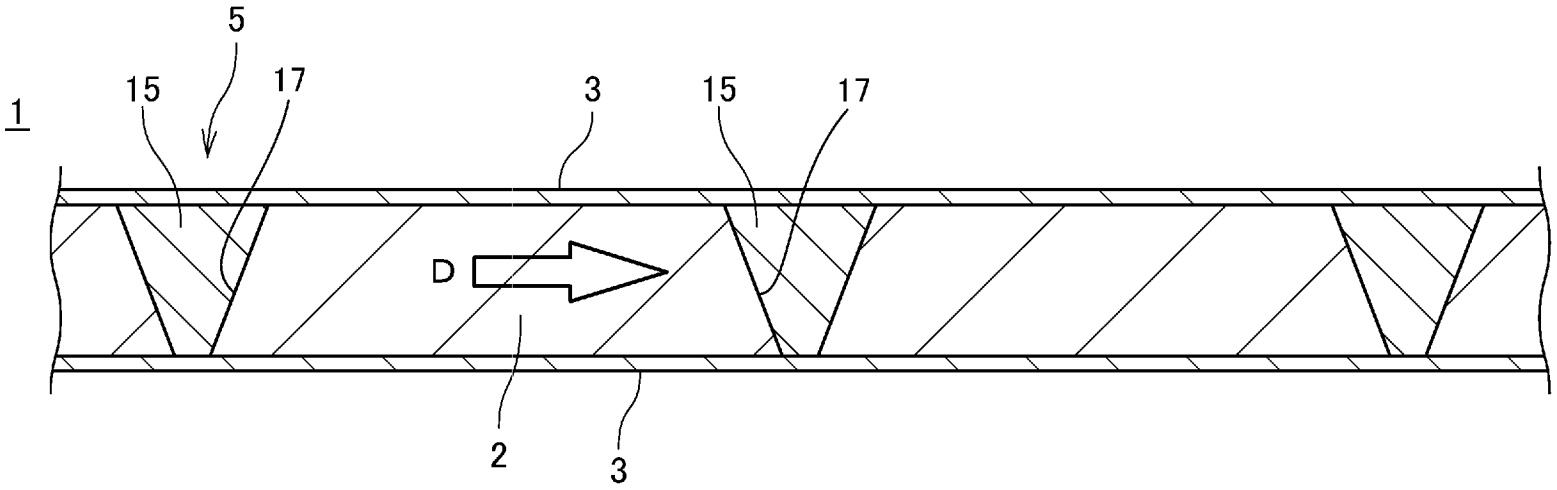
FIG. 14 is a cross-sectional view of a fuse element in which a restricting surface is formed by pressing the second high melting point particles in the low melting point metal layer.

Additionally, in the fuse element 1, the second high melting point particles 15 having a higher melting point than that of the low melting point metal layer 2 may be pressed into the low melting point metal layer 2 such that surfaces of the second high melting point particles 15 that are not parallel to the flow direction D of the low melting point metal serve as the restricting surfaces 17, as illustrated in FIG. 14. The restricting surfaces 17 of the second high melting point particles 15 that are not parallel to the flow direction D of the low melting point metal are not the same surface as the first high melting point metal layer 3.

As such, with the fuse element 1, the first high melting point metal layer 3 is supported by the second high melting point particles 15, and thus even in the case where the low melting point metal has melted due to reflow heating, flowing of the low melting point metal can be restricted, or deformation in the layered body constituted by the first high melting point metal layer 3 and the low melting point metal layer 2 can be restricted, by the restricting surfaces 17 formed within the low melting point metal layer 2.

Note that in the fuse element 1, the second high melting point particles 15 having a higher melting point than that of the low melting point metal layer 2 may be pressed into the layered body constituted by the first high melting point metal layer 3 and the low melting point metal layer 2 so as to form the restricting surfaces 17 within the low melting point metal layer 2 (see FIG. 10). Additionally, in the fuse element 1, the holes 10 may be formed in the low melting point metal layer 2, the second high melting point metal layer 11 may be layered, and the second high melting point particles 15 may then be inserted into the holes 10. Additionally, the second high melting point particles 15 may be provided with the protruding rim portions 16 that bond to the first high melting point metal layer 3 (see FIG. 11).

Fuse Device

A fuse device using the above-described fuse element 1 will be described next. As illustrated in FIG. 1, the fuse device 20 to which the present technique is applied includes: the electrically insulating substrate 21; the first electrode 22 and the second electrode 23 provided on the electrically insulating substrate 21; and the fuse element 1 that is mounted so as to bridge the first and second electrodes 22 and 23, fuses under its own heat build-up when current greater than a current rating flows through the element, and breaks the current path between the first electrode 22 and the second electrode 23.

The electrically insulating substrate 21 is formed as a quadrangle from a component having electrically insulating properties, such as alumina, glass ceramics, mullite, or zirconia. A raw material used in printed circuit boards, such as a glass epoxy substrate or a phenol substrate, may also be used for the electrically insulating substrate 21.

The first and second electrodes 22 and 23 are formed on opposing end portions of the electrically insulating substrate 21. The first and second electrodes 22 and 23 are formed of electrically conductive patterns such as Ag or Cu wiring, and protective layers constituted by Sn plating, Ni/Au plating, Ni/Pd plating, Ni/Pd/Au plating, or the like may be provided on the surfaces thereof as appropriate as an anti-oxidation measure. The first and second electrodes 22 and 23 continue from a front surface 21*a* of the electrically insulating substrate 21 to first and second outer connection electrodes 22*a* and 23*a* formed on a rear surface 21*b* of the electrically insulating substrate 21. The fuse device 20 is mounted in the current path of an outside circuit board via the first and second outer connection electrodes 22*a* and 23*a* formed on the rear surface 21*b*.

The fuse element 1 is connected to the first and second electrodes 22 and 23 via the connection solder 28.

As described above, the fuse element 1 includes the restricting portions 5, which suppress deformation even in high-temperature environments during reflow, and thus has excellent mounting properties; the fuse element 1 can be easily connected through reflow soldering or the like after being placed between the first and second electrodes 22 and 23 over the connection solder 28. Additionally, the fuse element 1 includes the restricting portions 5, and thus deformation is suppressed even when the fuse element 1 is repeatedly exposed to high-temperature environments such as when the fuse device 20 is reflow-mounted onto an outside circuit board, which makes it possible to suppress variations in the fusing characteristics. As such, the fuse element 1 and the fuse device 20 using the fuse element 1 can improve the mounting efficiency and maintain stable fusing characteristics.

A mounting state of the fuse element 1 will be described next. As illustrated in FIG. 1, in the fuse device 20, the fuse element 1 is mounted so as to be separated from the front surface 21*a* of the electrically insulating substrate 21.

On the other hand, in a fuse device in which the fuse element makes contact with the front surface of the electrically insulating substrate, such as when the fuse element is formed by being printed onto the front surface of the electrically insulating substrate, melted metal of the fuse element will adhere to the electrically insulating substrate between the first and second electrodes and produce leakage. For example, in a fuse device in which the fuse element is formed by printing Ag paste onto a ceramic substrate, the silver will sinter with and bite into the ceramic material and remain between the first and second electrodes. The melted residue of the fuse element results in leakage current flowing between the first and second electrodes, and thus the current path cannot be completely broken.

With respect to this point, in the fuse device 20, the fuse element 1 is formed as an independent body separate from the electrically insulating substrate 21, and is mounted so as to be separated from the front surface 21*a* of the electrically insulating substrate 21. Thus, with the fuse device 20, the fuse element 1 can be drawn onto the first and second electrodes 22 and 23 without melted metal biting into the electrically insulating substrate 21 when the fuse element 1 melts, and thus the first and second electrodes 22 and 23 can be reliably electrically insulated from each other.

Additionally, in the fuse device 20, the front surface and the rear surface of the fuse element 1 may be coated with flux 27 in order to prevent the first high melting point metal layer 3 or the low melting point metal layer 2 from oxidizing, remove oxidants during fusing, and improve the flow characteristics of the solder.

By coating the fuse element 1 with a flux sheet 27, it is possible, even in the case where an anti-oxidation film such as Pb-free solder having Sn as its main component is formed on the surface of the first high melting point metal layer 3 constituting the outer layer, to remove oxidants of the anti-oxidation film, which makes it possible to effectively prevent the first high melting point metal layer 3 from oxidizing and maintain and improve the fusing characteristics.

Additionally, in the fuse device 20, a cover component 29 that protects the interior and prevents the melted fuse element 1 from scattering is attached to the front surface 21*a* of the electrically insulating substrate 21 on which the fuse element 1 is provided. The cover component 29 can be formed from an electrically insulating component such as various types of engineering plastics or ceramics, and is connected using an electrically insulating adhesive. In the fuse device 20, the fuse element 1 is covered by the cover component 29, and thus melted metal can be trapped by the cover component 29 and prevented from scattering to the surrounding areas even when an arc discharge is produced by overcurrent and the fuse element 1 blows under its own heat build-up.

Circuit Configuration

Figure 15A:
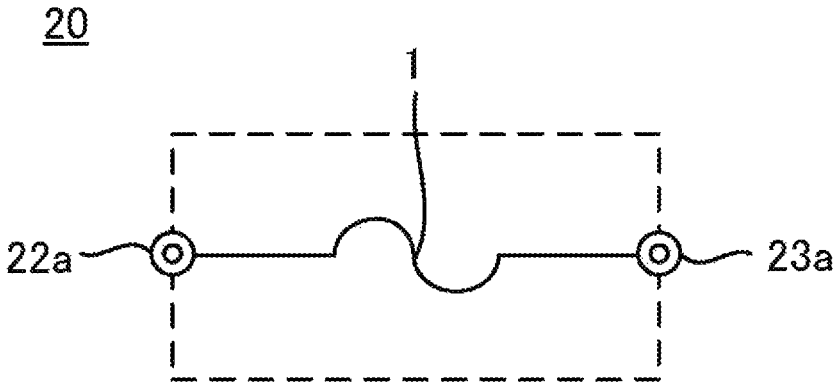
FIGS. 15A and 15B are circuit diagrams of a fuse device, where
Figure 15B:
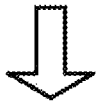
Figure 15B:
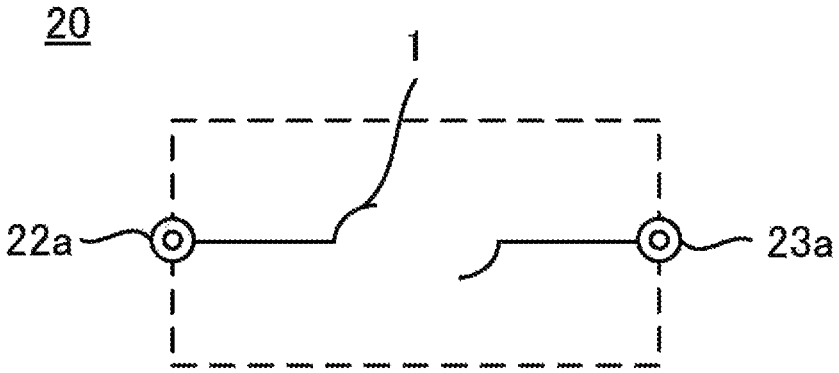

The fuse device 20 has the circuit configuration illustrated in FIG. 15A. The fuse device 20 is mounted on an outside circuit via the first and second outer connection electrodes 22*a* and 23*a*, and is incorporated into the current path of the outside circuit. With the fuse device 20, the fuse element 1 does not fuse under its own heat build-up while the prescribed rated current is flowing therein. However, in the fuse device 20, the fuse element 1 fuses under its own heat build-up when overcurrent greater than the current rating flows therein, which breaks the connection between the first and second electrodes 22 and 23 and thus breaks the current path of the outside circuit (FIG. 15B).

Here, as described above, the low melting point metal layer 2 having a lower melting point than that of the first high melting point metal layer 3 is layered in the fuse element 1. The fuse element 1 thus begins melting, under its own heat build-up produced by overcurrent, from the melting point of the low melting point metal layer 2, and the first high melting point metal layer 3 begins to erode. Accordingly, using the effect of the low melting point metal layer 2 eroding the first high melting point metal layer 3, the first high melting point metal layer 3 melts at a lower temperature than its own melting point, and thus the fuse element 1 can fuse quickly.

Protective Device

Figure 16A:
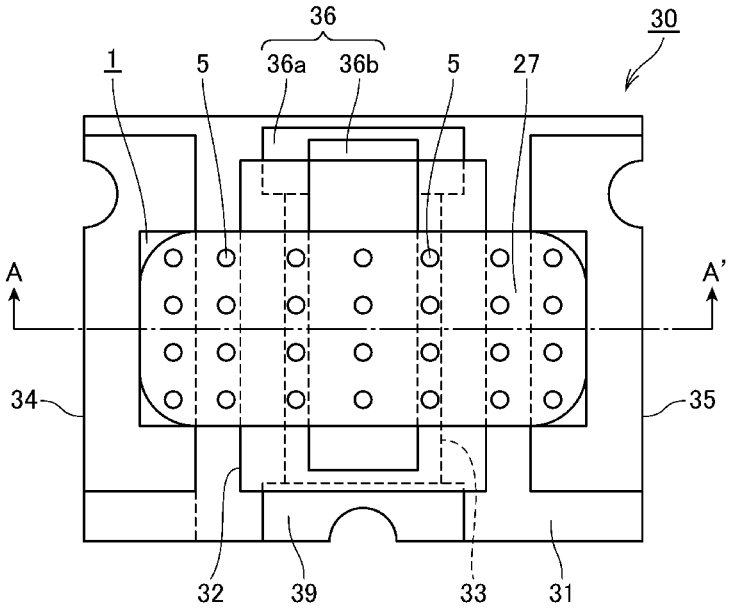
FIG. 16A is a plan view of a protective device using a fuse element to which the present invention is applied.
Figure 16B:
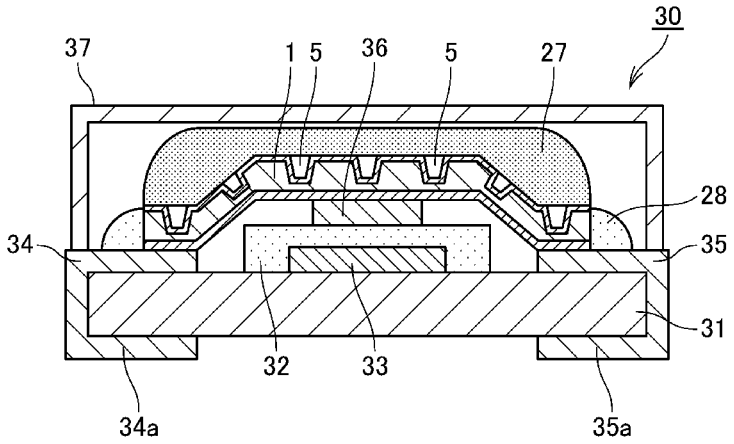
FIG. 16B is a cross-sectional view of the same.

A protective device using the above-described fuse element 1 will be described next. In the following descriptions, components that are the same as those in the above-described fuse device 20 will be given the same reference signs, and details thereof will be omitted. As illustrated in FIGS. 16A and 16B, a protective device 30 to which the present technique is applied includes: an electrically insulating substrate 31; a heat source 33 layered upon the electrically insulating substrate 31 and covered by an electrically insulating component 32; a first electrode 34 and a second electrode 35 formed on both ends of the electrically insulating substrate 31; a heat source connection electrode 36 layered above the electrically insulating substrate 31 overlapping with the heat source 33 and electrically connected to the heat source 33; and the fuse element 1, both ends of the fuse element 1 being connected to the first and second electrodes 34 and 35 and a central portion of the fuse element 1 being connected to the heat source connection electrode 36. In the protective device 30, a cover component 37 that protects the interior is attached to the top of the electrically insulating substrate 31.

Like the above electrically insulating substrate 21, the electrically insulating substrate 31 is formed as a quadrangle from a component having electrically insulating properties, such as alumina, glass ceramics, mullite, or zirconia. A raw material used in printed circuit boards, such as a glass epoxy substrate or a phenol substrate, may also be used for the electrically insulating substrate 31.

The first and second electrodes 34 and 35 are formed on opposing end portions of the electrically insulating substrate 31. The first and second electrodes 34 and 35 are formed by electrically conductive patterns of Ag, Cu, or the like. Additionally, the first and second electrodes 34 and 35 continue, via castellations, from a front surface 31*a* of the electrically insulating substrate 31 to first and second outer connection electrodes 34*a* and 35*a* formed on a rear surface 31*b* of the electrically insulating substrate 31. The first and second outer connection electrodes 34*a* and 35*a* formed on the rear surface 31*b* are connected to connection electrodes provided on the circuit board onto which the protective device 30 is mounted, and thus the protective device 30 is incorporated into part of the current path formed in the circuit board.

The heat source 33 is an electrically conductive component that builds up heat when energized, and is constituted of nichrome, W, Mo, Ru, a raw material containing these, or the like. The heat source 33 can be formed by mixing a powder of an alloy, a composition, or a compound of these with a resin binder or the like to form a paste, forming the paste into a pattern on the electrically insulating substrate 31 using a screen printing technique, and then firing the substrate, for example.

Additionally, in the protective device 30, the heat source 33 is covered by the electrically insulating component 32, and the heat source connection electrode 36 is formed opposing the heat source 33 with the electrically insulating component 32 interposed therebetween. The heat source connection electrode 36 is connected to the fuse element 1, and as a result, the heat source 33 overlaps the fuse element 1 with the electrically insulating component 32 and the heat source connection electrode 36 interposed therebetween. The electrically insulating component 32 is provided in order to protect and electrically insulate the heat source 33 and efficiently transfer heat from the heat source 33 to the fuse element 1, and is constituted of a glass layer, for example.

Note that the heat source 33 may be formed within the electrically insulating component 32 layered on the electrically insulating substrate 31. Additionally, the heat source 33 may be formed on the rear surface 31*b*, which is on the opposite side of the electrically insulating substrate 31 from the front surface 31*a* on which the first and second electrodes 34 and 35 are formed. Alternatively, the heat source 33 may be formed on the front surface 31*a* of the electrically insulating substrate 31, adjacent to the first and second electrodes 34 and 35. Additionally, the heat source 33 may be formed within the electrically insulating substrate 31.

Additionally, one end of the heat source 33 is connected to the heat source connection electrode 36, and another end of the heat source 33 is connected to a heat source electrode 39. The heat source connection electrode 36 includes a lower layer portion 36*a* formed upon the front surface 31*a* of the electrically insulating substrate 31 and connected to the heat source 33, and an upper layer portion 36*b* layered upon the electrically insulating component 32 opposing the heat source 33 and connected to the fuse element 1. Accordingly, the heat source 33 is electrically connected to the fuse element 1 via the heat source connection electrode 36. Note that the fuse element 1 can be caused to melt, and the melted electrical conductor can be made to agglomerate more easily, by disposing the heat source connection electrode 36 opposite the heat source 33 with the electrically insulating component 32 interposed therebetween.

Figure 17A:
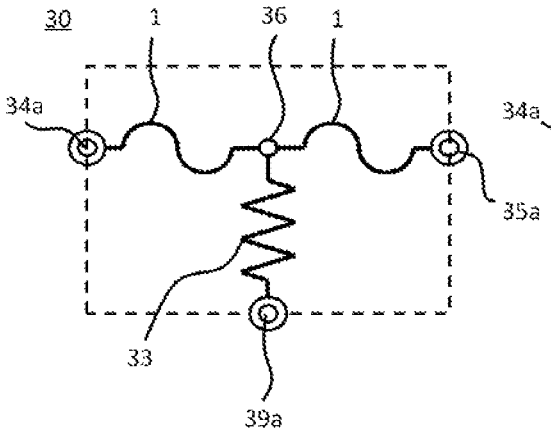
FIGS. 17A and 17B are circuit diagrams of the protective device, where

Meanwhile, the heat source electrode 39 is formed on the front surface 31*a* of the electrically insulating substrate 31, and continues, via a castellation, to a heat source power supply electrode 39*a* formed on the rear surface 31*b* of the electrically insulating substrate 31 (see FIG. 17A).

In the protective device 30, the fuse element 1 is connected from the first electrode 34 to the second electrode 35 over the heat source connection electrode 36. The fuse element 1 is connected to the first and second electrodes 34 and 35 and the top of the heat source connection electrode 36 by a connecting material such as the connection solder 28.

As described above, the fuse element 1 includes the restricting portions 5, which suppress deformation even in high-temperature environments during reflow, and thus has excellent mounting properties; the fuse element 1 can be easily connected through reflow soldering or the like after being placed between the first and second electrodes 34 and 35 via the connection solder 28. Additionally, the fuse element 1 includes the restricting portions 5, and thus deformation is suppressed even when the fuse element 1 is repeatedly exposed to high-temperature environments such as when the protective device 30 is reflow-mounted onto an outside circuit board, which makes it possible to suppress variations in the fusing characteristics. As such, the fuse element 1 and the protective device 30 using the fuse element 1 can improve the mounting efficiency and maintain stable fusing characteristics.

Flux

Additionally, in the protective device 30, the front surface and the rear surface of the fuse element 1 may be coated with the flux 27 in order to prevent the first high melting point metal layer 3 or the low melting point metal layer 2 from oxidizing, remove oxidants during fusing, and improve the flow characteristics of the solder. By coating the fuse element 1 with the flux 27, the wettability of the low melting point metal layer 2 (solder, for example) can be increased, oxidants produced when the low melting point metal melts can be removed, and the fusing characteristics can be improved by using the effect of eroding the high melting point metal (Ag, for example), when the protective device 30 is actually used.

Additionally, by coating the fuse element 1 with the flux 27, it is possible, even in the case where an anti-oxidation film such as Pb-free solder having Sn as its main component is formed on the surface of the first high melting point metal layer 3 constituting the outermost layer, to remove oxidants of the anti-oxidation film, which makes it possible to effectively prevent the first high melting point metal layer 3 from oxidizing and maintain and improve the fusing characteristics.

Preferably, the first and second electrodes 34 and 35, the heat source connection electrode 36, and the heat source electrode 39 are formed of electrically conductive patterns such as Ag or Cu, and protective layers constituted by Sn plating, Ni/Au plating, Ni/Pd plating, Ni/Pd/Au plating, or the like may be formed on the surfaces thereof as appropriate. This makes it possible to prevent the surfaces from oxidizing, as well as suppress the first and second electrodes 34 and 35 and the heat source connection electrode 36 from being eroded by the connecting material of the fuse element 1, such as the connection solder 28.

Cover Component

Additionally, in the protective device 30, the cover component 37 that protects the interior and prevents the melted fuse element 1 from scattering is attached to the front surface 31*a* of the electrically insulating substrate 31 on which the fuse element 1 is provided. The cover component 37 can be formed from an electrically insulating component such as various types of engineering plastics or ceramics. In the protective device 30, the fuse element 1 is covered by the cover component 37, and thus melted metal can be trapped by the cover component 37 and prevented from scattering to the surrounding areas.

In the protective device 30, an energizing path is formed through the heat source power supply electrode 39*a*, the heat source electrode 39, the heat source 33, the heat source connection electrode 36, and the fuse element 1, to the heat source 33. Additionally, in the protective device 30, the heat source electrode 39 is connected to the outside circuit that energizes the heat source 33 via the heat source power supply electrode 39*a*, and the energizing of the heat source electrode 39 to the fuse element 1 is controlled by the outside circuit.

Additionally, in the protective device 30, part of an energizing path to the heat source 33 is constituted by the fuse element 1 being connected to the heat source connection electrode 36. As such, with the protective device 30, the energizing path to the heat source 33 is broken when the connection with the outside circuit is broken by the fuse element 1 melting, which makes it possible to stop heat build-up.

Circuit Diagram

Figure 17B:
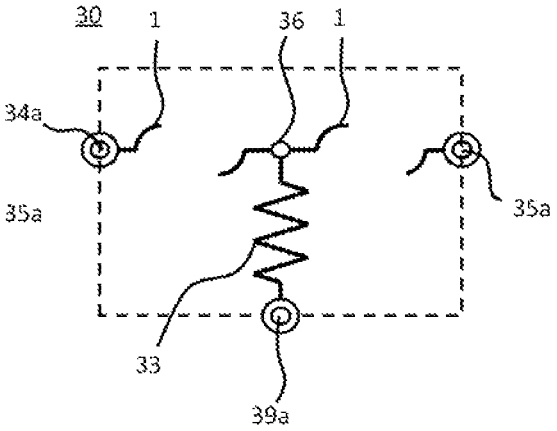

The protective device 30 to which the present technique is applied has a circuit configuration such as that illustrated in FIG. 17. That is, the protective device 30 has a circuit configuration constituted by the fuse element 1, which is connected in series between the first and second outer connection electrodes 34*a* and 35*a* via the heat source connection electrode 36, and the heat source 33, which is energized through a connection point with the fuse element 1 and builds up heat so as to melt the fuse element 1. Additionally, in the protective device 30, the first and second outer connection electrodes 34*a* and 35*a* and the heat source power supply electrode 39*a* connected to the first and second electrodes 34 and 35 and the heat source electrode 39, respectively, are connected to the outside circuit board. Accordingly, in the protective device 30, the fuse element 1 is connected in series in the current path of the outside circuit via the first and second electrodes 34 and 35, and the heat source 33 is connected, via the heat source electrode 39, to a current control device provided in the outside circuit.

Fusing Process

Figure 18:
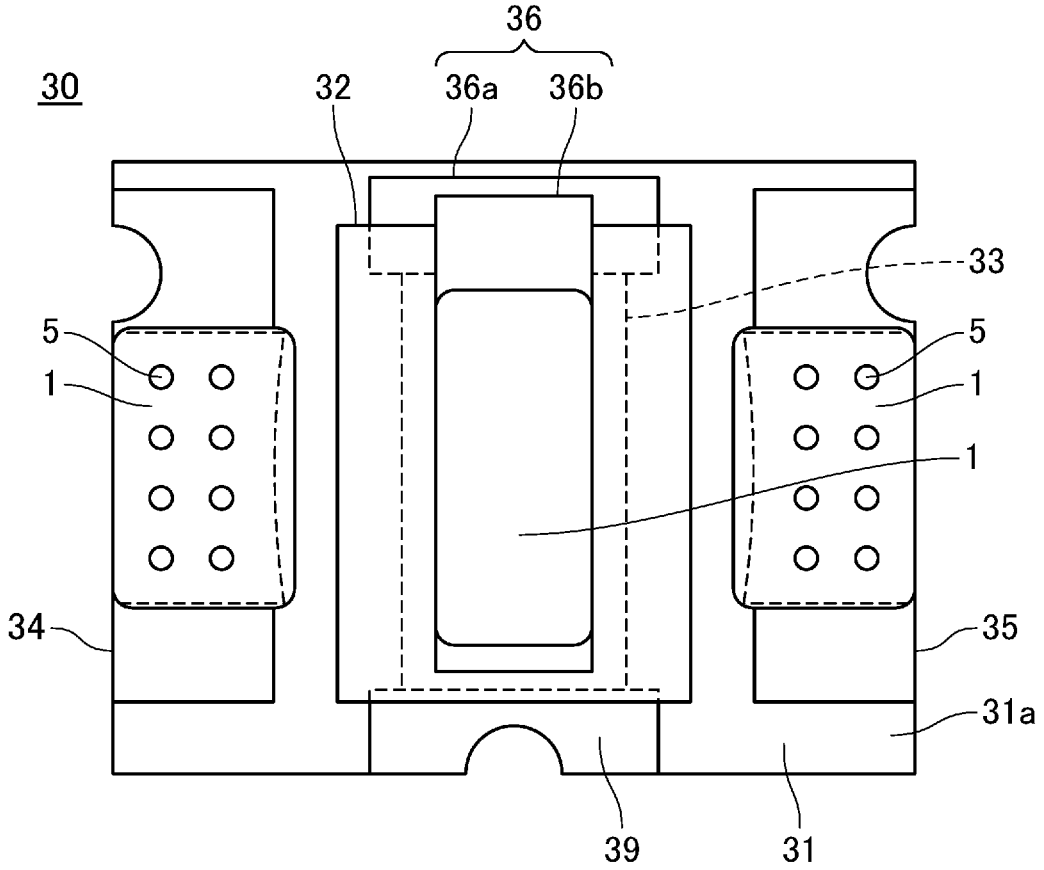
FIG. 18 is a plan view of a protective device after a fuse element has fused.

In the protective device 30 having such a circuit configuration, the heat source 33 is energized by the current control device provided in the outside circuit in the case where it is necessary for the current path of the outside circuit to be broken. Accordingly, in the protective device 30, the heat build-up of the heat source 33 causes the fuse element 1 incorporated into the current path of the outside circuit to melt, and as illustrated in FIG. 18, the melted electrical conductor of the fuse element 1 is drawn by the highly-wettable heat source connection electrode 36 and first and second electrodes 34 and 35, resulting in the fuse element 1 fusing. Accordingly, the fuse element 1 can fuse reliably between the first electrode 34, the heat source connection electrode 36, and the second electrode 35 (FIG. 17B), and the current path of the outside circuit can be broken. The supply of power to the heat source 33 is also stopped by the fuse element 1 fusing.

At this time, the heat build-up of the heat source 33 causes the fuse element 1 to begin melting from the melting point of the low melting point metal layer 2, which has a lower melting point than that of the first high melting point metal layer 3, and the first high melting point metal layer 3 begins to erode. Accordingly, using the effect of the low melting point metal layer 2 eroding the first high melting point metal layer 3, the first high melting point metal layer 3 melts at a lower temperature than its melting temperature, and thus the fuse element 1 can break the current path of the outside circuit quickly.

Short-Circuit Device

Figure 19:
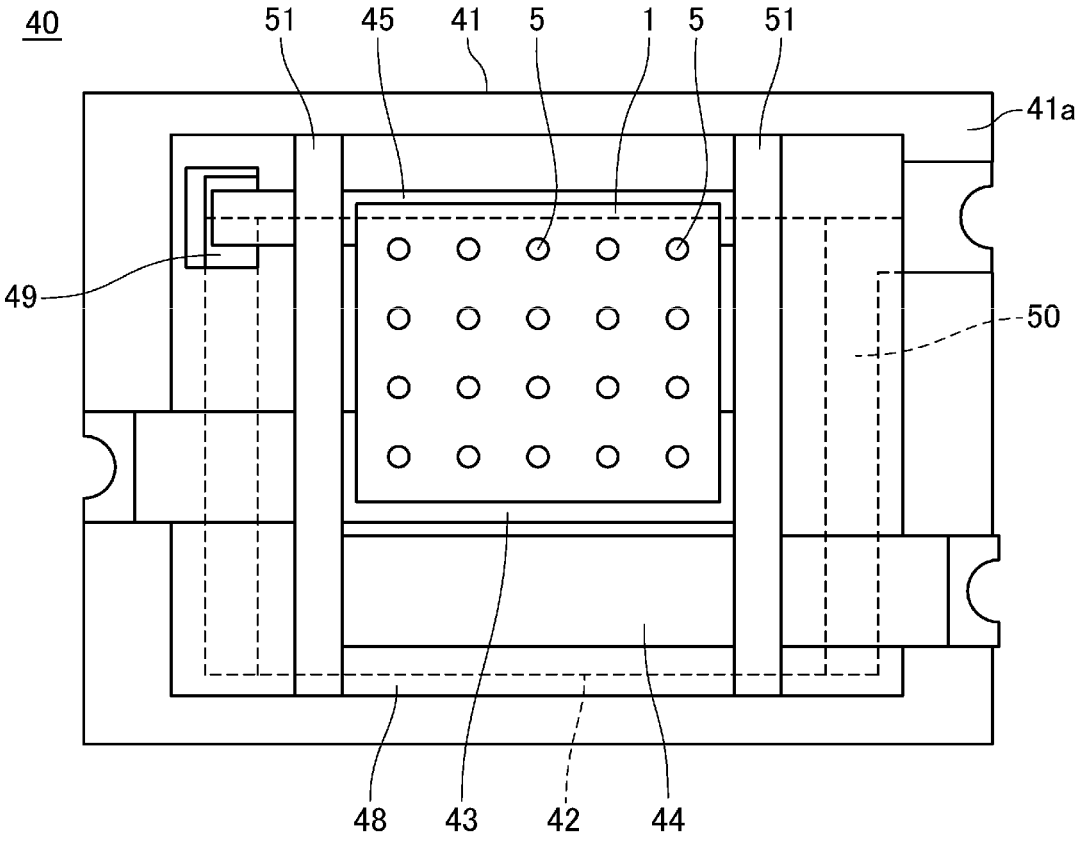
FIG. 19 is a plan view of a short-circuit device using a fuse element to which the present invention is applied.
Figure 20:
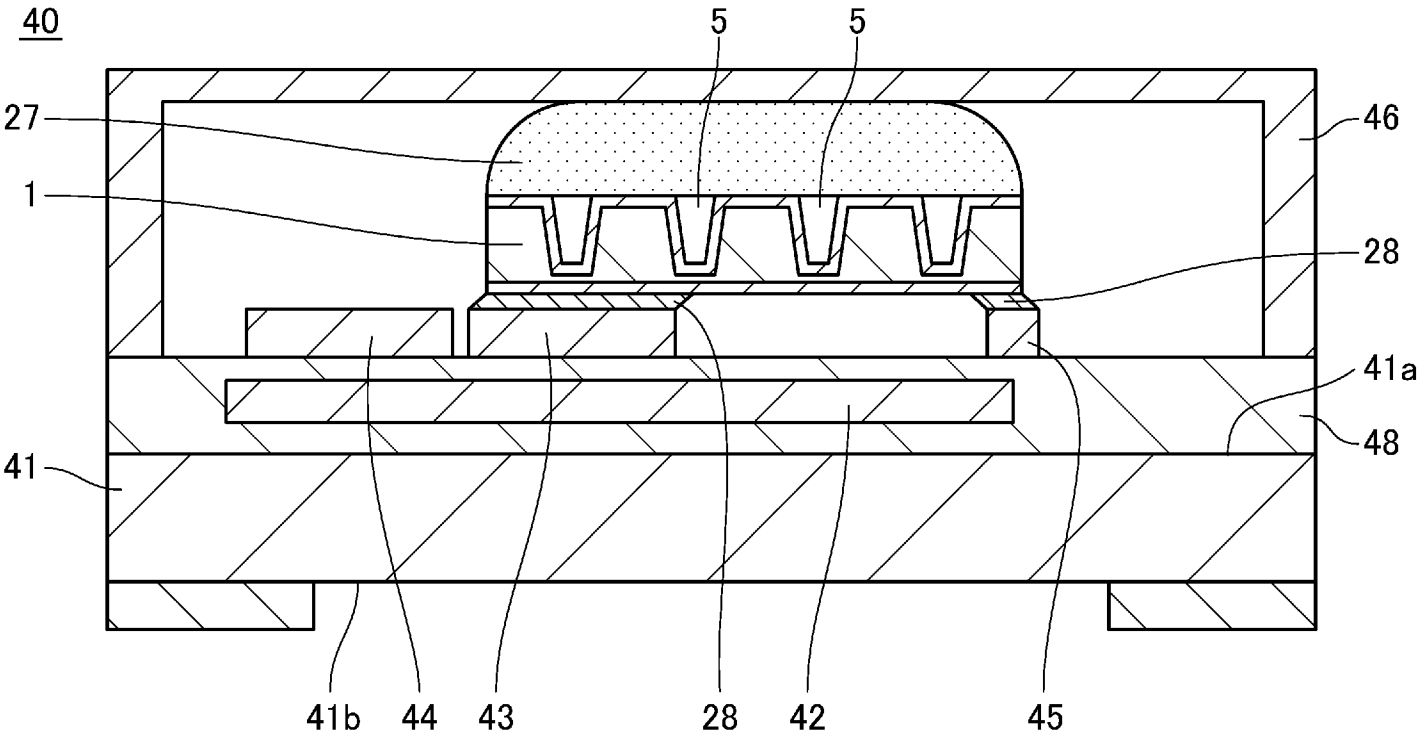
FIG. 20 is a cross-sectional view of a short-circuit device using a fuse element to which the present invention is applied.

A short-circuit device using the above-described fuse element 1 will be described next. In the following descriptions, components that are the same as those in the above-described fuse device 20 will be given the same reference signs, and details thereof will be omitted. FIG. 19 is a plan view of a short-circuit device 40, and FIG. 20 is a cross-sectional view of the short-circuit device 40. The short-circuit device 40 includes: an electrically insulating substrate 41; a heat source 42 provided on the electrically insulating substrate 41; a first electrode 43 and a second electrode 44 provided adjacent to each other on the electrically insulating substrate 41; a third electrode 45 provided adjacent to the first electrode 43 and electrically connected to the heat source 42; and the fuse element 1 constituting a current path by being provided across the first and third electrodes 43 and 45, the fuse element 1 being configured to break the current path between the first and third electrodes 43 and 45 by being heated by the heat source 42, and short-circuit the first and second electrodes 43 and 44 through a melted electrical conductor. In the short-circuit device 40, a cover component 46 that protects the interior is attached to the top of the electrically insulating substrate 41.

The electrically insulating substrate 41 is formed as a quadrangle from a component having electrically insulating properties, such as alumina, glass ceramics, mullite, or zirconia. A raw material used in printed circuit boards, such as a glass epoxy substrate or a phenol substrate, may also be used for the electrically insulating substrate 41.

The heat source 42 is covered by an electrically insulating component 48 upon the electrically insulating substrate 41. Note that the first to third electrodes 43 to 45 are formed upon the electrically insulating component 48. The electrically insulating component 48 is provided to efficiently transfer heat from the heat source 42 to the first to third electrodes 43 to 45, and is constituted of a glass layer, for example. The heat source 42 can make it easy for the melted electrical conductor to agglomerate by heating the first to third electrodes 43 to 45.

The first to third electrodes 43 to 45 are formed by electrically conductive patterns of Ag, Cu, or the like. The first electrode 43 is formed so that one side thereof is adjacent to the second electrode 44, and is electrically insulated by being separated from the second electrode 44. The third electrode 45 is formed on the other side of the first electrode 43. The first electrode 43 and the third electrode 45 conduct electricity as a result of the fuse element 1 being connected thereto, and thus constitute a current path of the short-circuit device 40. The first electrode 43 is connected, via a castellation facing a side surface of the electrically insulating substrate 41, to a first outer connection electrode 43*a* (see FIG. 21) provided on a rear surface 41*b* of the electrically insulating substrate 41. Additionally, the second electrode 44 is connected, via a castellation facing a side surface of the electrically insulating substrate 41, to a second outer connection electrode 44*a* (see FIG. 21) provided on the rear surface 41*b* of the electrically insulating substrate 41.

The third electrode 45 is connected to the heat source 42 via a heat source connection electrode 49 provided in the electrically insulating substrate 41 or the electrically insulating component 48. The heat source 42 is connected, via a heat source electrode 50 and a castellation facing a side edge of the electrically insulating substrate 41, to a heat source power supply electrode 50*a* (see FIG. 21) provided on the rear surface 41*b* of the electrically insulating substrate 41.

The fuse element 1 is connected to the first and third electrodes 43 and 45 via a connecting material such as the connection solder 28. As described above, the fuse element 1 includes the restricting portions 5, which suppress deformation even in high-temperature environments during reflow, and thus has excellent mounting properties; the fuse element 1 can be easily connected through reflow soldering or the like after being placed between the first and third electrodes 43 and 45 over the connection solder 28. Additionally, the fuse element 1 includes the restricting portions 5, and thus deformation is suppressed even when the fuse element 1 is repeatedly exposed to high-temperature environments such as when the short-circuit device 40 is reflow-mounted onto an outside circuit board, which makes it possible to suppress variations in the fusing characteristics. As such, the fuse element 1 and the short-circuit device 40 using the fuse element 1 can improve the mounting efficiency and maintain stable fusing characteristics.

Flux

Additionally, in the short-circuit device 40, the front surface and the rear surface of the fuse element 1 may be coated with the flux 27 in order to prevent the first high melting point metal layer 3 or the low melting point metal layer 2 from oxidizing, remove oxidants during fusing, and improve the flow characteristics of the solder. By coating the fuse element 1 with the flux 27, the wettability of the low melting point metal layer 2 (solder, for example) can be increased, oxidants produced when the low melting point metal melts can be removed, and the fusing characteristics can be improved by using the effect of eroding the high melting point metal (Ag, for example), when the short-circuit device 40 is actually used.

Additionally, by coating the fuse element 1 with the flux 27, it is possible, even in the case where an anti-oxidation film such as Pb-free solder having Sn as its main component is formed on the surface of the first high melting point metal layer 3 constituting the outermost layer, to remove oxidants of the anti-oxidation film, which makes it possible to effectively prevent the first high melting point metal layer 3 from oxidizing and maintain and improve the fusing characteristics.

In the short-circuit device 40, it is preferable that the first electrode 43 have a broader surface area than that of the third electrode 45. When such is the case, with the short-circuit device 40, a greater amount of the melted electrical conductor of the fuse element 1 can be caused to agglomerate on the first and second electrodes 43 and 44, and thus the first and second electrodes 43 and 44 can be caused to short-circuit reliably (see FIG. 22).

Although the first to third electrodes 43 to 45 can be formed using a typical electrode material such as Cu or Ag, it is preferable that coatings constituted by Ni/Au plating, Ni/Pd plating, Ni/Pd/Au plating, or the like at least be formed on the surfaces of the first and second electrodes 43 and 44 through a known plating process. Through this, the first and second electrodes 43 and 44 can be prevented from oxidizing and the melted electrical conductor can be reliably held. This also makes it possible to prevent erosion of the first electrode 43 (solder erosion) caused by the connecting material of the fuse element 1, such as the connection solder 28, melting in the case where the short-circuit device 40 is reflow-mounted.

Outflow prevention portions 51, constituted of an electrically insulating material such as glass and preventing the outflow of the above-described melted electrical conductor of the fuse element 1, the connection solder 28 of the fuse element 1, and the like, are formed on the first to third electrodes 43 to 45.

Cover Component

Additionally, in the short-circuit device 40, the cover component 46 that protects the interior and prevents the melted fuse element 1 from scattering is attached to a front surface 41*a* of the electrically insulating substrate 41 on which the fuse element 1 is provided. The cover component 46 can be formed from an electrically insulating component such as various types of engineering plastics or ceramics. In the short-circuit device 40, the fuse element 1 is covered by the cover component 46, and thus melted metal can be trapped by the cover component 46 and prevented from scattering to the surrounding areas.

Short-Circuit Device Circuit

Figure 21A:
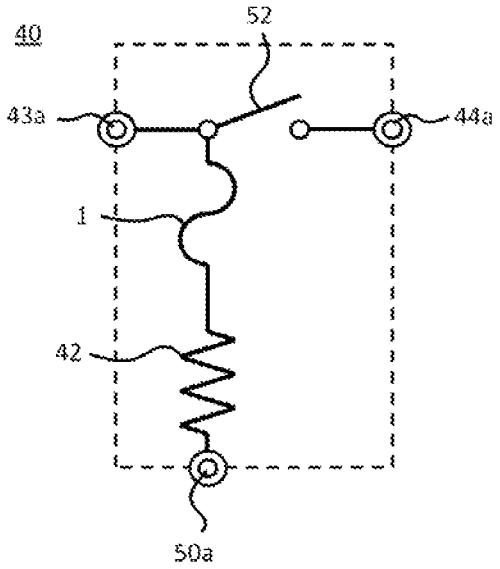
FIGS. 21A and 21B are circuit diagrams of the short-circuit device, where
Figure 21B:
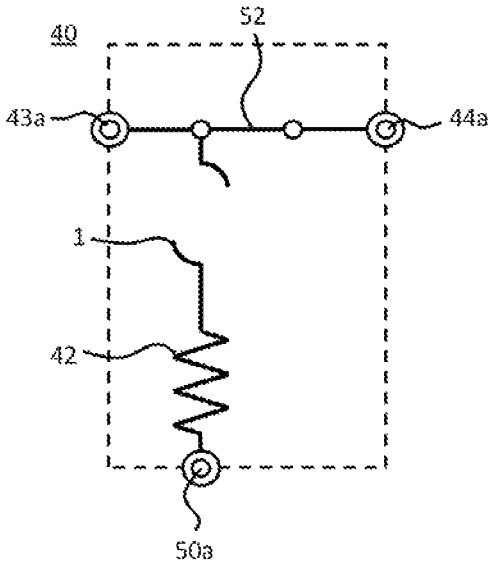

The short-circuit device 40 described above has a circuit configuration such as that illustrated in FIGS. 21A and 21B. In other words, in the short-circuit device 40, the first electrode 43 and the second electrode 44 are normally electrically insulated from each other (FIG. 21A), but the short-circuit device 40 forms a switch 52 that short-circuits the first electrode 43 and the second electrode 44 via the melted electrical conductor when the fuse element 1 melts due to heat build-up in the heat source 42 (FIG. 21B). The first outer connection electrode 43*a* and the second outer connection electrode 44*a* constitute the terminals of the switch 52. Additionally, the fuse element 1 is connected to the heat source 42 via the third electrode 45 and the heat source connection electrode 49.

By incorporating the short-circuit device 40 into an electronic device or the like, both terminals 43*a* and 44*a* of the switch 52 are connected to the current path of the electronic device, and in the case where the current path is energized, the switch 52 is caused to short-circuit so as to form the current path of the electronic component.

Figure 22:
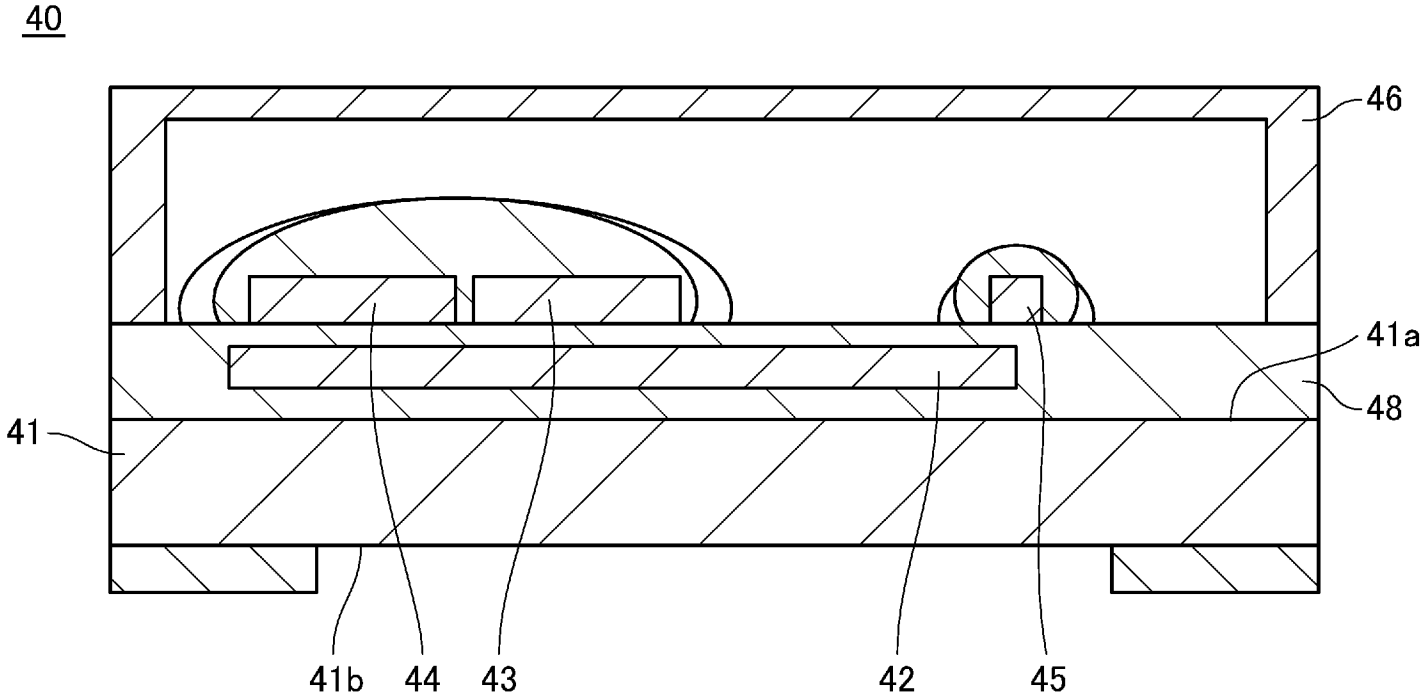
FIG. 22 is a cross-sectional view of a short-circuit device after a fuse element has fused.

For example, with the short-circuit device 40, when the electronic component and both terminals 43*a* and 44*a* of the switch 52 provided in the current path of the electronic component are connected in parallel, and a malfunction has arisen in the electronic component connected in parallel, power is supplied between the heat source power supply electrode 50*a* and the first outer connection electrode 43*a*, and the heat source 42 is energized so as to build up heat. When the fuse element 1 melts as a result of this heat, the melted electrical conductor agglomerates on the first and second electrodes 43 and 44, as illustrated in FIG. 22. Because the first and second electrodes 43 and 44 are formed adjacent to each other, the melted electrical conductor that has agglomerated on the first and second electrodes 43 and 44 joins together, and the first and second electrodes 43 and 44 short-circuit as a result. In other words, with the short-circuit device 40, a short-circuit arises between the terminals of the switch 52 (see FIG. 21B), and a bypass current path that bypasses the electronic component in which a malfunction has arisen is formed. Note that because the first and third electrodes 43 and 45 are separated by the fuse element 1 fusing, the supply of power to the heat source 42 is also stopped.

Here, as described above, the low melting point metal layer 2 having a lower melting point than that of the first high melting point metal layer 3 is layered in the fuse element 1. The fuse element 1 thus begins melting, under its own heat build-up produced by overcurrent, from the melting point of the low melting point metal layer 2, and the first high melting point metal layer 3 begins to erode. Accordingly, using the effect of the low melting point metal layer 2 eroding the first high melting point metal layer 3, the first high melting point metal layer 3 melts at a lower temperature than its melting temperature, and thus the fuse element 1 can fuse quickly.

Variation on Short-Circuit Device

Note that it is not absolutely necessary for the heat source 42 to be covered by the electrically insulating component 48 in the short-circuit device 40, and the heat source 42 may be arranged within the electrically insulating substrate 41. Using a raw material having excellent thermal conductivity for the electrically insulating substrate 41 makes it possible to achieve similar heating as in the case where the heat source 42 is covered by the electrically insulating component 48, such as a glass layer.

In addition to forming the heat source 42 on the surface of the electrically insulating substrate 41 on which the first to third electrodes 43 to 45 are formed as described above, in the short-circuit device 40, the heat source 42 may be arranged on the surface of the electrically insulating substrate 41 on the opposite side as the surface on which the first to third electrodes 43 to 45 are formed. Forming the heat source 42 on the rear surface 41*b* of the electrically insulating substrate 41 makes it possible to form the heat source 42 with a simpler process than when forming the heat source 42 within the electrically insulating substrate 41. Note that in this case, it is preferable, from the standpoint of protecting resistors and ensuring electrically insulating properties during mounting, that the electrically insulating component 48 be formed on the heat source 42.

Furthermore, in the short-circuit device 40, the heat source 42 may be arranged on the surface of the electrically insulating substrate 41 on which the first to third electrodes 43 to 45 are formed, and may be provided alongside the first to third electrodes 43 to 45. Forming the heat source 42 on the front surface 41*a* of the electrically insulating substrate 41 makes it possible to form the heat source 42 with a simpler process than when forming the heat source 42 within the electrically insulating substrate 41. Note that in this case too, it is preferable that the electrically insulating component 48 be formed on the heat source 42.

Additionally, a fourth electrode adjacent to the second electrode 44 and a second fuse element placed bridging the second electrode 44 and the fourth electrode may be formed in the short-circuit device 40. The second fuse element has the same configuration as the fuse element 1. With the short-circuit device 40 provided with the fourth electrode and the second fuse element, when the fuse element 1 and the second fuse element fuse, the melted electrical conductors thereof spread between the first and second electrodes 43 and 44 and cause the first and second electrodes 43 and 44 to short-circuit. In this case, too, it is preferable that the first electrode 43 have a broader surface area than the third electrode 35, and that the second electrode 44 have a broader surface area than the fourth electrode. When such is the case, with the short-circuit device 40, a greater amount of the melted electrical conductor can be caused to agglomerate on the first and second electrodes 43 and 44, and thus the first and second electrodes 43 and 44 can be caused to short-circuit reliably.

Switching Device

Figure 23:
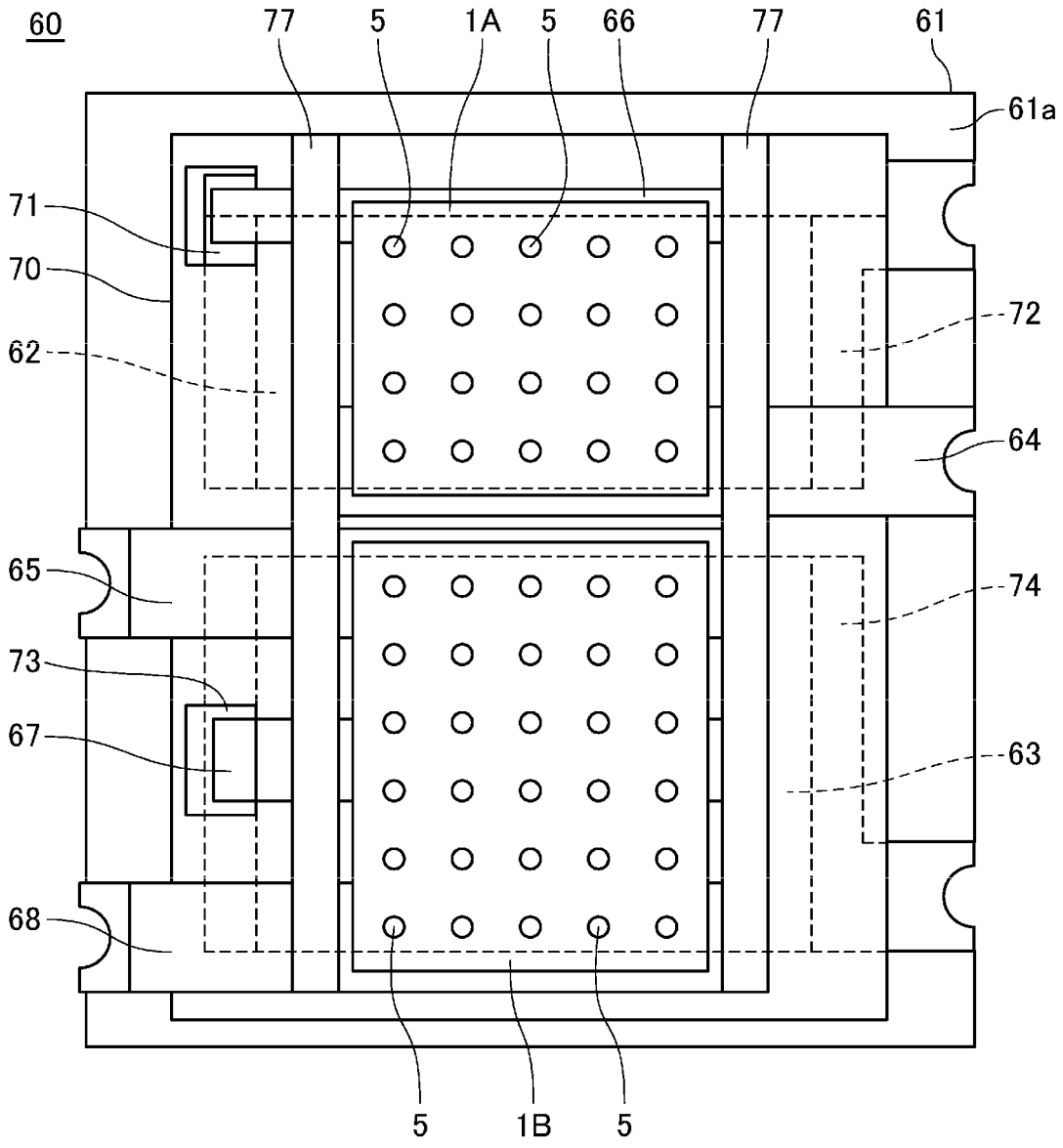
FIG. 23 is a plan view of a switching device using a fuse element to which the present invention is applied.
Figure 24:
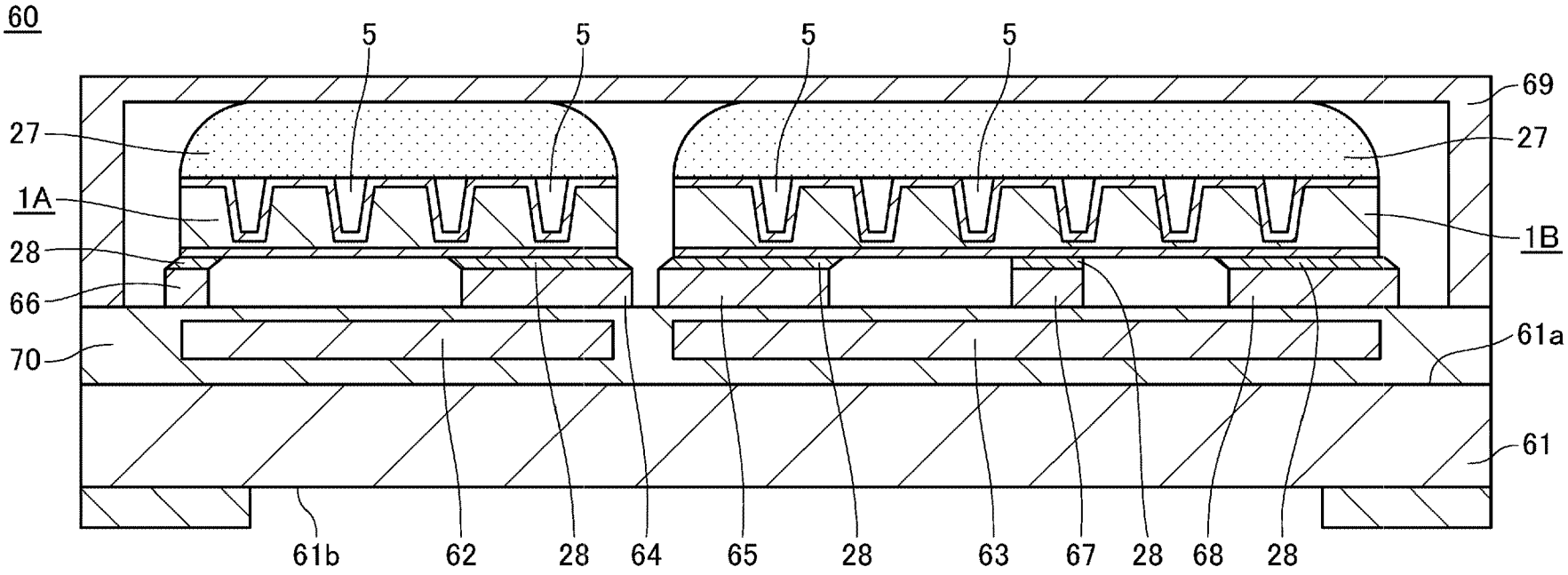
FIG. 24 is a cross-sectional view of the switching device using a fuse element to which the present invention is applied.

A switching device using the above-described fuse element 1 will be described next. FIG. 23 is a plan view of a switching device 60, and FIG. 24 is a cross-sectional view of the switching device 60. The switching device 60 includes: an electrically insulating substrate 61; a first heat source 62 and a second heat source 63 provided on the electrically insulating substrate 61; a first electrode 64 and a second electrode 65 provided adjacent to each other on the electrically insulating substrate 61; a third electrode 66 provided adjacent to the first electrode 64 and electrically connected to the first heat source 62; a fourth electrode 67 provided adjacent to the second electrode 65 and electrically connected to the second heat source 63; a fifth electrode 68 provided adjacent to the fourth electrode 67; a first fuse element 1A, provided across the first and third electrodes 64 and 66 so as to form a current path, and configured to break the current path between the first and third electrodes 64 and 66 by being heated by the first heat source 62; and a second fuse element 1B, provided across the fourth electrode 67 from the second electrode 65 to the fifth electrode 68, and configured to break the current path between the second, fourth, and fifth electrodes 65, 67, and 68 by being heated by the second heat source 63. In the switching device 60, a cover component 69 that protects the interior is attached to the top of the electrically insulating substrate 61.

The electrically insulating substrate 61 is formed as a quadrangle from a component having electrically insulating properties, such as alumina, glass ceramics, mullite, or zirconia. A raw material used in printed circuit boards, such as a glass epoxy substrate or a phenol substrate, may also be used for the electrically insulating substrate 61.

The first and second heat sources 62 and 63 are, like the above-described heat source 33, electrically conductive components that build up heat when energized, and can be formed in the same manner as the heat source 33. Additionally, the first and second fuse elements 1A and 1B have the same configuration as the above-described fuse element 1.

The first and second heat sources 62 and 63 are covered by an electrically insulating component 70 upon the electrically insulating substrate 61. The first and third electrodes 64 and 66 are formed on the electrically insulating component 70 covering the first heat source 62, and the second, fourth, and fifth electrodes 65, 67, and 68 are formed on the electrically insulating component 70 covering the second heat source 63. The first electrode 64 is formed so that one side thereof is adjacent to the second electrode 65, and is electrically insulated by being separated from the second electrode 65. The third electrode 66 is formed on the other side of the first electrode 64. The first electrode 64 and the third electrode 66 conduct electricity as a result of the first fuse element 1A being connected thereto, and thus constitute a current path of the switching device 60. Additionally, the first electrode 64 is connected, via a castellation facing a side surface of the electrically insulating substrate 61, to a first outer connection electrode 64*a* (see FIG. 25) provided on a rear surface 61*b* of the electrically insulating substrate 61.

The third electrode 66 is connected to the first heat source 62 via a first heat source connection electrode 71 provided in the electrically insulating substrate 61 or the electrically insulating component 70. The first heat source 62 is connected, via a first heat source electrode 72 and a castellation facing a side edge of the electrically insulating substrate 61, to a first heat source power supply electrode 72*a* (see FIG. 25) provided on the rear surface 61*b* of the electrically insulating substrate 61.

The fourth electrode 67 is formed on the side of the second electrode 65 opposite from the side adjacent to the first electrode 64. The fifth electrode 68 is formed on the side of the fourth electrode 67 opposite from the side adjacent to the second electrode 65. The second electrode 65, the fourth electrode 67, and the fifth electrode 68 are connected to the second fuse element 1B. Additionally, the second electrode 65 is connected, via a castellation facing a side surface of the electrically insulating substrate 61, to a second outer connection electrode 65*a* (see FIG. 25) provided on the rear surface 61*b* of the electrically insulating substrate 61.

The fourth electrode 67 is connected to the second heat source 63 via a second heat source connection electrode 73 provided in the electrically insulating substrate 61 or the electrically insulating component 70. The second heat source 63 is connected, via a second heat source electrode 74 and a castellation facing a side edge of the electrically insulating substrate 61, to a second heat source power supply electrode 74*a* (see FIG. 25) provided on the rear surface 61*b* of the electrically insulating substrate 61.

Furthermore, the fifth electrode 68 is connected, via a castellation facing a side surface of the electrically insulating substrate 61, to a fifth outer connection electrode 68*a* (see FIG. 25) provided on the rear surface of the electrically insulating substrate 61.

In the switching device 60, the first fuse element 1A is connected so as to bridge the first electrode 64 and the third electrode 66, and the second fuse element 1B is connected so as to bridge the second electrode 65 and the fifth electrode 68 via the fourth electrode 67.

Like the above-described fuse element 1, the first and second fuse elements 1A and 1B include the restricting portions 5, which suppress deformation even in high-temperature environments such as during reflow and thus have excellent mounting properties; the first and second fuse elements 1A and 1B can be easily connected through reflow soldering or the like after being placed upon the first to fifth electrodes 64 to 68 over the connection solder 28. Additionally, the fuse element 1 includes the restricting portions 5, and thus deformation is suppressed even when the fuse element 1 is repeatedly exposed to high-temperature environments such as when the switching device 60 is reflow-mounted onto an outside circuit board, which makes it possible to suppress variations in the fusing characteristics. As such, the fuse elements 1A and 1B and the switching device 60 using the fuse elements 1A and 1B can improve the mounting efficiency and maintain stable fusing characteristics.

Flux

Additionally, in the switching device 60, the front surfaces and the rear surfaces of the fuse elements 1A and 1B may be coated with the flux 27 in order to prevent the first high melting point metal layer 3 or the low melting point metal layer 2 from oxidizing, remove oxidants during fusing, and improve the flow characteristics of the solder. By coating the fuse elements 1A and 1B with the flux 27, the wettability of the low melting point metal layer 2 (solder, for example) can be increased, oxidants produced when the low melting point metal melts can be removed, and the fusing characteristics can be improved by using the effect of eroding the high melting point metal (Ag, for example), when the switching device 60 is actually used.

Additionally, by coating the fuse elements 1A and 1B with the flux 27, it is possible, even in the case where an anti-oxidation film such as Pb-free solder having Sn as its main component is formed on the surface of the first high melting point metal layer 3 constituting the outermost layer, to remove oxidants of the anti-oxidation film, which makes it possible to effectively prevent the first high melting point metal layer 3 from oxidizing and maintain and improve the fusing characteristics.

Although the first to fifth electrodes 64 to 68 can be formed using a typical electrode material such as Cu or Ag, it is preferable that protective layers constituted by Ni/Au plating, Ni/Pd plating, Ni/Pd/Au plating, or the like at least be formed on the surfaces of the first and second electrodes 64 and 65 through a known plating process. Through this, the first and second electrodes 64 and 65 can be prevented from oxidizing and the melted electrical conductor can be reliably held. This also makes it possible to prevent erosion of the first and second electrodes 64 and 65 (solder erosion) caused by the connecting material connecting the first and second fuse elements 1A and 1B, such as the connection solder 28, melting in the case where the switching device 60 is reflow-mounted.

Outflow prevention portions 77, constituted of an electrically insulating material such as glass and preventing the outflow of the above-described melted electrical conductor of the fuse elements 1A and 1B, the connection solder 28 of the fuse elements 1A and 1B, and the like, are formed on the first to fifth electrodes 64 to 68.

Cover Component

Additionally, in the switching device 60, the cover component 69 that protects the interior and prevents the melted fuse elements 1A and 1B from scattering is attached to a front surface 61*a* of the electrically insulating substrate 61 on which the fuse elements 1A and 1B are provided. The cover component 69 can be formed from an electrically insulating component such as various types of engineering plastics or ceramics. In the switching device 60, the fuse elements 1A and 1B are covered by the cover component 69, and thus melted metal can be trapped by the cover component 69 and prevented from scattering to the surrounding areas.

Switching Device Circuit

Figure 25A:
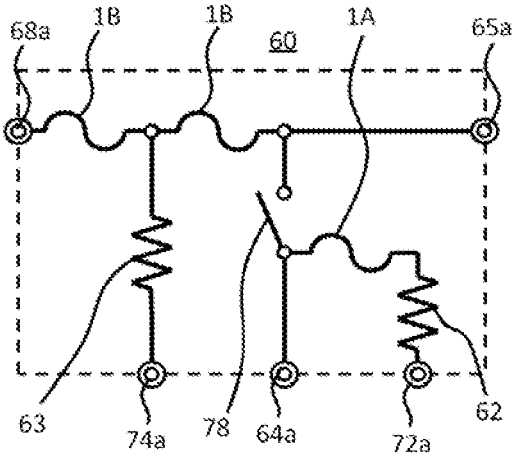
FIGS. 25A and 25B are circuit diagrams of the switching device, where

The switching device 60 described above has a circuit configuration such as that illustrated in FIG. 25A. In other words, the switching device 60 forms a switch 78 for which the first electrode 64 and the second electrode 65 are normally electrically insulated from each other, but the first electrode 64 and the second electrode 65 are short-circuited via the melted electrical conductor when the first and second fuse elements 1A and 1B melt due to heat build-up in the first and second heat sources 62 and 63. The first outer connection electrode 64*a* and the second outer connection electrode 65*a* constitute the terminals of the switch 78.

Additionally, the first fuse element 1A is connected to the first heat source 62 via the third electrode 66 and the first heat source connection electrode 71. The second fuse element 1B is connected to the second heat source 63 via the fourth electrode 67 and the second heat source connection electrode 73, and is further connected to the second heat source power supply electrode 74*a* via the second heat source electrode 74. In other words, the second fuse element 1B and the second electrode 65, the fourth electrode 67, and the fifth electrode 68 to which the second fuse element 1B are connected function as a protective device that enables the second electrode 65 and the fifth electrode 68 to conduct electricity via the second fuse element 1B before the switching device 60 operates and fuses the second fuse element 1B so as to break the path between the second electrode 65 and the fifth electrode 68.

By incorporating the switching device 60 into an outside circuit such as an electronic device, the outer connection electrodes 65*a* and 68*a* of the second and fifth electrodes 65 and 68 are connected in series in an initial current path of the outside circuit, and the second heat source 63 is connected, via the second heat source power supply electrode 74*a*, to a current control device provided in the outside circuit. Additionally, in the switching device 60, the terminals 64*a* and 65*a* of the switch 78 are connected to the current path following the switching of the outside circuit, and the first heat source 62 is connected, via the first heat source power supply electrode 72*a*, to the current control device provided in the outside circuit.

Before operation, the switching device 60 is energized between the second and fifth outer connection electrodes 65*a* and 68*a*.

Figure 25B:
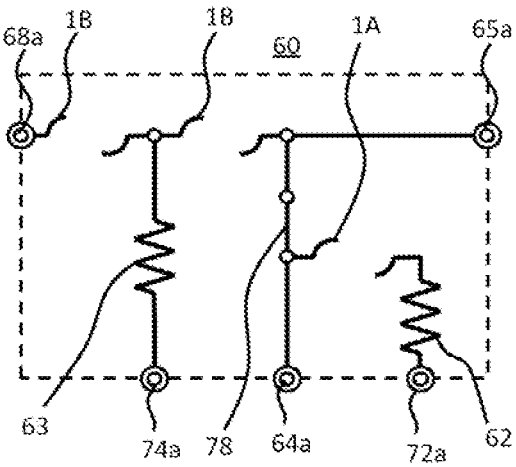
Figure 26:
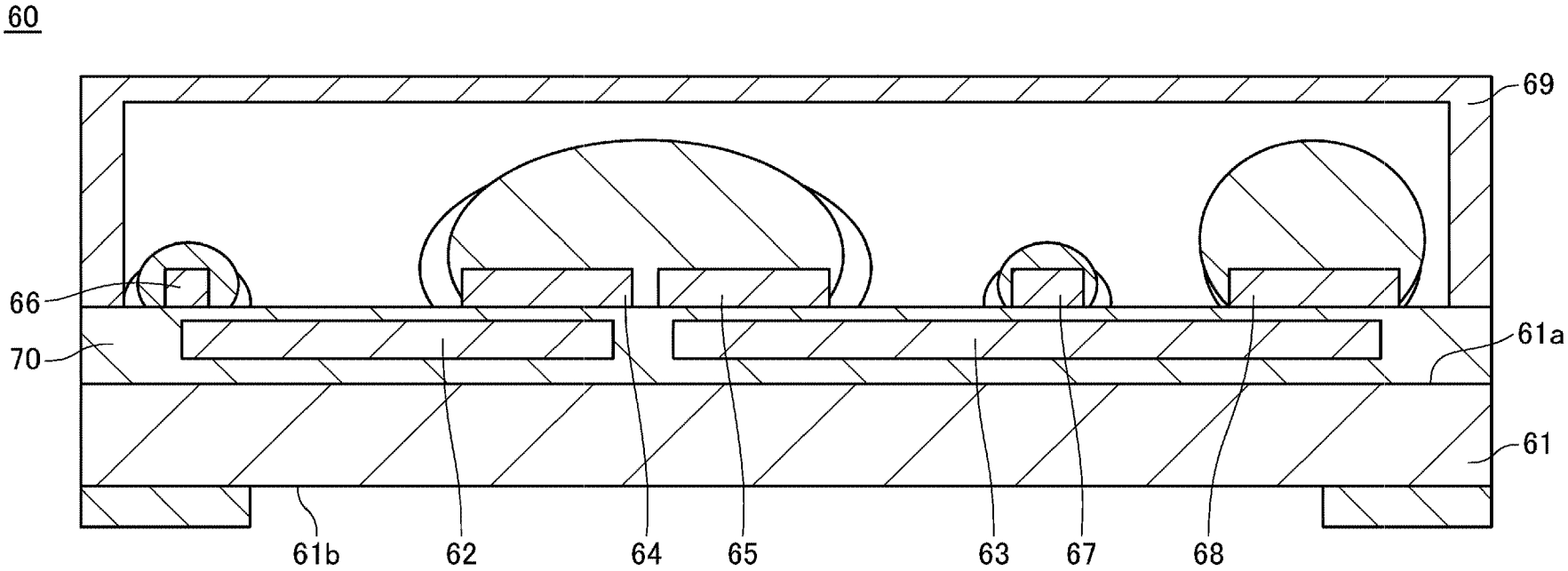
FIG. 26 is a cross-sectional view of a switching device after a fuse element has fused.

Then, in the switching device 60, when the second heat source 63 is energized by the second heat source power supply electrode 74*a*, the second fuse element 1B melts due to the heat build-up in the second heat source 63, and agglomerates onto the second, fourth, and fifth electrodes 65, 67, and 68, as illustrated in FIG. 26. As a result, the current path between the second electrode 65 and the fifth electrode 68 that has been connected by the second fuse element 1B is broken, as illustrated in FIG. 25B. Additionally, in the switching device 60, when the first heat source 62 is energized by the first heat source power supply electrode 72*a*, the first fuse element 1A melts due to the heat build-up in the first heat source 62, and agglomerates onto the first and third electrodes 64 and 66. As a result, in the switching device 60, the melted electrical conductor of the first and second fuse elements 1A and 1B that has agglomerated on the first electrode 64 and the second electrode 65 joins, which short-circuits the first electrode 64 and the second electrode 65 that had been electrically insulated, as illustrated in FIG. 26. In other words, in the switching device 60, the switch 78 can be short-circuited and the current path between the second and fifth electrodes 65 and 68 can be switched to a current path between the first and second electrodes 64 and 65 (FIG. 25B).

Here, as described above, the low melting point metal layer 2 having a lower melting point than that of the first high melting point metal layer 3 is layered in the fuse elements 1A and 1B. The fuse elements 1A and 1B thus begin melting, due to the heat build-up in the first and second heat sources 62 and 63, from the melting point of the low melting point metal layer 2, and the first high melting point metal layer 3 begins to erode. Accordingly, using the effect of the low melting point metal layer 2 eroding the first high melting point metal layer 3, the first high melting point metal layer 3 melts at a lower temperature than its own melting temperature, and thus the fuse elements 1A and 1B can fuse quickly.

Note that the energizing of the first heat source 62 is stopped as a result of the path between the first and third electrodes 64 and 66 being broken by the first fuse element 1A fusing, and the energizing of the second heat source 63 is stopped as a result of the paths between the second and fourth electrodes 65 and 67 and between the fourth and fifth electrodes 67 and 68 being broken by the second fuse element 1B fusing.

Early Melting of Second Fusible Electrical Conductor

Here, in the switching device 60, it is preferable that the second fuse element 1B begin melting before the first fuse element 1A. In the switching device 60, heat builds up in the first heat source 62 and the second heat source 63 independently, and thus causing heat to build up in the second heat source 63 first and then causing heat to build up in the first heat source 62 after as the timing for energizing the heat sources makes it possible to cause the second fuse element 1B to melt earlier than the first fuse element 1A, such that the circuit between the second and fifth electrodes 65 and 68 that needs to be broken can be broken before switching to first and second bypass circuits. Also, as illustrated in FIG. 26, the melted electrical conductor of the first and second fuse elements 1A and 1B can reliably be caused to agglomerate and join on the first and second electrodes 64 and 65, and the first and second electrodes 64 and 65 can be reliably short-circuited.

Additionally, in the switching device 60, the second fuse element 1B may be formed narrower than the first fuse element 1A so that the second fuse element 1B melts before the first fuse element 1A. Forming the second fuse element 1B narrower makes it possible to reduce the melting time, which makes it possible to cause the second fuse element 1B to melt earlier than the first fuse element 1A.

Electrode Surface Area

Additionally, in the switching device 60, it is preferable that the surface area of the first electrode 64 be broader than the third electrode 66, and that the surface area of the second electrode 65 be broader than the fourth and fifth electrodes 67 and 68. The amount of melted electrical conductor that can be held increases in proportion with the electrode surface area, and thus making the surface area of the first electrode 64 broader than the third electrode 66 and the surface area of the second electrode 65 broader than the fourth and fifth electrodes 67 and 68 makes it possible to cause a greater amount of the melted electrical conductor to agglomerate on the first and second electrodes 64 and 65, which in turn makes it possible to reliably cause a short-circuit between the first and second electrodes 64 and 65.

Variation on Switching Device

Note that in the switching device 60, it is not absolutely necessary for the first and second heat sources 62 and 63 to be covered by the electrically insulating component 70, and the first and second heat sources 62 and 63 may instead be disposed within the electrically insulating substrate 61. Using a raw material having excellent thermal conductivity for the electrically insulating substrate 61 makes it possible for the first and second heat sources 62 and 63 to achieve similar heating as in the case where the first and second heat sources 62 and 63 are covered by the electrically insulating component 70, such as a glass layer.

Additionally, in the switching device 60, the first and second heat sources 62 and 63 may be disposed on a rear surface of the electrically insulating substrate 61 opposite from the surface on which the first to fifth electrodes 64 to 68 are formed. Forming the first and second heat sources 62 and 63 on the rear surface 61*b* of the electrically insulating substrate 61 makes it possible to form the first and second heat sources 62 and 63 with a simpler process than when forming the first and second heat sources 62 and 63 within the electrically insulating substrate 61. Note that in this case, it is preferable, from the standpoint of protecting resistors and ensuring electrically insulating properties during mounting, that the electrically insulating component 70 be formed on the first and second heat sources 62 and 63.

Furthermore, in the switching device 60, the first and second heat sources 62 and 63 may be arranged on the surface of the electrically insulating substrate 61 on which the first to fifth electrodes 64 to 68 are formed, and may be provided alongside the first to fifth electrodes 64 to 68. Forming the first and second heat sources 62 and 63 on the front surface 61*a* of the electrically insulating substrate 61 makes it possible to form the first and second heat sources 62 and 63 with a simpler process than when forming the first and second heat sources 62 and 63 within the electrically insulating substrate 61. Note that in this case too, it is desirable that the electrically insulating component 70 be formed on the first and second heat sources 62 and 63.

First Variation on Fuse Element

Surface Irregularity Portion

Figure 27:
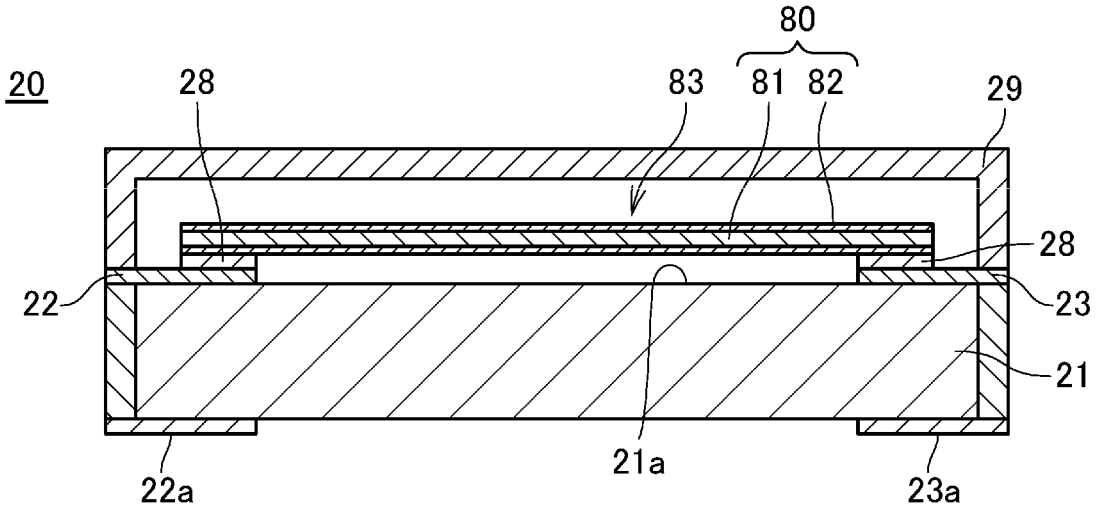
FIG. 27 is a cross-sectional view of an example of a fuse device using a fuse element provided with a surface irregularity portion.

Variations on the fuse element will be described next. A fuse element 80 according to an embodiment of the present technique, illustrated in FIG. 27, is used as a fusible electrical conductor of the fuse device 20, the protective device 30, the short-circuit device 40, and the switching device 60, in the same manner as the above-described fuse element 1, and fuses under its own heat build-up (Joule heat) when current greater than a current rating flows, or fuses due to heat build-up of a heat source. Although the following will describe a case in which the fuse element 80 is installed in the fuse device 20 as an example of the configuration of the fuse element 80, the same effects are achieved in the case where the fuse element 80 is installed in the protective device 30, the short-circuit device 40, and the switching device 60.

The fuse element 80 is formed having a substantially rectangular shape with an overall thickness of approximately from 50 to 500 μm, for example, and as illustrated in FIG. 27, is soldered to the first and second electrodes 22 and 23 provided on the electrically insulating substrate 21 of the fuse device 20.

The fuse element 80 includes a low melting point metal layer 81 and a first high melting point metal layer 82 having a higher melting point than that of the low melting point metal layer 81, and has a surface irregularity portion 83 configured to reduce deformation in at least the first high melting point metal layer 82 at greater than or equal to the melting point of the low melting point metal layer 81.

A raw material commonly called "Pb-free solder", such as Sn or an alloy that takes Sn as its main component, can be used favorably as the low melting point metal layer 81. The melting point of the low melting point metal layer 81 does not absolutely have to be higher than the temperature of the reflow furnace, and the low melting point metal layer 81 may melt at approximately 200° C. The low melting point metal layer 81 may use Bi, In, or an alloy containing Bi or In, that melts at an even low temperature of approximately from 120° C. to 140° C.

An alloy having, for example, Ag and Cu, or Ag or Cu, as its main component, and that has a higher melting point than that of the low melting point metal layer 81, is favorably used as the first high melting point metal layer 82, and the first high melting point metal layer 82 has a melting point high enough so as not to melt even when the fuse element 80 is mounted onto the electrically insulating substrate 21 using a reflow furnace.

The first high melting point metal layers 82 are layered on both front and rear surfaces of the low melting point metal layer 81. In other words, the fuse element 80 has a layered structure in which the low melting point metal layer 81 constitutes an inner layer and the first high melting point metal layer 82 having a higher melting point than that of the low melting point metal layer 81 constitutes outer layers.

Surface Irregularity Portion

Like the above-described restricting portions 5, the surface irregularity portion 83 suppresses deformation of the fuse element 80 when the fuse element 80 is repeatedly exposed to high-temperature environments, such as when the fuse element 80 is reflow-mounted onto the electrically insulating substrate 21 of the fuse device 20, when the fuse device 20 using the fuse element 80 is reflow-mounted onto an outside circuit board, and the like.

Figure 28A:
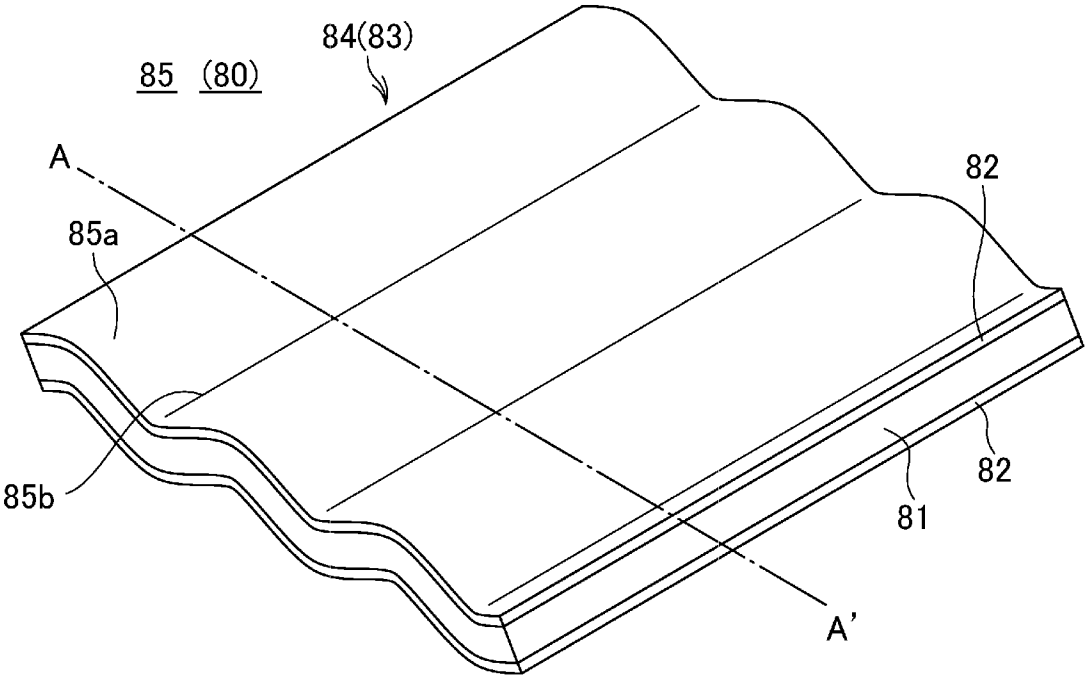
FIG. 28A is a perspective view of a wave-shaped element.
Figure 28B:
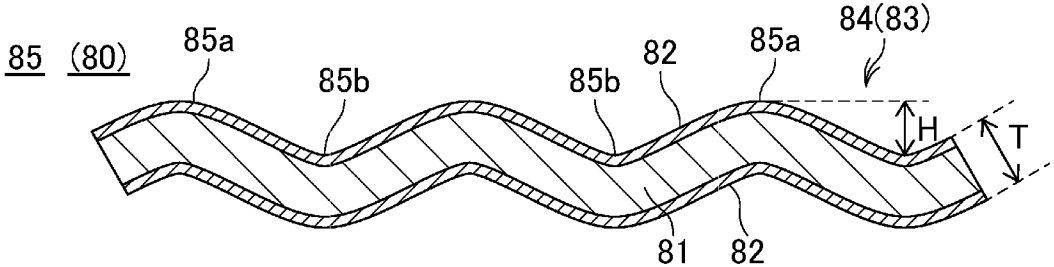
FIG. 28B is a cross-sectional view from A-A' in FIG. 28A.

As one example of the surface irregularity portion 83, illustrated in FIGS. 28A and 28B, the surface irregularity portion 83 is an embossed part 84 provided in the layered body constituted by the low melting point metal layer 81 and the first high melting point metal layer 82. The embossed part 84 has, for example, a substantially wave-shaped cross section in which a plurality of peak portions 85*a* and valley portions 85*b* formed in front and rear surfaces continue parallel to each other, such that the fuse element 80 is formed as a wave-shaped element 85. The wave-shaped element 85 can be manufactured by, for example, pressing the layered body constituted by the low melting point metal layer 81 and the first high melting point metal layer 82 into the substantially wave-shaped cross section.

Note that the embossed part 84 in which the plurality of peak portions 85*a* and valley portions 85*b* continue parallel to each other may be formed across the entirety of the fuse element 80, or may be formed in only part of the fuse element 80. Additionally, from the standpoint of preventing variations in the fusing characteristics, it is preferable that the embossed part 84 be provided in at least a fusing area not supported by the first and second electrodes 22 and 23 of the electrically insulating substrate 21 and the like.

This fuse element 80 is placed so as to bridge the first and second electrodes 22 and 23 provided on the electrically insulating substrate 21 of the fuse device 20, and is then subjected to reflow heating. The fuse element 80 is soldered to the first and second electrodes 22 and 23 using the connection solder 28 as a result. The fuse device 20 on which the fuse element 80 has been mounted is furthermore placed on an outside circuit board of various types of electronic devices, and is reflow-mounted.

Here, the first high melting point metal layer 82 that does not melt even at the reflow temperature is layered on the low melting point metal layer 81 as the outer layers, and the embossed part 84 is provided as well. Accordingly, even in a case where the fuse element 80 is repeatedly exposed to a high-temperature environment, such as when being reflow-mounted to the electrically insulating substrate 21 of the fuse device 20 or when the fuse device 20 using the fuse element 80 is reflow-mounted onto an outside circuit board, the embossed part 84 can keep deformation of the fuse element 80 within a constant range at which variations in the fusing characteristics are suppressed. As such, the fuse element 80 can be reflow-mounted even in a case where the surface area thereof has been increased, which makes it possible to improve the mounting efficiency. Additionally, by having a broader width with respect to the direction of the current, the fuse element 80 can also achieve an improvement in the current rating in the fuse device 20.

In other words, by providing the surface irregularity portion 83, flowing of the melted low melting point metal is suppressed, and deformation of the first high melting point metal layer 82 constituting the outer layers is also suppressed, even in the case where the fuse element 80 is exposed to a high-temperature environment greater than or equal to the melting point of the low melting point metal layer 81 for a short amount of time by an outside heat source such as a reflow furnace. Accordingly, the fuse element 80 can suppress a situation in which the melted low melting point metal agglomerates due to tension and expands, or the melted low melting point metal flows out and becomes thinner, and as a result, collapsing or bulging locally arises.

Accordingly, the fuse element 80 can prevent variations in a resistance value caused by deformations such as local collapsing or bulging arising at the temperature used during reflow mounting, and can maintain fusing characteristics in which the fuse element 80 fuses at a prescribed temperature or current and in a prescribed amount of time. Additionally, the fuse element 80 can maintain the fusing characteristics even when repeatedly exposed to the reflow temperature, such as when the fuse device 20 is reflow-mounted onto an outside circuit board after the fuse element 80 has been reflow-mounted onto the electrically insulating substrate 21 of the fuse device 20, which makes it possible to improve the product quality.

Additionally, as with the above-described fuse element 1, with the fuse element 80, flowing of the melted low melting point metal is suppressed by the embossed part 84, even in the case where the fuse element 80 is manufactured by being cut out from a large element sheet and the low melting point metal layer 81 is exposed from the side surfaces thereof. Accordingly, a situation in which the melted connection solder 28 is suctioned from the side surfaces, causing an increase in the volume of the low melting point metal and a local decrease in the resistance value, is suppressed.

Additionally, the fuse element 80 is configured with the low resistance first high melting point metal layer 82 layered thereon, which makes it possible to greatly reduce the electrical conductor resistance compared to fusible electrical conductors of the related art using lead-based high melting point solders, and greatly increase the rated current compared to chip fuses of the related art and the like having the same size. A smaller size than chip fuses of the related art having the same rated current can also be achieved.

Furthermore, the fuse element 80 includes the low melting point metal layer 81 having a lower melting point than that of the first high melting point metal layer 82, such that the fuse element 80 begins melting from the melting point of the low melting point metal layer 81 under the self-produced heat build-up from overcurrent and can therefore fuse quickly. For example, in the case where the low melting point metal layer 81 is constituted of an Sn—Bi-based alloy, an In—Sn-based alloy, or the like, the fuse element 80 begins melting from a low temperature of approximately 140° C. or 120° C. The melted low melting point metal layer 81 erodes (solder erosion) the first high melting point metal layer 82, and thus the first high melting point metal layer 82 melts at a lower temperature than its own melting point. Accordingly, the fuse element 80 can be fused even more quickly by using the effect of the low melting point metal layer 81 eroding the first high melting point metal layer 82.

Bent Portion

Figure 29:
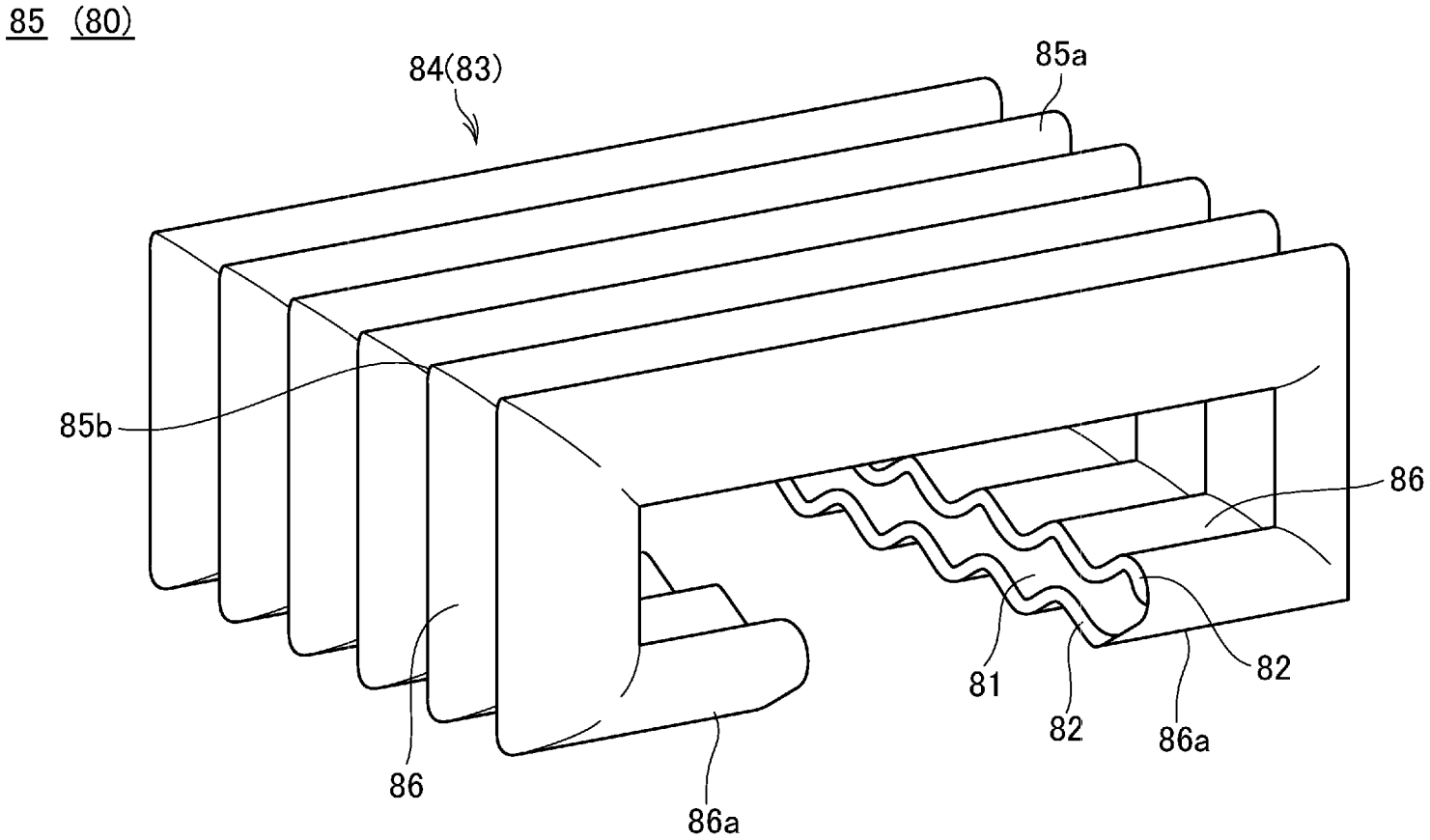
FIG. 29 is a perspective view of an example of a wave-shaped element in which bent portions are formed.

Additionally, as illustrated in FIG. 29, the embossed part 84 having a substantially wave-shaped cross section may be provided with bent portions 86 having bends that intersect with the direction in which the plurality of peak portions 85*a* and valley portions 85*b* are continuous. The bent portions 86 are formed on both ends in the direction in which the peak portions 85*a* and the valley portions 85*b* of the wave-shaped element 85 are continuous. Additionally, terminal portions 86*a* to be mounted to the first and second electrodes 22 and 23 of the electrically insulating substrate 21 may be provided by bending the bent portions 86 back so as to be substantially parallel to a main surface of the wave-shaped element 85.

By providing the fuse element 80 with the bent portions 86 in addition to the embossed part 84, flowing of the melted low melting point metal in the direction in which the peak portions 85*a* and the valley portions 85*b* are continuous can be further suppressed, and variations in the fusing characteristics caused by deformation resulting from outflow of the low melting point metal or inflow of melted solder or the like can be prevented.

With the fuse element 80 illustrated in FIG. 29, the terminal portions 86*a* are provided in the direction in which the peak portions 85*a* and the valley portions 85*b* are continuous, and that direction corresponds to the direction in which current flows. Note that with the fuse element 80, the bent portions 86 may be formed in a direction orthogonal or oblique to the direction in which the peak portions 85*a* and the valley portions 85*b* are continuous, and that direction may correspond to the direction in which current flows.

Circular, Elliptical, Rounded Rectangular, or Polygonal Shapes

Figure 30B:
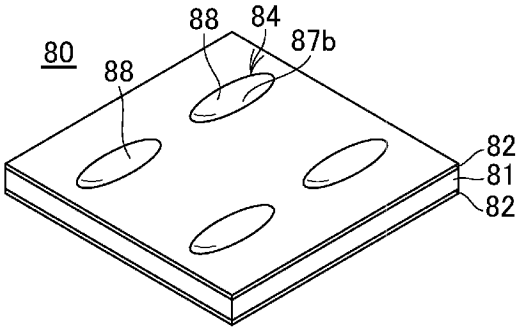
FIG. 30B is a perspective view of a fuse element provided with embossed parts constituted of elliptical portions.
Figure 30A:
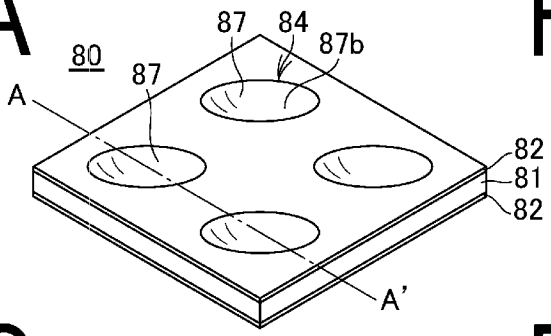
FIG. 30A is a perspective view of a fuse element provided with embossed parts constituted of circular portions.

The embossed part 84 may, as illustrated in FIG. 30A, be a part in which a plurality of circular portions 87, in which the shape of the surface irregularities is circular when viewed in plan view, are formed in the front and rear surfaces of the fuse element 80. By forming the plurality of circular portions 87 across the entirety of the fuse element 80, flowing of the melted low melting point metal is suppressed, and deformation of the first high melting point metal layer 82 constituting the outer layers is also suppressed, even in the case where the fuse element 80 is exposed to a high-temperature environment greater than or equal to the melting point of the low melting point metal layer 81 for a short amount of time by an outside heat source such as a reflow furnace. Accordingly, the fuse element 80 can suppress a situation in which the melted low melting point metal agglomerates due to tension and expands, or the melted low melting point metal flows out and becomes thinner, and as a result, collapsing or bulging locally arises.

The circular portions 87 can be manufactured by, for example, pressing the layered body constituted by the low melting point metal layer 81 and the first high melting point metal layer 82 with convex and concave plates in which a plurality of shapes corresponding to the circular portions 87 are formed.

Note that the circular portions 87 may be formed so that convex parts 87*a* are formed in one surface of the fuse element 80 and concave parts 87*b* are formed in another surface of the fuse element 80, or the convex parts 87*a* and the concave parts 87*b* may be formed in both the one surface and the other surface.

Figure 30D:
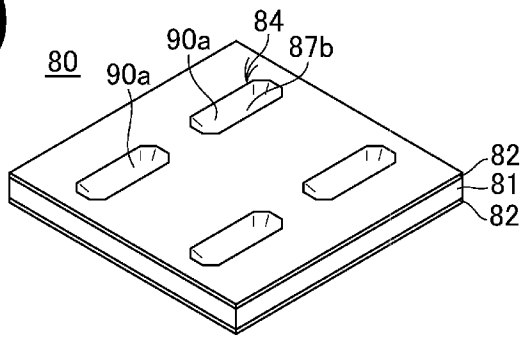
FIG. 30D is a perspective view of a fuse element provided with embossed parts constituted of polygonal portions.
Figure 30C:
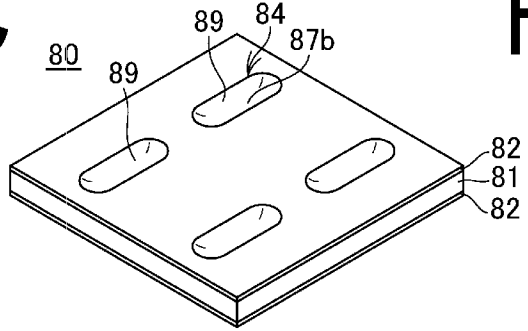
FIG. 30C is a perspective view of a fuse element provided with embossed parts constituted of rounded rectangular portions.
Figure 30E:
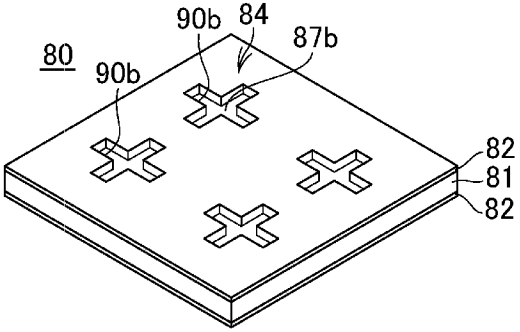
FIG. 30E is a perspective view of a fuse element provided with embossed parts constituted of polygonal portions.

Additionally, the embossed part 84 may be a part in which a plurality of elliptical portions 88 (FIG. 30B), in which the shape of the surface irregularities is elliptical when viewed in plan view, a part in which a plurality of rounded rectangular portions 89 (FIG. 30C), in which the shape of the surface irregularities is a rounded rectangle when viewed in plan view, or a part in which a plurality of polygonal portions 90*a* (FIG. 30D) or polygonal portions 90*b* (FIG. 30E), in which the shape of the surface irregularities is polygonal when viewed in plan view, are formed in the front and rear surfaces of the fuse element 80. One or a combination of a plurality of the circular portions 87, the elliptical portions 88, the rounded rectangular portions 89, and the polygonal portions 90 (90*a*, 90*b*) may be formed in the embossed part 84.

Note that the embossed part 84 in which the plurality of circular portions 87, elliptical portions 88, rounded rectangular portions 89, or polygonal portions 90 are formed may be formed across the entirety of the fuse element 80, or may be formed in only part of the fuse element 80. Additionally, from the standpoint of preventing variations in the fusing characteristics, it is preferable that the embossed part 84 be provided in at least a fusing area not supported by the first and second electrodes 22 and 23 of the electrically insulating substrate 21 and the like.

Heights of Surface Irregularity Portion

Figure 31:
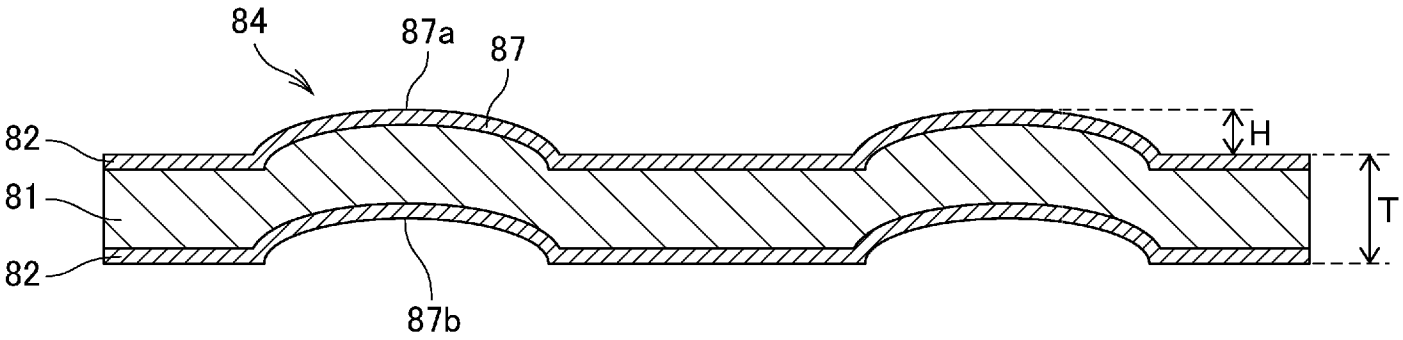
FIG. 31 is cross-sectional view from A-A' in FIG. 30A.

Here, a height H of the embossed part 84 is preferably greater than or equal to 5% of a total thickness T of the fuse element 80. The height H of the embossed part 84 refers, with respect to the wave-shaped element 85 illustrated in FIG. 28B, to a difference in elevation between the peak portions 85*a* and the valley portions 85*b* in the same surface; with respect to the fuse element 80 in which the circular portions 87 illustrated in FIG. 30A are formed, the height H refers to a height from the main surface of the fuse element 80 to the highest position of the convex parts 87*a* of the circular portions 87 projecting from that main surface, as illustrated in FIG. 31. The same applies in the fuse elements 80 in which the elliptical portions 88, the rounded rectangular portions 89, the polygonal portions 90*a*, and the polygonal portions 90*b* illustrated in FIGS. 30B to 30E are formed. Meanwhile, the total thickness T of the fuse element 80 refers, with respect to the wave-shaped element 85 illustrated in FIG. 28B, to a thickness between the front and rear surfaces; with respect to the fuse element 80 in which the circular portions 87 or the like illustrated in FIGS. 30A to 30E are formed, the total thickness T refers to a thickness between the front and rear surfaces at a main surface of the fuse element 80 where there is no embossing.

By setting the height H of the embossed part 84 to greater than or equal to 5% of the total thickness T, the fuse element 80 can effectively suppress flowing of the low melting point metal layer 81 constituting the inner layer, and prevent variations in the fusing characteristics caused by deformation. However, in a case where the height H of the embossed part 84 is less than 5% of the total thickness T, the fuse element 80 will insufficiently suppress flowing of the low melting point metal layer 81 caused by outside heating during reflow or the like, and thus the fusing characteristics may vary due to deformation.

Note that with the fuse element 80, in a case where the height H of the embossed part 84 is too great, the height when mounting the fuse element 80 on the electrically insulating substrate 21 or the like will increase, which may make it difficult to make the device smaller and thinner as a whole. Accordingly, the height of the embossed part 84 is designed as appropriate on the basis of conditions such as the desire device size, the current rating, and the like.

Surface Area of Embossed Part

Additionally, a total surface area of the embossed part 84 is preferably greater than or equal to 2% of the total surface area of the fuse element 80. The total surface area of the embossed part 84 refers to the surface area in which the peak portions 85*a* and the valley portions 85*b* of the wave-shaped element 85 are formed, or the total surface area of the circular portions 87, the elliptical portions 88, the rounded rectangular portions 89, and the polygonal portions 90, when the fuse element 80 is viewed in plan view. The total surface area of the fuse element 80 refers to the surface area of the fuse element 80 when viewed in plan view.

By setting the total surface area of the embossed part 84 to greater than or equal to 2% of the total surface area of the fuse element 80, flowing of the low melting point metal layer 81 constituting the inner layer can be effectively suppressed, and variations in the fusing characteristics caused by deformation can be prevented. However, in a case where the total surface area of the embossed part 84 is less than 2% of the total surface area of the fuse element 80, the fuse element 80 will insufficiently suppress flowing of the low melting point metal layer 81 caused by outside heating during reflow or the like, and thus the fusing characteristics may vary due to deformation.

Here, samples having different total surface areas for the embossed part with respect to the total surface area of the fuse element 80 were prepared, and the rate of change in the resistance value was measured between before and after subjecting the fuse element 80 to a temperature corresponding to a reflow temperature (260° C.). Each sample used included a fuse element of the same size, in which a solder foil was plated with Ag. Sample 1 did not have any embossing (a surface area percentage of 0%). In Sample 2, an embossed part constituted by a plurality of the circular portions 87 was formed uniformly across the entire surface of the fuse element at a surface area percentage of 1.0%. In Sample 3, an embossed part constituted by a plurality of the circular portions 87 was formed uniformly across the entire surface of the fuse element at a surface area percentage of 3.1%.

The rate of change in the resistances of Samples 1 to 3 after reflow heating were 114% for Sample 1 and 115% for Sample 2, whereas Sample 3 was kept to a rate of change of 103%. In other words, it can be inferred that by setting the total surface area of the embossed part 84 to greater than or equal to 2% of the total surface area of the fuse element 80, flowing of the low melting point metal layer 81 constituting the inner layer can be effectively suppressed, and variations in the fusing characteristics caused by deformation can be prevented.

Groove Portions

Figure 32A:
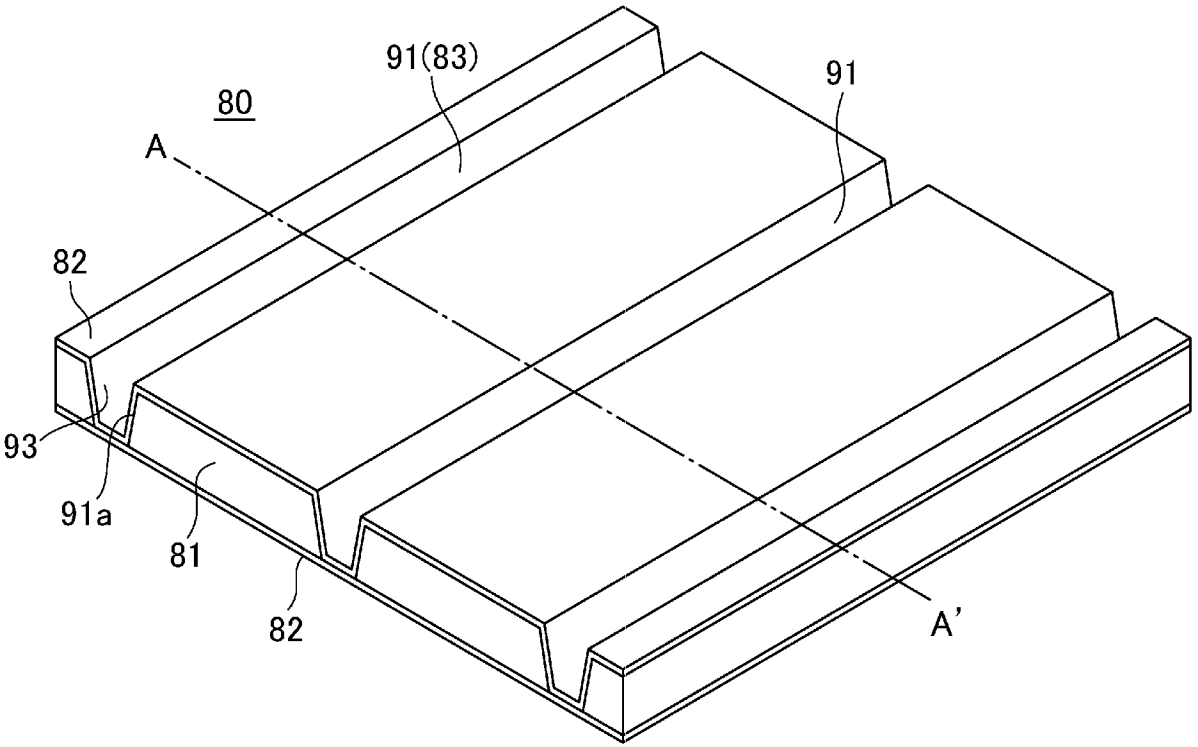
FIG. 32A is a perspective view of a fuse element in which long groove portions are formed.
Figure 32B:
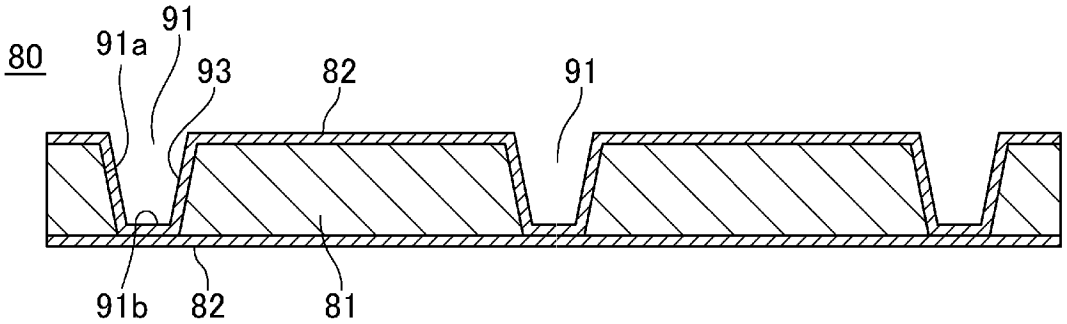
FIG. 32B is a cross-sectional view from A-A' in FIG. 32A.
Figure 33A:
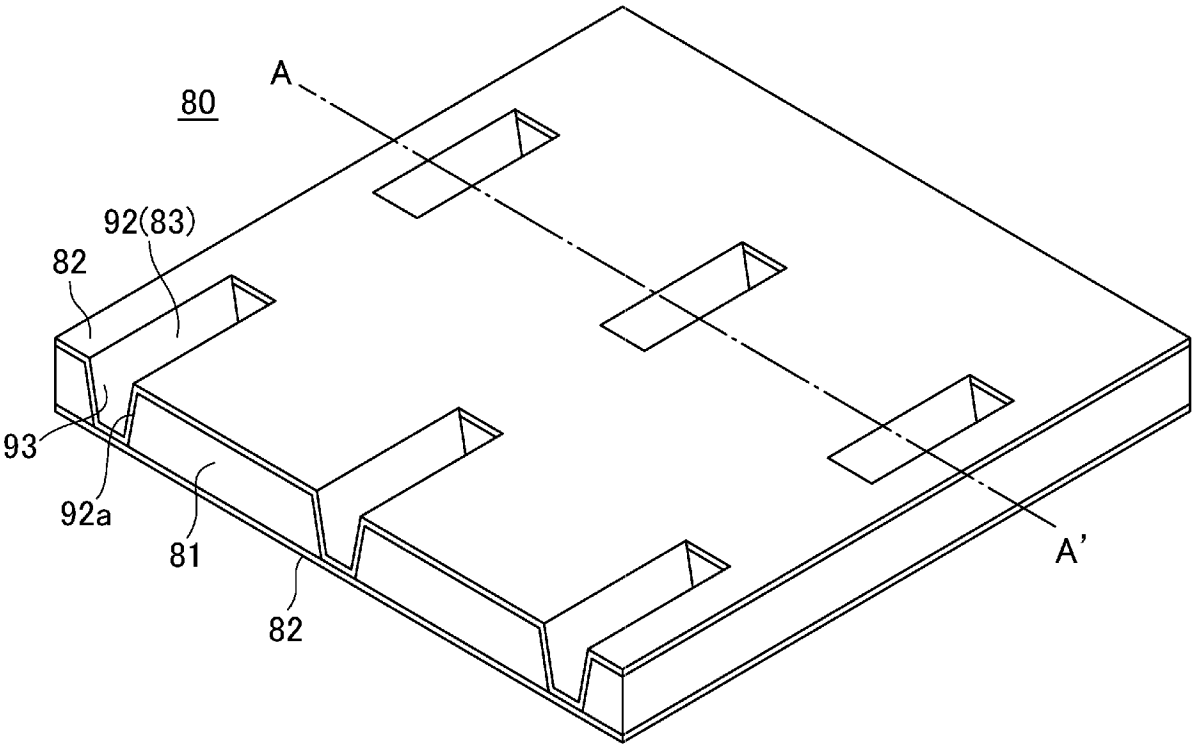
FIG. 33A is a perspective view of a fuse element in which short groove portions are formed.
Figure 33B:
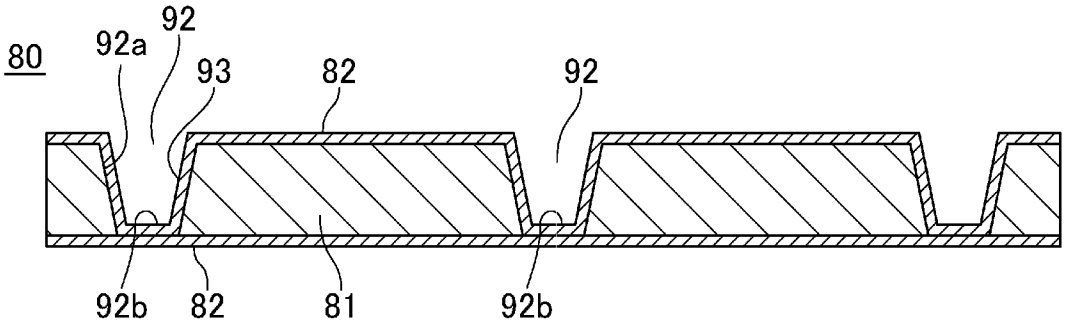
FIG. 33B is a cross-sectional view from A-A' in FIG. 33A.

Another example of the surface irregularity portion 83 is groove portions provided in the layered body constituted by the low melting point metal layer 81 and the first high melting point metal layer 82. The groove portions include long groove portions 91 formed between a pair of opposing side surfaces of the fuse element 80, as illustrated in FIGS. 32A and 32B, and short groove portions 92 that are shorter than the distance between the pair of opposing side surfaces of the fuse element 80, as illustrated in FIGS. 33A and 33B. One or both of the long groove portions 91 and the short groove portions 92 may be formed in a single fuse element 80.

As illustrated in FIGS. 32A to 33B, a plurality of the long groove portions 91 and the short groove portions 92 are formed in a prescribed pattern, such as being parallel at a prescribed spacing, in the same surface of the fuse element 80.

In the long groove portions 91 and the short groove portions 92, side surfaces 91*a* and 92*a* are at least partially covered by a second high melting point metal layer 93 that is continuous with the first high melting point metal layer 82. The long groove portions 91 and the short groove portions 92 can be formed by, for example, first pressing the low melting point metal layer 81 using a mold, and then layering the first and second high melting point metal layers 82 and 93 through a plating process or the like.

Like the raw material constituting the first high melting point metal layer 82, the raw material constituting the second high melting point metal layer 93 has a melting point high enough so that the second high melting point metal layer 93 does not melt at the reflow temperature. From the standpoint of manufacturing efficiency, it is preferable that the second high melting point metal layer 93 be formed of the same raw material as the first high melting point metal layer 82 during the process of forming the first high melting point metal layer 82.

Note that the long groove portions 91 and the short groove portions 92 may be formed by first pressing the layered body constituted by the low melting point metal layer 81 and the first high melting point metal layer 82 using a mold, and then subjecting the second high melting point metal layer 93 to a plating process or the like as appropriate.

This fuse element 80 is placed so that both side edges in the longitudinal direction of the long groove portions 91 and the short groove portions 92 bridge the first and second electrodes 22 and 23 provided on the electrically insulating substrate 21 of the fuse device 20, and is then subjected to reflow heating. The fuse element 80 is soldered to the first and second electrodes 22 and 23 using the connection solder 28 as a result. The fuse device 20 on which the fuse element 80 has been mounted is furthermore placed on an outside circuit board of various types of electronic devices, and is reflow-mounted.

Here, the first high melting point metal layer 82 that does not melt even at the reflow temperature is layered on the low melting point metal layer 81 as an outer layer, and the long groove portions 91 or the short groove portions 92 are provided as well. Accordingly, even in a case where the fuse element 80 is repeatedly exposed to a high-temperature environment, such as when being reflow-mounted to the electrically insulating substrate 21 of the fuse device 20 or when the fuse device 20 using the fuse element 80 is reflow-mounted onto an outside circuit board, the long groove portions 91 or the short groove portions 92 can keep deformation of the fuse element 80 within a constant range at which variations in the fusing characteristics are suppressed. As such, the fuse element 80 can be reflow-mounted even in a case where the surface area thereof has been increased, which makes it possible to improve the mounting efficiency. The fuse element 80 can also achieve an improvement in the current rating in the fuse device 20.

In other words, in the fuse element 80, the long groove portions 91 or the short groove portions 92 are formed in the low melting point metal layer 81, and the side surfaces 91*a* of the long groove portions 91 or the side surfaces 92*a* of the short groove portions 92 are covered with the second high melting point metal layer 93. Accordingly, even in the case where the fuse element 80 is exposed to a high-temperature environment greater than or equal to the melting point of the low melting point metal layer 81 for a short amount of time by an outside heat source such as a reflow furnace, flowing of the melted low melting point metal is suppressed, and the first high melting point metal layer 82 constituting the outer layer is supported, by the second high melting point metal layer 93 that covers the side surfaces 91*a* of the long groove portions 91 or the side surfaces 92*a* of the short groove portions 92. Accordingly, the fuse element 80 can suppress a situation in which the melted low melting point metal agglomerates due to tension and expands, or the melted low melting point metal flows out and becomes thinner, and as a result, collapsing or bulging locally arises.

Accordingly, the fuse element 80 can prevent variations in a resistance value caused by deformations such as local collapsing or bulging arising at the temperature used during reflow mounting, and can maintain fusing characteristics in which the fuse element 80 fuses at a prescribed temperature or current and in a prescribed amount of time. Additionally, the fuse element 80 can maintain the fusing characteristics even when repeatedly exposed to the reflow temperature, such as when the fuse device 20 is reflow-mounted onto an outside circuit board after the fuse element 80 has been reflow-mounted onto the electrically insulating substrate 21 of the fuse device 20, which makes it possible to improve the product quality.

Additionally, as with the above-described fuse element 1, with the fuse element 80, flowing of the melted low melting point metal is suppressed by the long groove portions 91 or the short groove portions 92, even in the case where the fuse element 80 is manufactured by being cut out from a large element sheet and the low melting point metal layer 81 is exposed from the side surfaces thereof. Accordingly, a situation in which the melted connection solder 28 is suctioned from the side surfaces, causing an increase in the volume of the low melting point metal and a local decrease in the resistance value, is suppressed.

Cross-Sectional Shape

Figure 34:
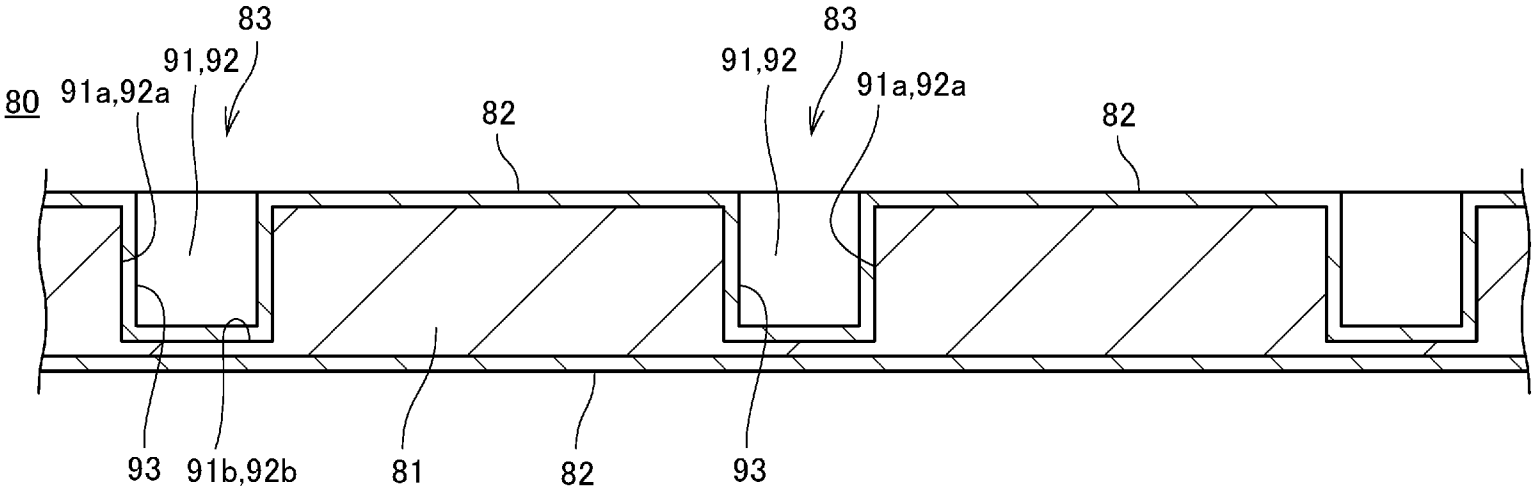
FIG. 34 is a cross-sectional view of a fuse element provided with long groove portions or short groove portions having rectangular cross sections.

As illustrated in FIGS. 32B and 33B, the long groove portions 91 and the short groove portions 92 may be formed having a tapered cross-sectional shape. The long groove portions 91 and the short groove portions 92 can, for example, be formed having tapered cross-sectional shapes corresponding to the shape of a mold by pressing the low melting point metal layer 81 using the mold. Additionally, as illustrated in FIGS. 34A and 34B, the long groove portions 91 and the short groove portions 92 may be formed having a rectangular cross-sectional shape. In the fuse element 80, the long groove portions 91 or the short groove portions 92 having rectangular cross-sectional shapes can be formed by, for example, pressing the low melting point metal layer 81 using a mold corresponding to the long groove portions 91 or the short groove portions 92 having rectangular cross-sectional shapes.

Partial Covering of High Melting Point Metal Layer

Figure 35:
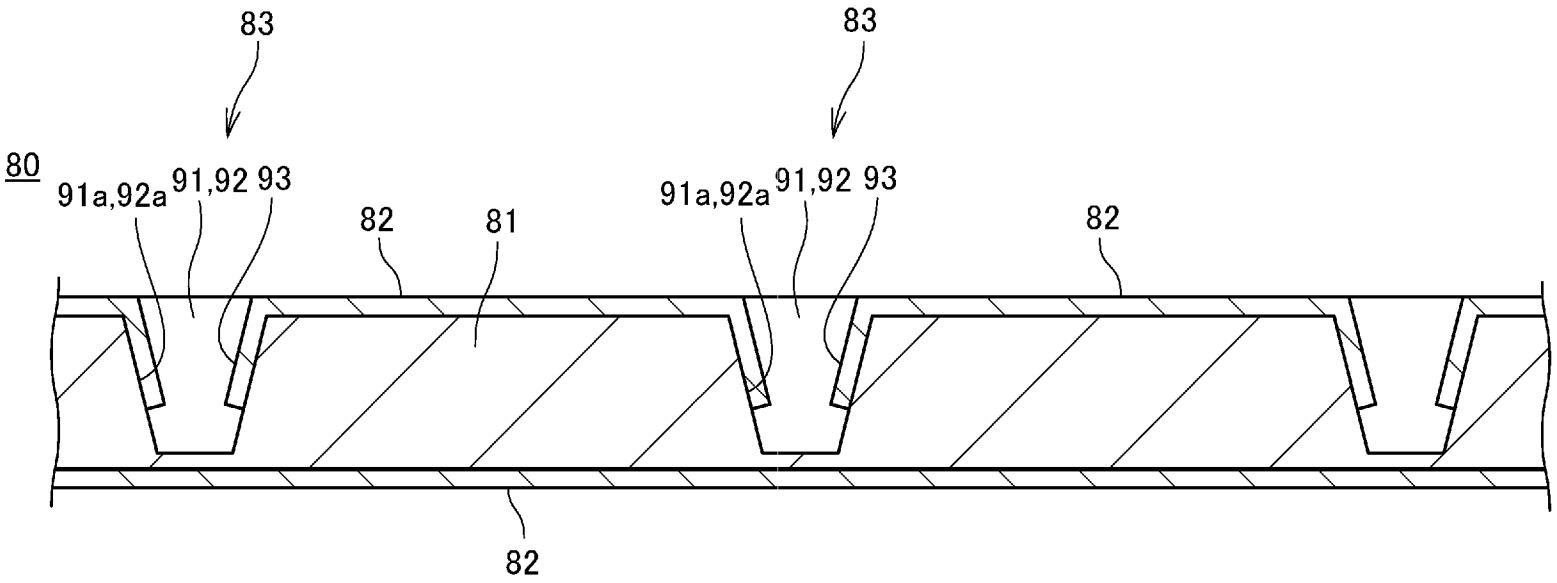
FIG. 35 is a cross-sectional view of a fuse element in which the second high melting point metal layer is provided only in an area corresponding to approximately the upper ⅔ of opening end-sides of grooves.

Note that with the long groove portions 91 and the short groove portions 92, it is sufficient for at least part of the side surfaces 91*a* and 92*a* to be covered by the second high melting point metal layer 93 continuous with the first high melting point metal layer 82, and as illustrated in FIG. 35, the second high melting point metal layer 93 may cover only an area corresponding to approximately the upper ⅔ of the side surfaces 91*a* and 92*a*. Additionally, with the long groove portions 91 and the short groove portions 92, the layered body constituted by the low melting point metal layer 81 and the first high melting point metal layer 82 may be formed first, and the layered body may then be pressed from the top of the first high melting point metal layer 82 using a mold such that some of the first high melting point metal layer 82 is pushed onto the side surfaces 91*a* of the long groove portions 91 to serve as the second high melting point metal layer 93.

As illustrated in FIG. 35, by layering the second high melting point metal layer 93 continuous with the first high melting point metal layer 82 onto parts of the ends of the side surfaces 91*a* and 92*a* of the openings in the long groove portions 91 and the short groove portions 92, the second high melting point metal layer 93 layered onto the side surfaces 91*a* and 92*a* of the long groove portions 91 and the short groove portions 92 suppresses flowing of the melted low melting point metal and supports the first high melting point metal layer 82 on the end sides of the openings, and thus local collapsing or expansion of the fuse element 80 can be suppressed.

Figure 36A:
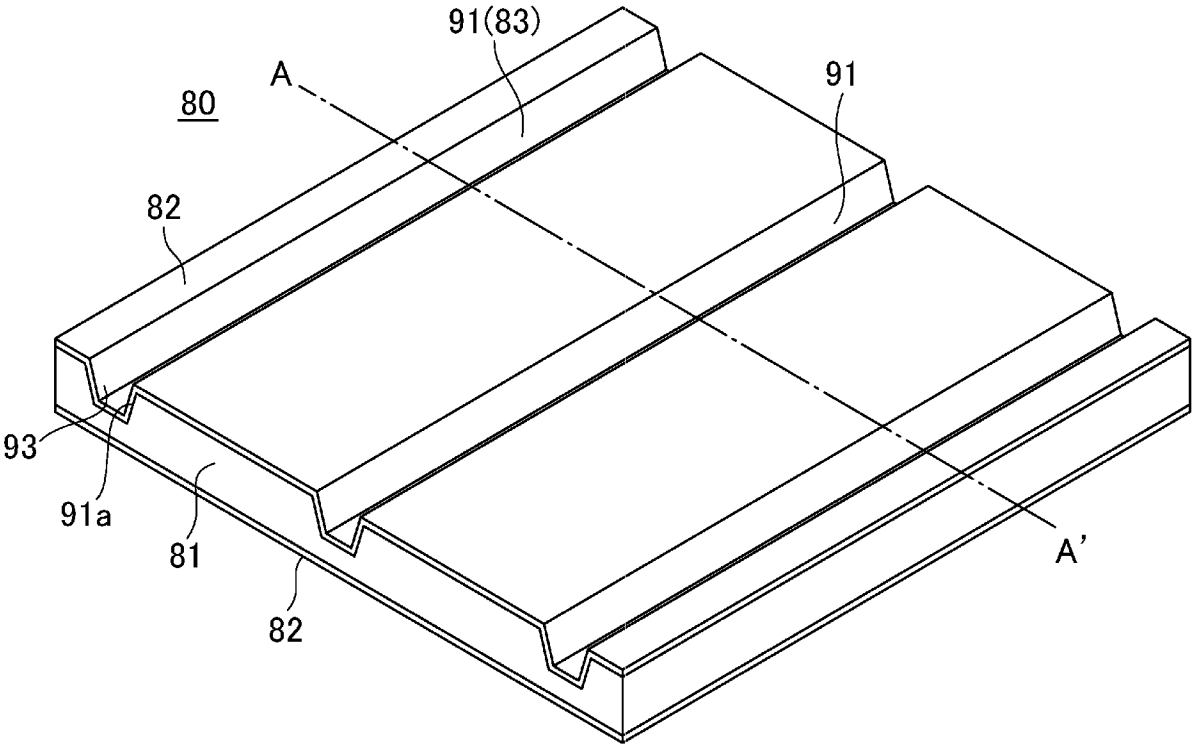
FIG. 36A is a perspective view of a fuse element in which closed-ended long groove portions or short groove portions are provided.
Figure 36B:
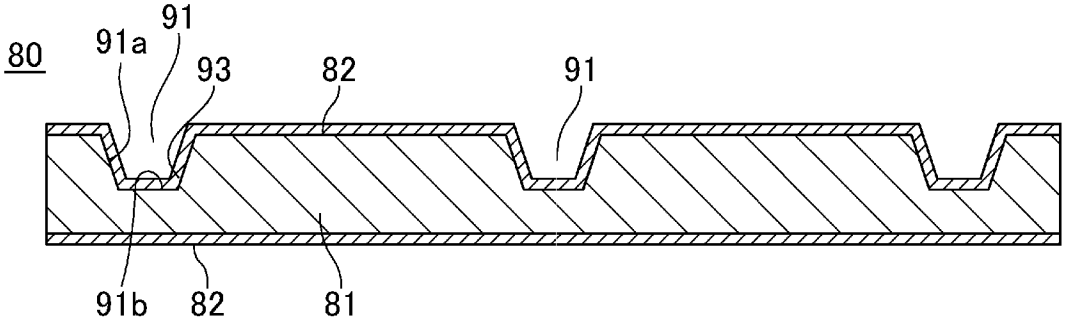
FIG. 36B is a cross-sectional view from A-A' in FIG. 36A.
Figure 37A:
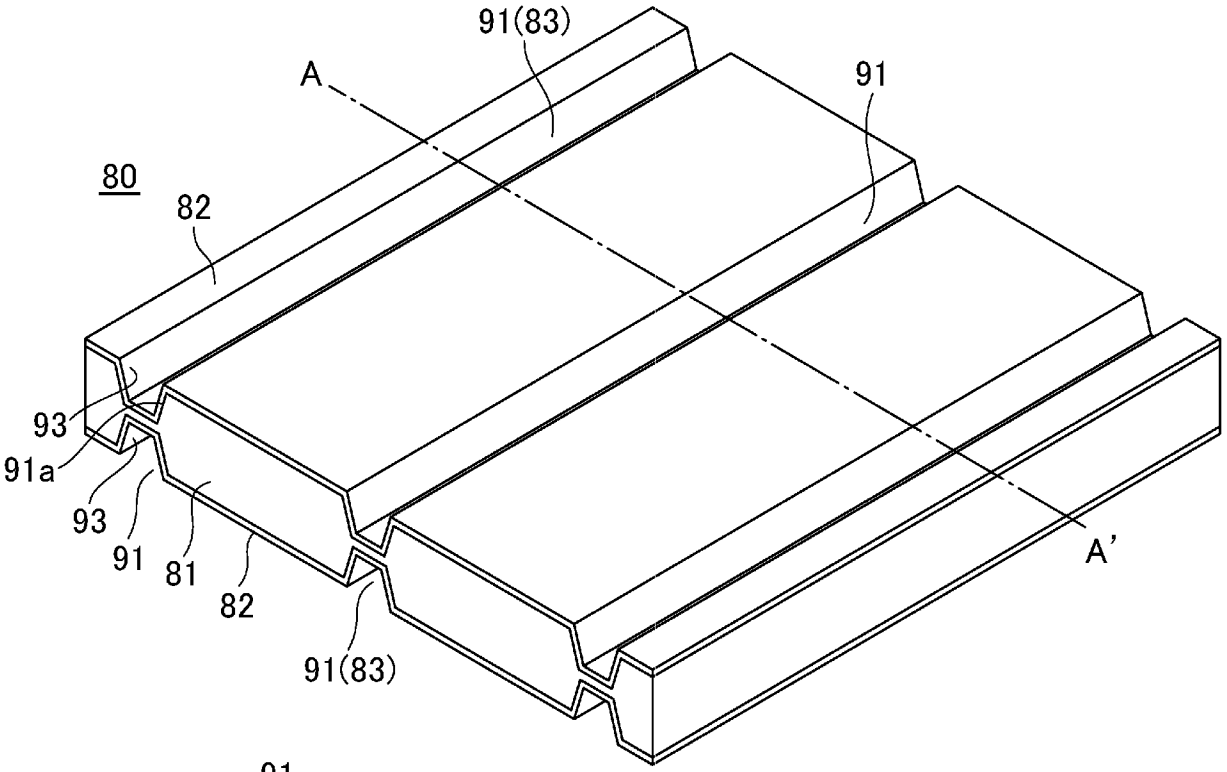
FIG. 37A is a perspective view of a fuse element in which long groove portions provided in front and rear surfaces are provided parallel to each other and in overlapping positions.
Figure 37B:
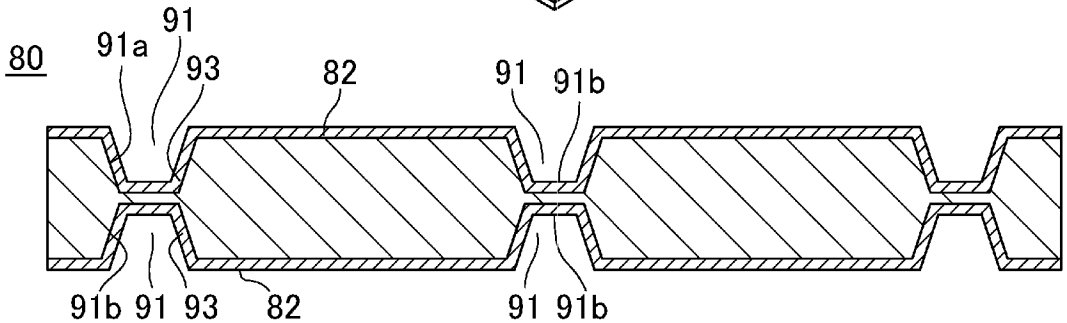
FIG. 37B is a cross-sectional view from A-A' in FIG. 37A.
Figure 38A:
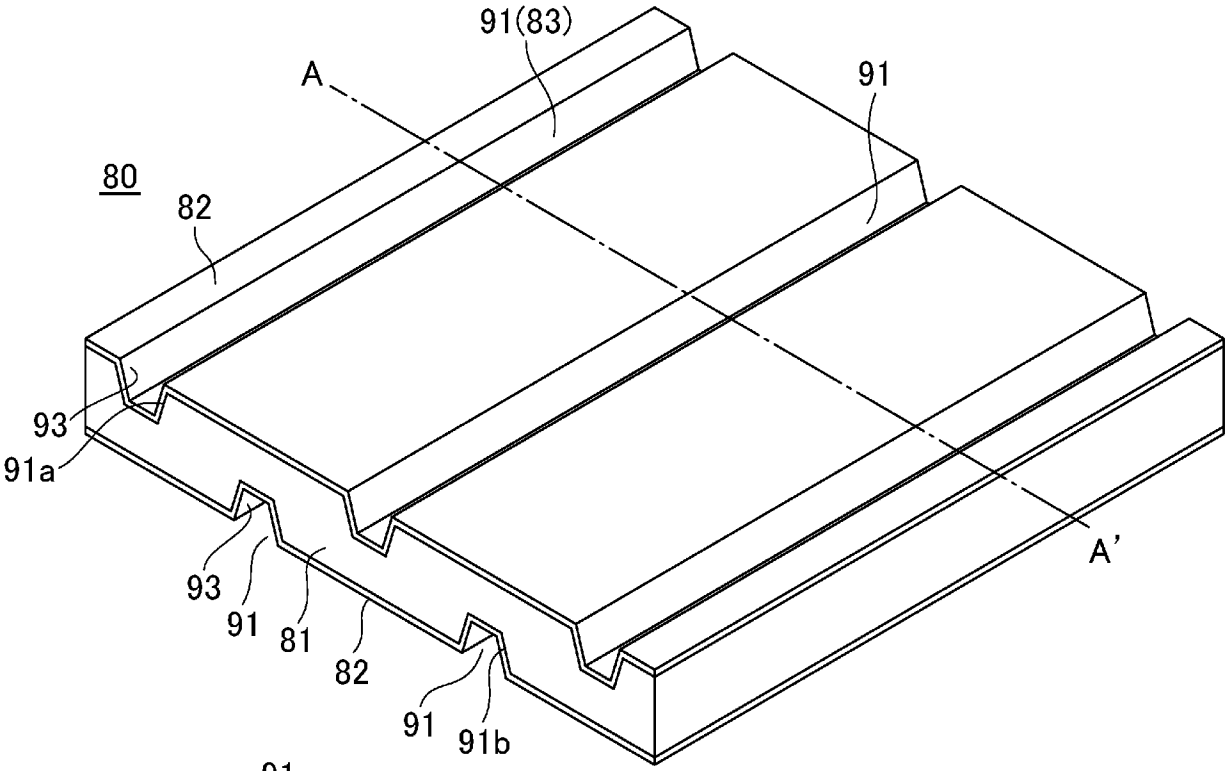
FIG. 38A is a perspective view of a fuse element in which long groove portions provided in front and rear surfaces are provided parallel to each other and in non-overlapping positions.
Figure 38B:
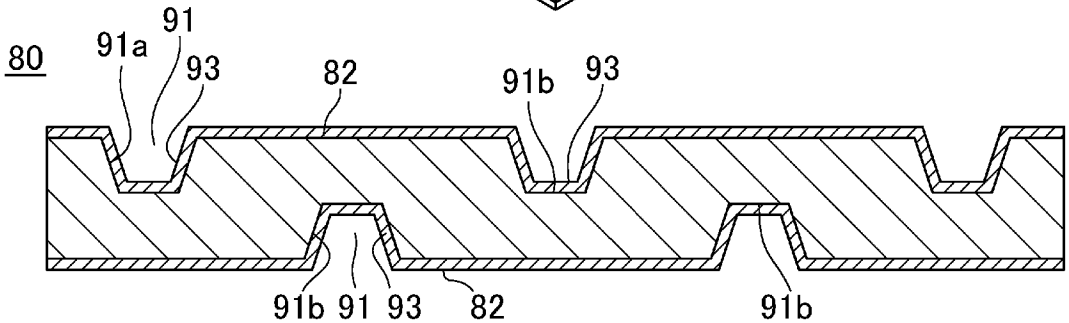
FIG. 38B is a cross-sectional view from A-A' in FIG. 38A.

The long groove portions 91 may be formed as penetrating grooves passing through the low melting point metal layer 81 in the thickness direction thereof, as illustrated in FIG. 32B, or as closed-ended grooves having a depth shallower than the thickness of the low melting point metal layer 81, as illustrated in FIGS. 36A and 36B. In the case where the long groove portions 91 are formed as penetrating grooves, the second high melting point metal layer 93 covering the side surfaces 91*a* of the long groove portions 91 is layered on the first high melting point metal layer 82 layered on the rear surface of the low melting point metal layer 81 so as to form bottom surfaces 91*b* of the long groove portions 91, and is continuous, at the edges of the openings, with the first high melting point metal layer 82 layered on the surface of the low melting point metal layer 81.

In the case where the long groove portions 91 are formed as closed-ended grooves, it is preferable that the long groove portions 91 be covered by the second high melting point metal layer 93 as far as the bottom surfaces 91*b*, as illustrated in FIG. 36B. With the fuse element 80, even the bottom surfaces 91*b* of the long groove portions 91 are covered by the second high melting point metal layer 93, and thus even in the case where the low melting point metal flows due to the reflow heating, that flow is suppressed, and the first high melting point metal layer 82 constituting the outer layer is supported, by the second high melting point metal layer 93 covering the side surfaces 91*a* and the bottom surfaces 91*b* of the long groove portions 91. Accordingly, there are only slight variations in the thickness of the fuse element 80, which do not result in variations in the fusing characteristics.

Additionally, the long groove portions 91 provided in the front and rear surfaces of the fuse element 80 may be parallel to each other and formed in overlapping or non-overlapping positions, as illustrated in FIGS. 37A and 37B and FIGS. 38A and 38B. Even with the configuration illustrated in FIGS. 37A to 38B, flowing of the melted low melting point metal is restricted, and the first high melting point metal layer 82 constituting the outer layer is supported, by the second high melting point metal layer 93 covering the side surfaces 91*a* of the long groove portions 91. Accordingly, the fuse element 80 can suppress a situation in which the melted low melting point metal agglomerates due to tension and expands, or the melted low melting point metal flows out and becomes thinner, and as a result, collapsing or bulging locally arises.

Note that with the fuse elements 80 illustrated in FIGS. 32 to 38, the direction of the current with respect to the direction of the long groove portions 91 can be designed as desired; the direction of the long groove portions 91 may correspond to the direction in which current flows, or a direction orthogonal or oblique to the direction of the long groove portions 91 may correspond to the direction in which current flows.

Figure 39A:
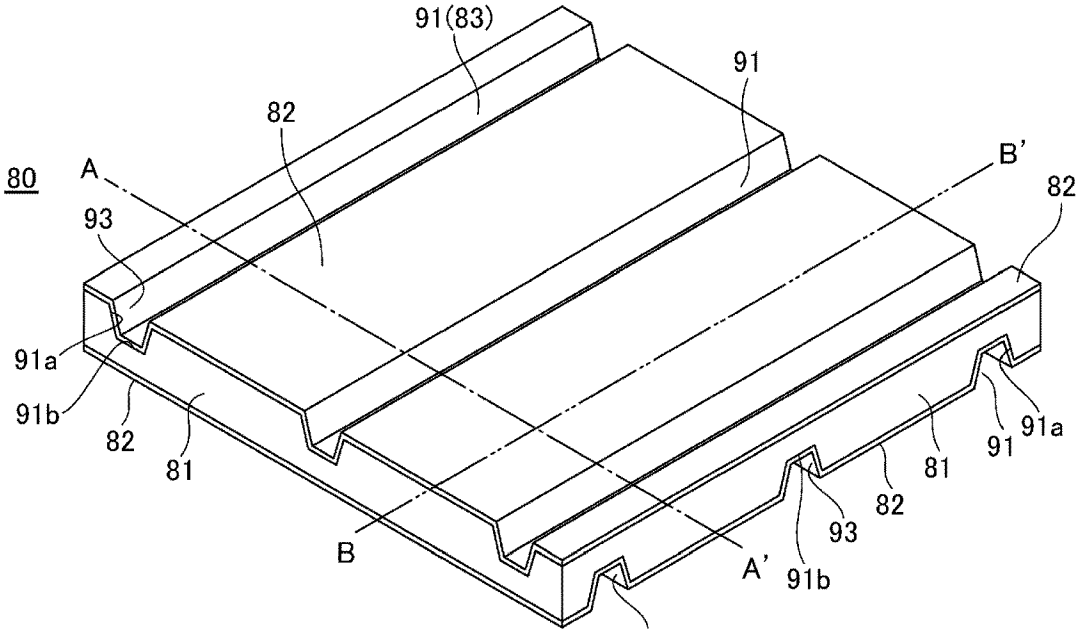
FIG. 39A is a perspective view of a fuse element in which long groove portions provided in front and rear surfaces are provided in positions intersecting with each other.
Figure 39C:
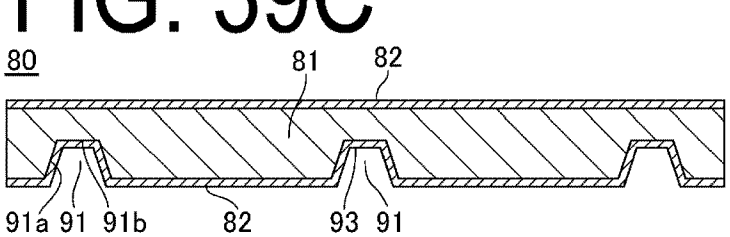
FIG. 39C is a cross-sectional view from A-A' in FIG. 39A.
Figure 39B:
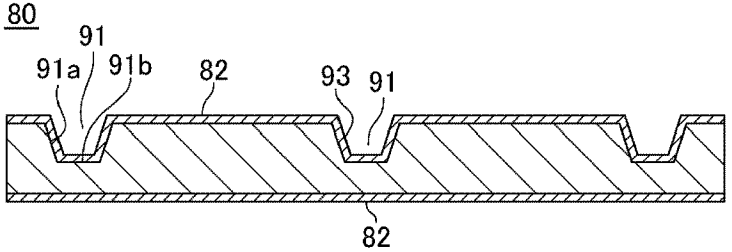
FIG. 39B is a cross-sectional view from A-A' in FIG. 39A.

Additionally, the long groove portions 91 provided in the front and rear surfaces of the fuse element 80 may intersect with each other, as illustrated in FIGS. 39A to 39C. FIG. 39B is a cross-sectional view of the fuse element 80 from A-A' in FIG. 39A, and FIG. 39C is a cross-sectional view of the fuse element 80 from B-B' in FIG. 39A.

The long groove portions 91 provided in the front and rear surfaces are formed so as to be closed-ended, and are not so deep as to contact each other, having depths slightly less than half the thickness of the fuse element 80, for example. The long groove portions 91 provided in the front and rear surfaces may also be orthogonal or oblique to each other. With the fuse element 80 illustrated in FIG. 39, the direction of the current with respect to the direction of the long groove portions 91 provided in the front and rear surfaces can be designed as desired; the direction of the long groove portions 91 formed in one of the front and rear surfaces may correspond to the direction in which current flows, or a direction oblique to the direction of the long groove portions 91 provided in the front and rear surfaces may correspond to the direction in which current flows.

Additionally, as illustrated in FIG. 33, one end of each of the short groove portions 92 may be flush with a side surface of the fuse element 80, or may be formed within the fuse element 80. Additionally, the plurality of short groove portions 92 may be parallel to each other, or non-parallel to each other. Furthermore, although the plurality of short groove portions 92 may be arranged on the same line, the short groove portions 92 need not be arranged on the same line, and may instead be arranged in a staggered pattern, for example.

Additionally, like the long groove portions 91, the short groove portions 92 may be formed as penetrating grooves passing through the low melting point metal layer 81 in the thickness direction thereof, or as closed-ended grooves having a depth shallower than the thickness of the low melting point metal layer 81. In the case where the short groove portions 92 are formed as penetrating grooves, the second high melting point metal layer 93 covering the side surfaces 92*a* of the short groove portions 92 is layered on the first high melting point metal layer 82 layered on the rear surface of the low melting point metal layer 81 so as to form bottom surfaces 92*b* of the short groove portions 92, and is continuous, at the edges of the openings, with the first high melting point metal layer 82 layered on the surface of the low melting point metal layer 81. In the case where the short groove portions 92 are formed as closed-ended grooves, it is preferable that the short groove portions 92 be covered by the second high melting point metal layer 93 as far as the bottom surfaces 92*b*.

Additionally, the plurality of short groove portions 92 may be formed in the front and rear surfaces of the fuse element 80. The plurality of short groove portions 92 formed in the front and rear surfaces of the fuse element 80 may be formed in overlapping or non-overlapping positions. Additionally, the plurality of short groove portions 92 formed in the front and rear surfaces of the fuse element 80 may be parallel to each other or non-parallel to each other, and may intersect with each other.

Figure 40A:
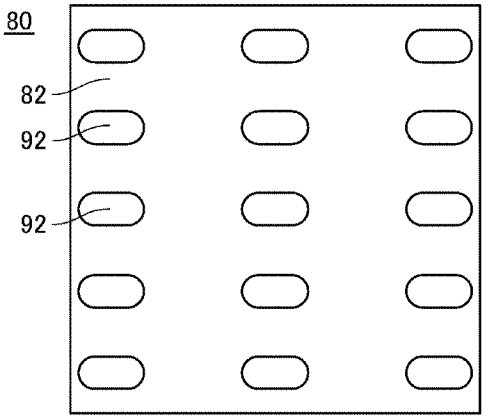
FIG. 40A is a plan view of a fuse element provided with rounded rectangular short groove portions when viewed in plan view.
Figure 40B:
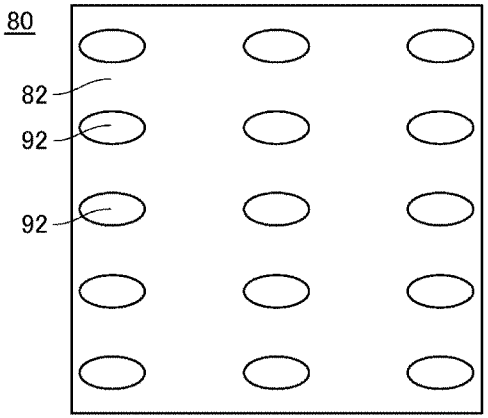
FIG. 40B is a plan view of a fuse element provided with elliptical short groove portions when viewed in plan view.
Figure 40C:
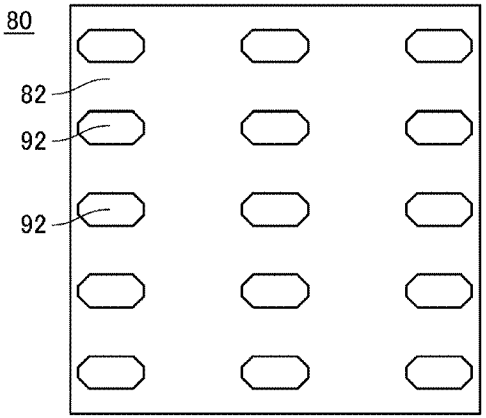
FIG. 40C is a plan view of a fuse element provided with polygonal short groove portions when viewed in plan view.
Figure 40D:
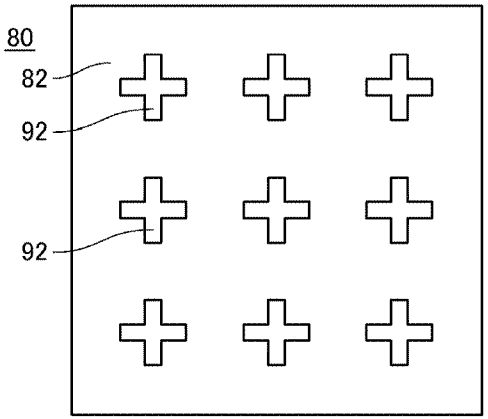
FIG. 40D is a plan view of a fuse element provided with polygonal short groove portions when viewed in plan view.
Figure 41A:
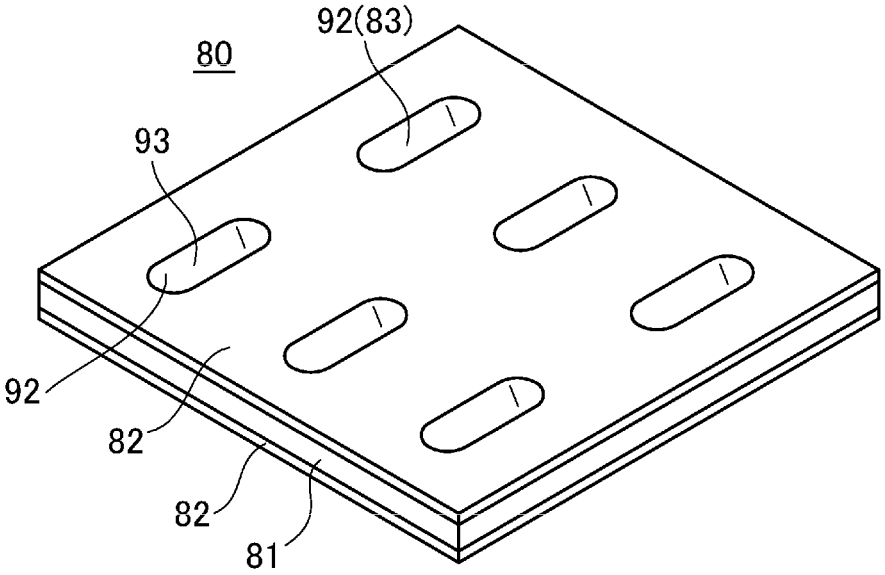
FIG. 41A is a perspective view of a fuse element provided with groove-shaped short groove portions having a rounded rectangular shape when viewed in a plan view, with a middle portion having a triangular prism shape and both end portions having a semicircular cone shape.
Figure 41B:
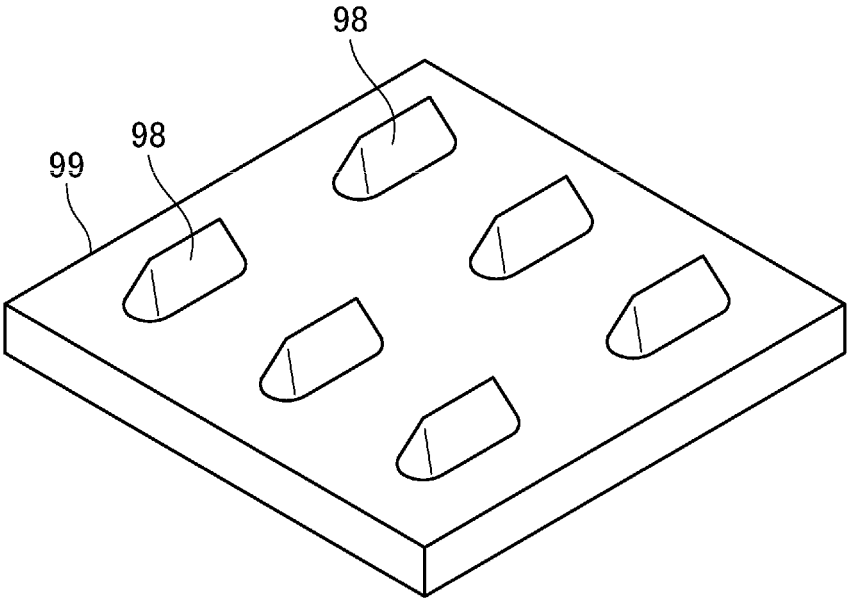
FIG. 41B is a perspective view of a metal mold in which are formed protrusions in which both ends have a semicircular cone shape and a middle portion has a triangular prism shape.

Additionally, the short groove portions 92 may be rectangular when viewed in plan view, as illustrated in FIG. 33, or may have rounded rectangular shapes when viewed in plan view, as illustrated in FIG. 40A. Additionally, the short groove portions 92 may be elliptical (FIG. 40B) or polygonal (FIGS. 40C and 40D) when viewed in plan view. Additionally, each of the short groove portions 92 may have a groove shape that is a rounded rectangular shape when viewed in plan view, with a middle portion having a triangular prism shape and both end portions having semicircular cone shapes, as illustrated in FIG. 41A. The short groove portions 92 illustrated in FIG. 41A can be formed by, for example, pressing the low melting point metal layer 81 or the layered body constituted by the low melting point metal layer 81 and the first high melting point metal layer 82 with a mold 99 in which are formed protrusions 98 in which both ends are semicircular cone shapes and a middle portion is a triangular prism shape, as illustrated in FIG. 41B.

Second Variation on Fuse Element

Penetrating Slits

Figure 42A:
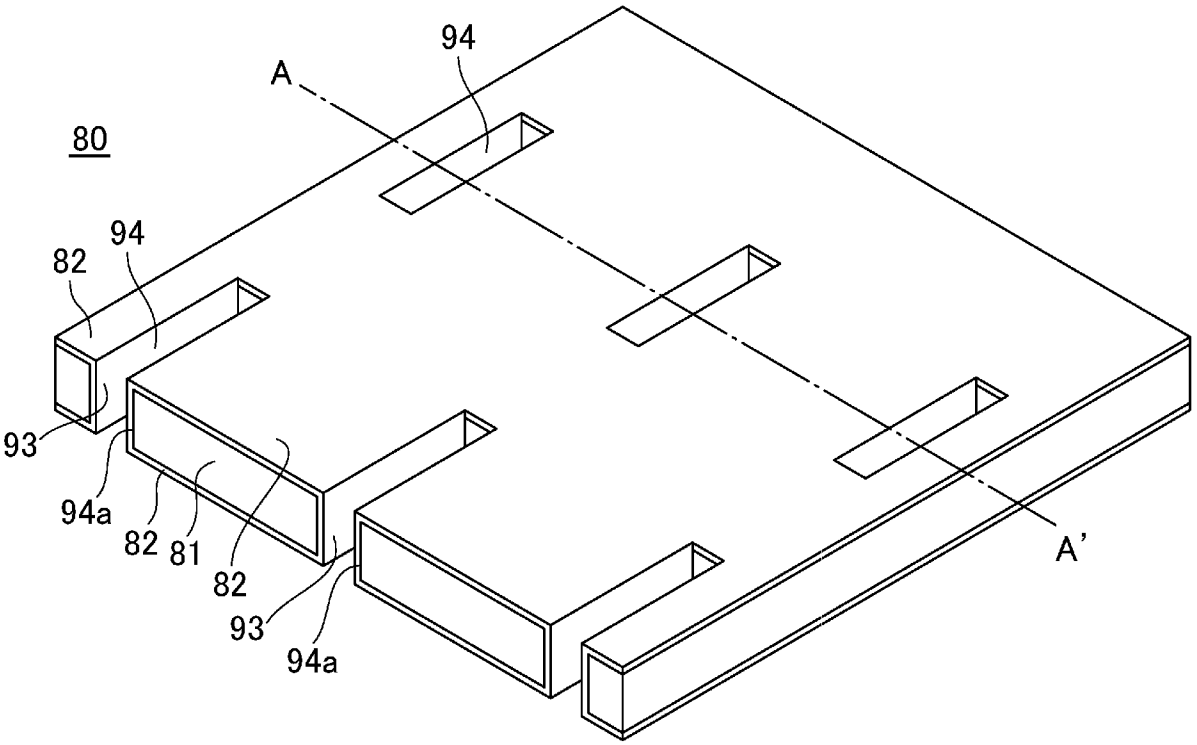
FIG. 42A is a perspective view of a fuse element provided with penetrating slits.
Figure 42B:
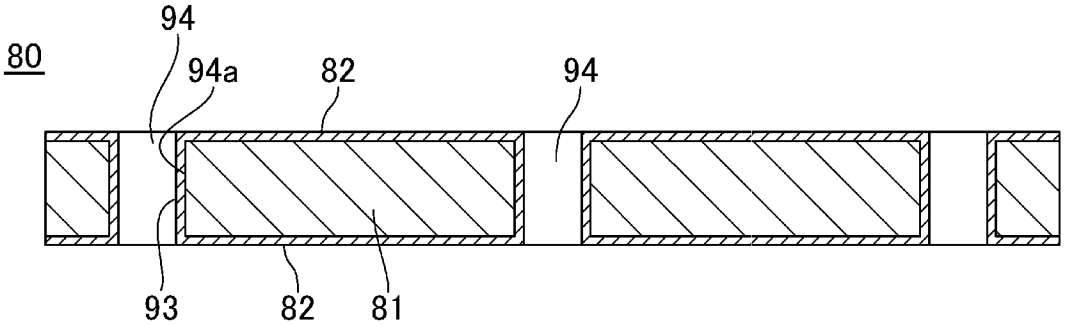
FIG. 42B is a cross-sectional view from A-A' in FIG. 42A.

Instead of the surface irregularity portion 83, one or more penetrating slits 94 may be formed in the fuse element 80. As illustrated in FIG. 42, the penetrating slits 94 are slits that penetrate in the thickness direction of the fuse element 80 provided as the layered body constituted by the low melting point metal layer 81 and the first high melting point metal layer 82 layered on the front and rear surfaces of the low melting point metal layer 81, and wall surfaces 94*a* are at least partially covered by the second high melting point metal layer 93 that is continuous with the first high melting point metal layer 82.

Like the above-described surface irregularity portion 83, the penetrating slits 94 suppress deformation of the fuse element 80 when the fuse element 80 is repeatedly exposed to high-temperature environments, such as when the fuse element 80 is reflow-mounted onto the electrically insulating substrate 21 of the fuse device 20, when the fuse device 20 using the fuse element 80 is reflow-mounted onto an outside circuit board, and the like.

In other words, by providing the penetrating slits 94, flowing of the melted low melting point metal is suppressed, and deformation of the first high melting point metal layer 82 constituting the outer layers is also suppressed, by the second high melting point metal layer 93 covering the wall surfaces 94*a*, even in the case where the fuse element 80 is exposed to a high-temperature environment greater than or equal to the melting point of the low melting point metal layer 81 for a short amount of time by an outside heat source such as a reflow furnace. Accordingly, the fuse element 80 can suppress a situation in which the melted low melting point metal agglomerates due to tension and expands, or the melted low melting point metal flows out and becomes thinner, and as a result, collapsing or bulging locally arises.

Accordingly, the fuse element 80 can prevent variations in a resistance value caused by deformations such as local collapsing or bulging arising at the temperature used during reflow mounting, and can maintain fusing characteristics in which the fuse element 80 fuses at a prescribed temperature or current and in a prescribed amount of time. Additionally, the fuse element 80 can maintain the fusing characteristics even when repeatedly exposed to the reflow temperature, such as when the fuse device 20 is reflow-mounted onto an outside circuit board after the fuse element 80 has been reflow-mounted onto the electrically insulating substrate 21 of the fuse device 20, which makes it possible to improve the product quality.

Cooling Component

Figure 43:
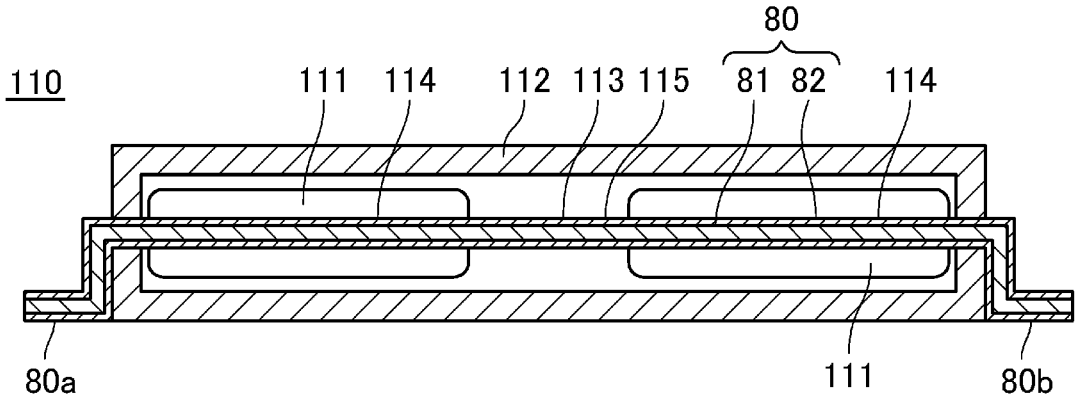
FIG. 43 is a cross-sectional view of an example of a fuse device in which a cooling component is layered onto a fuse element.

In the fuse device 20 described above, the fuse element 80 is soldered to the first and second electrodes 22 and 23 provided on the electrically insulating substrate 21. However, as illustrated in FIG. 43, both end portions of the fuse element 80 in the electrical conduction direction thereof may serve as terminal portions 80*a* and 80*b* connected to connection electrodes of an outside circuit (not illustrated). This fuse device 110 includes: the fuse element 80; a cooling component 111 layered on the fuse element 80; and a protective component 112 that accommodates the fuse element 80 and the cooling component 111 and is configured to prevent the scattering of the melted electrical conductor when the fuse element 80 fuses.

Both end portions of the fuse element 80 in the electrical conduction direction thereof serve as the terminal portions 80*a* and 80*b* connected to connection electrodes of the outside circuit (not illustrated). The cooling component 111 is layered on the front and rear surfaces, and the pair of terminal portions 80*a* and 80*b* are extended to the outside of the protective component 112, and thus the fuse element 80 can be connected to the connection electrodes of the outside circuit via the terminal portions 80*a* and 80*b*.

Additionally, with the fuse device 110, by layering the cooling component 111 on the fuse element 80, a low thermal conductivity portion 113 distanced from the cooling component 111 and having a relatively low thermal conductivity, and a high thermal conductivity portion 114 in contact with the cooling component 111 and having a relatively high thermal conductivity, are formed within the fuse element 80.

Cooling Component

By layering the cooling component 111 on the areas of the fuse element 80 aside from a breaking portion 115 that fuses, and having the cooling component 111 absorbed heat from the fuse element 80, the low thermal conductivity portion 113 where the cooling component 111 is not layered can be selectively caused to fuse.

An adhesive, for example, can be used as the cooling component 111, and an adhesive having a high thermal conductivity is preferable from the standpoint of facilitating the cooling of the fuse element 80. Additionally, an electrically conductive adhesive constituted by a binder resin containing electrically conductive particles may be used as the cooling component 111. Using an electrically conductive adhesive as the cooling component 111 makes it possible to efficiently absorb heat from the high thermal conductivity portion 114 via the electrically conductive particles.

The low thermal conductivity portion 113 refers to a part of the fuse element 80, provided along the breaking portion 115 where the fuse element 80 fuses, across a width direction orthogonal to the electrical conduction direction between the terminal portions 80*a* and 80*b*, that is at least partially separated from the cooling component 111 so as not to make thermal contact therewith, and has a comparatively low thermal conductivity within the surface of the fuse element 80.

Meanwhile, the high thermal conductivity portion 114 refers to a part aside from the breaking portion 115, that at least partially makes contact with the cooling component 111, and has a comparatively high thermal conductivity within the surface of the fuse element 80. Note that it is sufficient for the high thermal conductivity portion 114 to make thermal contact with the cooling component 111, and thus the high thermal conductivity portion 114 may contact the cooling component 111 directly or via a thermally-conductive component.

The protective component 112 that protects the interior of the fuse device 110 can be formed from an electrically insulating raw material having high thermal conductivity, such as a synthetic resin including nylon or LCP resin (liquid crystal polymer), a ceramic material, or the like. The terminal portions 80*a* and 80*b* of the fuse element 80 are extended from side surfaces of the protective component 112.

In the fuse device 110, the low thermal conductivity portion 113 is provided along the breaking portion 115 and the high thermal conductivity portion 114 is formed in areas aside from the breaking portion 115 within the surface of the fuse element 80. Accordingly, when heat builds up in the fuse element 80 due to overcurrent greater than the current rating, heat in the high thermal conductivity portion 114 is actively caused to escape to the exterior, which suppresses heat build-up in the areas aside from the breaking portion 115, and heat is caused to concentrate in the low thermal conductivity portion 113 formed along the breaking portion 115. This makes it possible for the breaking portion 115 to fuse while suppressing the effects of heat on the terminal portions 80*a* and 80*b*. Accordingly, with the fuse device 110, the fuse element 80 between the terminal portions 80*a* and 80*b* can be fused, and the current path of the outside circuit can be broken.

As such, with the fuse device 110, by forming the fuse element 80 having a rectangular shape and reducing the length in the electrical conduction direction, a lower resistance can be achieved and the rated current can be increased. In the case where a high-melting point fuse element such as Cu is used, a large amount of heat builds up during the fusing, and thus in a case where electrode terminals to which the fuse element is connected are near the breaking portion due to the fuse element having a small size, the temperature of the terminals will rise to near the melting point of the high melting point metal. This may result in problems such as melting of the connection solder used for surface mounting. With respect to this point, with the fuse device 110, overheating of the terminal portions 80*a* and 80*b* connected to the connection electrodes of the outside circuit via connection solder or the like can be suppressed, which solves problems such as melting of the connection solder used for surface mounting, and makes it possible to reduce the size of the device.

Additionally, with the fuse device 110, by providing the fuse element 80 with the above-described surface irregularity portion 83 or penetrating slits 94, flowing of the melted low melting point metal is suppressed, and deformation of the first high melting point metal layer 82 constituting the outer layers is also suppressed, even in the case where the fuse element 80 is exposed to a high-temperature environment greater than or equal to the melting point of the low melting point metal layer 81 for a short amount of time by an outside heat source such as a reflow furnace. Accordingly, the fuse element 80 can prevent variations in a resistance value caused by deformations such as local collapsing or bulging arising at the temperature used during reflow mounting, and can maintain fusing characteristics in which the fuse element 80 fuses at a prescribed temperature or current and in a prescribed amount of time. Additionally, the fuse element 80 can maintain the fusing characteristics even when repeatedly exposed to the reflow temperature, such as when the fuse device 110 is reflow-mounted onto an outside circuit board and the outside circuit board is then reflow-mounted onto yet another circuit board, which makes it possible to improve the product quality.

Figure 44:
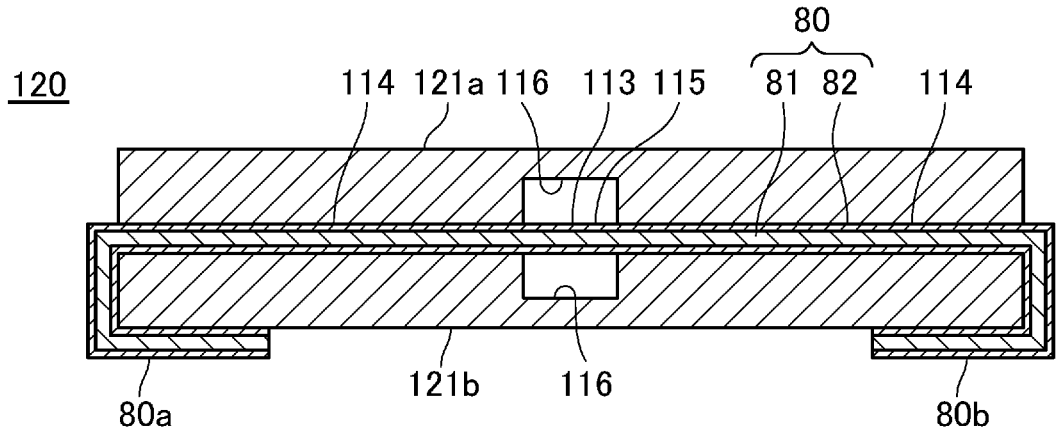
FIG. 44 is a cross-sectional view of an example of a fuse device in which a fuse element is interposed between cooling components constituting a device housing.
Figure 45:
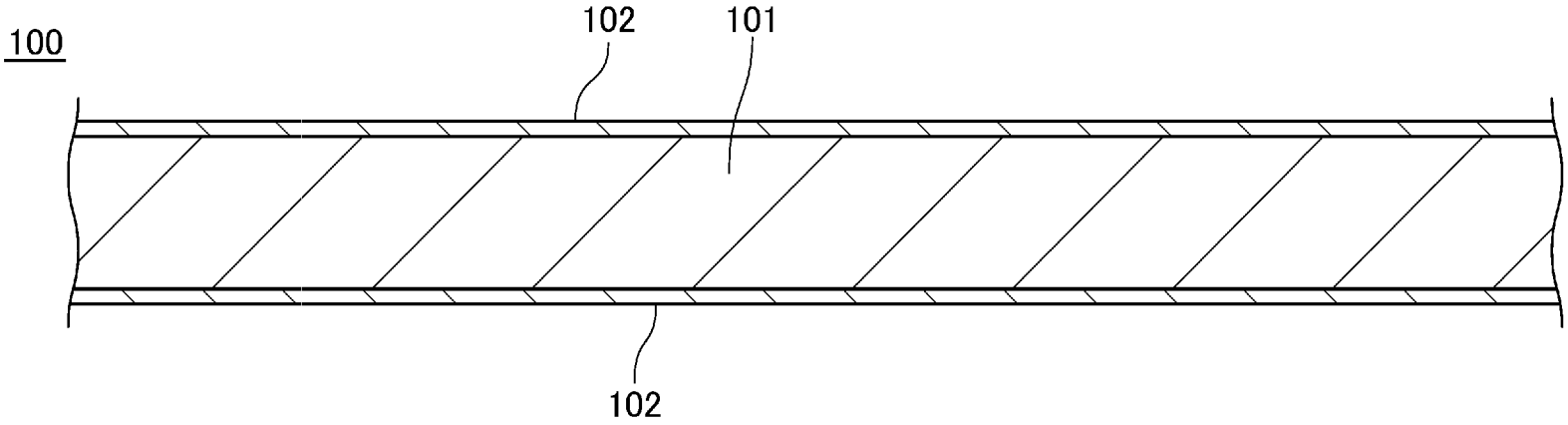
FIG. 45 is a cross-sectional view of a fuse element of the related art.
Figure 46:
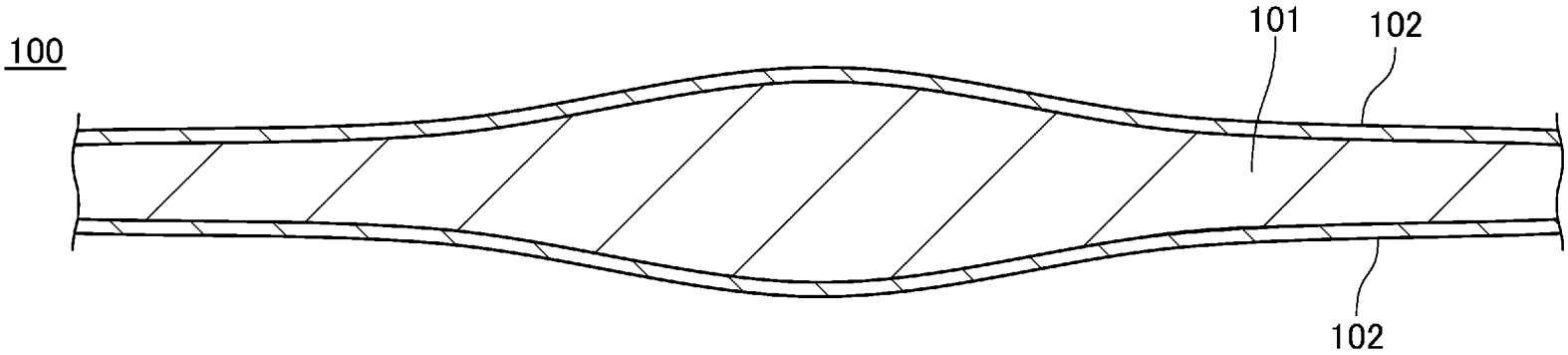
FIG. 46 is a cross-sectional view of a fuse element of the related art that has collapsed and bulged locally.

Additionally, with the fuse device 110, the cooling component 111 is layered on the fuse element 80 and is protected by the protective component 112; however, the fuse element 80 may be interposed between cooling components 121 (121*a* and 121*b*) constituting a device housing, as illustrated in FIG. 44. This fuse device 120 includes the fuse element 80 and the cooling components 121 that are in contact with or near the fuse element 80.

The fuse element 80 is interposed between the pair of upper and lower cooling components 121*a* and 121*b*, and the pair of terminal portions 80*a* and 80*b* are extended to the outside of the cooling components 121*a* and 121*b*, and thus the fuse element 80 can be connected to the connection electrodes of the outside circuit via the terminal portions 80*a* and 80*b*.

Additionally, with the fuse device 120, groove portions 116 are formed in positions of the cooling components 121 corresponding to the breaking portion 115. Accordingly, the cooling components 121 make contact with or are near the parts of the fuse element 80 aside from the breaking portion 115, and the breaking portion 115 overlaps with the groove portions 116. Accordingly, with the fuse device 120, the breaking portion 115 of the fuse element 80 is exposed to the air, which has a lower thermal conductivity than the cooling components 121, and thus the low thermal conductivity portion 113 is formed.

In the fuse device 120, the fuse element 80 is interposed between the pair of upper and lower cooling components 121*a* and 121*b*, and thus the groove portions 116 overlap with both surfaces of the breaking portion 115. As a result, the low thermal conductivity portion 113 distanced from the cooling components 121*a* and 121*b* and having a relatively low thermal conductivity, and the high thermal conductivity portion 114 in contact with or near the cooling components 121*a* and 121*b* and having a relatively high thermal conductivity, are formed within the fuse element 80.

An electrically insulating raw material having high thermal conductivity, such as a ceramic material, can be used favorably for the cooling components 121, and the cooling components 121 can be molded into any desired shape through powder molding or the like. The cooling components 121 preferably have a thermal conductivity of greater than or equal to 1 W/(m·k). Although the cooling components 121 may be formed using a metal raw material, it is preferable that the surfaces thereof be given an electrically insulating covering from the standpoint of preventing short-circuits with surrounding components and improving the handling properties. The device housing is formed by bonding the pair of upper and lower cooling components 121*a* and 121*b* to each other using an adhesive, for example.

In the fuse device 120 as well, the low thermal conductivity portion 113 is provided along the breaking portion 115 and the high thermal conductivity portion 114 is formed in areas aside from the breaking portion 115 within the surface of the fuse element 80. Accordingly, when heat builds up in the fuse element 80 due to overcurrent greater than the current rating, heat in the high thermal conductivity portion 114 is actively caused to escape to the exterior, which suppresses heat build-up in the areas aside from the breaking portion 115, and heat is caused to concentrate in the low thermal conductivity portion 113 formed along the breaking portion 115. This makes it possible for the breaking portion 115 to fuse while suppressing the effects of heat on the terminal portions 80*a* and 80*b*. Accordingly, with the fuse device 120, the fuse element 80 between the terminal portions 80*a* and 80*b* can be fused, and the current path of the outside circuit can be broken.

Additionally, with the fuse device 120, by providing the fuse element 80 with the above-described surface irregularity portion 83 or penetrating slits 94, flowing of the melted low melting point metal is suppressed, and deformation of the first high melting point metal layer 82 constituting the outer layers is also suppressed, even in the case where the fuse element 80 is exposed to a high-temperature environment greater than or equal to the melting point of the low melting point metal layer 81 for a short amount of time by an outside heat source such as a reflow furnace. Accordingly, the fuse element 80 can prevent variations in a resistance value caused by deformations such as local collapsing or bulging arising at the temperature used during reflow mounting, and can maintain fusing characteristics in which the fuse element 80 fuses at a prescribed temperature or current and in a prescribed amount of time. Additionally, the fuse element 80 can maintain the fusing characteristics even when repeatedly exposed to the reflow temperature, such as when the fuse device 120 is reflow-mounted onto an outside circuit board and the outside circuit board is then reflow-mounted onto yet another circuit board, which makes it possible to improve the product quality.

In the fuse element 80, in a case where the height H of the embossed part 84 is too high, the contact with the pair of upper and lower cooling components 121*a* and 121*b* will worsen in areas aside from the fusing area, which may impede the cooling effect. Accordingly, it is preferable that the height H of the embossed part 84 be set taking into consideration the balance between restricting flowing of the low melting point metal layer 81 and the cooling efficiency.

In the fuse device 110, the fuse element 80 may be fitted into side surfaces of the protective component 112, and both ends of the fuse element 80 may be bent on the outside of the protective component 112 so as to form the terminal portions 80*a* and 80*b* on the outside of the protective component 112, as illustrated in FIG. 43. At this time, the fuse element 80 may be bent so that the terminal portions 80*a* and 80*b* are flush with a rear surface of the protective component 112, or may be bent so that the terminal portions 80*a* and 80*b* project from the rear surface of the protective component 112. Likewise, in the fuse device 120 as well, the terminal portions 80*a* and 80*b* may be formed by being bent on the outside of the cooling components 121.

Additionally, in the fuse device 120, the fuse element 80 may be fitted into side surfaces of the cooling components 121, and both ends of the fuse element 80 may be bent onto rear surface sides of the cooling components 121 so as to form the terminal portions 80*a* and 80*b* on the rear surface sides of the cooling components 121, as illustrated in FIG. 44. Likewise, in the fuse device 110 as well, the terminal portions 80*a* and 80*b* may be formed by being bent onto the rear surface side of the protective component 112.

By bending the fuse element 80 such that the terminal portions 80*a* and 80*b* are further formed from the side surfaces of the protective component 112 or the cooling components 121 to positions on the rear surface sides or the outer sides thereof, outflow of the low melting point metal layer constituting the inner layer, inflow of the connection solder that connects the terminal portions 80*a* and 80*b*, and the like can be suppressed, which makes it possible to prevent variations in the fusing characteristics caused by local collapsing or expansion.

REFERENCE SIGNS LIST

1 Fuse element
2 Low melting point metal layer
3 First high melting point metal layer
5 Restricting portion
10 Hole
10*a* Side surface
10*b* Bottom surface
11 Second high melting point metal layer
13 First high melting point particles
15 Second high melting point particles
16 Protruding rim portion
20 Fuse device
21 Electrically insulating substrate
22 First electrode
22*a* First outer connection electrode
23 Second electrode
23*a* Second outer connection electrode
27 Flux
28 Connecting solder
29 Cover component
30 Protective device
31 Electrically insulating substrate
32 Electrically insulating component
33 Heat source
34 First electrode
34*a* First outer connection electrode
35 Second electrode
35*a* Second outer connection electrode
36 Heat source connection electrode
36*a* Lower layer portion
36*b* Upper layer portion
37 Cover component
39 Heat source electrode
40 Short-circuit device
41 Electrically insulating substrate
42 Heat source
43 First electrode
43*a* First outer connection electrode
44 Second electrode
44*a* Second outer connection electrode
45 Third electrode
46 Cover component
48 Electrically insulating component
49 Heat source connection electrode
50 Heat source electrode
50*a* Heat source power supply electrode
51 Outflow prevention portion
52 Switch
60 Switching device
61 Electrically insulating substrate
62 First heat source
63 Second heat source
64 First electrode
64*a* First outer connection electrode
65 Second electrode
65*a* Second outer connection electrode
66 Third electrode
67 Fourth electrode
68 Fifth electrode
68*a* Fifth outer connection electrode
69 Cover component
70 Electrically insulating component
71 First heat source connection electrode
72 First heat source electrode
72*a* First heat source power supply electrode
73 Second heat source connection electrode
74 Second heat source electrode
74*a* Second heat source power supply electrode
77 Outflow prevention portion
78 Switch
80 Fuse element
81 Low melting point metal layer
82 First high melting point metal layer

83 Surface irregularity portion
84 Embossed part
85 Wave-shaped element
85*a* Peak portion
85*b* Valley portion
86 Bent portion
87 Circular portion
88 Elliptical portion
89 Rounded rectangular portion
90 Polygonal portion
91 Long groove portion
92 Short groove portion
93 Second high melting point metal layer
94 Penetrating slit
110 Fuse device
111 Cooling component
112 Protective component
113 Low thermal conductivity portion
114 High thermal conductivity portion
115 Breaking portion
120 Fuse device
121 Cooling component

The invention claimed is:

1. A fuse element comprising:
a low melting point metal layer;
a first high melting point metal layer layered on the low melting point metal layer and having a higher melting point than a melting point of the low melting point metal layer; and
a restricting portion including a high melting point material having a higher melting point than the melting point of the low melting point metal layer and configured to restrict flowing of a low melting point metal or deformation of a layered body constituted by the first high melting point metal layer and the low melting point metal layer,
wherein in the restricting portion, side surfaces of one or more holes provided in the low melting point metal layer are at least partially covered by a second high melting point metal layer continuous with the first high melting point metal layer.

2. The fuse element according to claim 1,
wherein the restricting portion includes a surface not parallel with a direction in which melted low melting point metal flows, or a surface not identical to the first high melting point metal layer.

3. The fuse element according to claim 1,
wherein the one or more holes are through-holes or closed-ended holes.

4. The fuse element according to claim 1,
wherein the one or more holes are filled by the second high melting point metal.

5. The fuse element according to claim 1,
wherein the one or more holes are formed having a tapered cross-sectional shape or a rectangular cross-sectional shape.

6. The fuse element according to claim 1,
wherein a minimum diameter of each of the one or more holes is greater than or equal to 50 μm.

7. The fuse element according to claim 1,
wherein a depth of each of the one or more holes is greater than or equal to 50% of a thickness of the low melting point metal layer.

8. The fuse element according to claim 1,
wherein the one or more the holes are provided every 15×15 mm.

9. The fuse element according to claim 1,
wherein the one or more holes are closed-ended holes, and are formed in one surface and another surface of the low melting point metal layer opposite each other or not opposite each other.

10. The fuse element according to claim 1,
wherein the one or more holes are provided in at least a central portion of the fuse element, or a difference in a number or a density of the one or more holes on both sides of a line passing through a center of the fuse element is less than or equal to 50%.

11. A fuse element comprising:
a low melting point metal layer;
a first high melting point metal layer layered on the low melting point metal layer and having a higher melting point than a melting point of the low melting point metal layer; and
a restricting portion including a high melting point material having a higher melting point than the melting point of the low melting point metal layer and configured to restrict flowing of a low melting point metal or deformation of a layered body constituted by the first high melting point metal layer and the low melting point metal layer,
wherein in the restricting portion, first high melting point particles having a higher melting point than the melting point of the low melting point metal layer are distributed in the low melting point metal layer.

12. The fuse element according to claim 11,
wherein the first high melting point particles make contact with the first high melting point metal layer layered on both surfaces of the low melting point metal layer and support the first high melting point metal layer.

13. A fuse element according to claim 11,
wherein a particle diameter of each of the first high melting point particles is smaller than a thickness of the low melting point metal layer.

14. A fuse element comprising:
a low melting point metal layer;
a first high melting point metal layer layered on the low melting point metal layer and having a higher melting point than a melting point of the low melting point metal layer; and
a restricting portion including a high melting point material having a higher melting point than the melting point of the low melting point metal layer and configured to restrict flowing of a low melting point metal or deformation of a layered body constituted by the first high melting point metal layer and the low melting point metal layer,
wherein in the restricting portion, second high melting point particles having a higher melting point than the melting point of the low melting point metal layer are pressed into the low melting point metal layer.

15. A fuse element comprising:
a low melting point metal layer;
a first high melting point metal layer layered on the low melting point metal layer and having a higher melting point than a melting point of the low melting point metal layer; and
a restricting portion including a high melting point material having a higher melting point than the melting point of the low melting point metal layer and configured to restrict flowing of a low melting point metal or deformation of a layered body constituted by the first high melting point metal layer and the low melting point metal layer, wherein in the restricting portion, second high melting point particles having a higher melting point than the melting point of the low melting point metal layer are pressed into the layered body constituted by the first high melting point metal layer and the low melting point metal layer.

16. The fuse element according to claim 15, wherein the second high melting point particles each include protruding rim portions configured to bond to the first high melting point metal layer.

17. A fuse device comprising:

an electrically insulating substrate;

a first electrode and a second electrode formed on the electrically insulating substrate; and a fuse element including a low melting point metal layer and a first high melting point metal layer having a higher melting point than a melting point of the low melting point metal layer and connected across the first electrode and the second electrode, the low melting point metal layer and the first high melting point metal layer being layered, wherein the fuse element includes a restricting portion including a high melting point material having a higher melting point than the melting point of the low melting point metal layer, and configured to restrict flowing of a low melting point metal or deformation of a layered body constituted by the first high melting point metal layer and the low melting point metal layer, and in the restricting portion, side surfaces of one or more holes provided in the low melting point metal layer are at least partially covered by a second high melting point metal layer continuous with the first high melting point metal layer.

18. A protective device comprising:

an electrically insulating substrate;

a first electrode and a second electrode formed on the electrically insulating substrate;

a heat source formed on the electrically insulating substrate or within the electrically insulating substrate;

a heat source connection electrode electrically connected to the heat source; and a fuse element including a low melting point metal layer and a first high melting point metal layer having a higher melting point than a melting point of the low melting point metal layer and connected across the first electrode and the second electrode and the heat source connection electrode, the low melting point metal layer and the first high melting point metal layer being layered, wherein the fuse element includes a restricting portion including a high melting point material having a higher melting point than the melting point of the low melting point metal layer and configured to restrict flowing of a low melting point metal or deformation of a layered body constituted by the first high melting point metal layer and the low melting point metal layer, and in the restricting portion, side surfaces of one or more holes provided in the low melting point metal layer are at least partially covered by a second high melting point metal layer continuous with the first high melting point metal layer.

19. A short-circuit device comprising:

a first electrode;

a second electrode provided adjacent to the first electrode;

a fusible electrical conductor supported by the first electrode and configured to agglomerates across the first electrode and the second electrode and short-circuit the first electrode and the second electrode by melting; and a heat source configured to heat the fusible electrical conductor, wherein the fusible electrical conductor includes a low melting point metal layer and a first high melting point metal layer having a higher melting point than a melting point of the low melting point metal layer, the low melting point metal layer and the first high melting point metal layer being layered, and a restricting portion including a high melting point material having a higher melting point than the melting point of the low melting point metal layer and configured to restrict flowing of a low melting point metal or deformation of a layered body constituted by the first high melting point metal layer and the low melting point metal layer, and in the restricting portion, side surfaces of one or more holes provided in the low melting point metal layer are at least partially covered by a second high melting point metal layer continuous with the first high melting point metal layer.

20. A switching device comprising:

an electrically insulating substrate;

a first heat source and a second heat source formed on the electrically insulating substrate or within the electrically insulating substrate;

a first electrode and a second electrode provided adjacent to each other on the electrically insulating substrate;

a third electrode provided on the electrically insulating substrate and electrically connected to the first heat source;

a first fusible electrical conductor connected across the first electrode and the third electrode;

a fourth electrode provided on the electrically insulating substrate and electrically connected to the second heat source;

a fifth electrode provided adjacent to the fourth electrode on the electrically insulating substrate; and a second fusible electrical conductor connected from the second electrode to the fifth electrode across the fourth electrode, wherein the first fusible electrical conductor and the second fusible electrical conductor include a low melting point metal layer and a first high melting point metal layer having a higher melting point than a melting point of the low melting point metal layer, the low melting point metal layer and the first high melting point metal layer being layered, and a restricting portion including a high melting point material having a higher melting point than the melting point of the low melting point metal layer and configured to restrict flowing of a low melting point metal or deformation of a layered body constituted by the first high melting point metal layer and the low melting point metal layer, the second fusible electrical conductor is melted by electric heating of the second heat source and breaks a path between the second electrode and the fifth electrode, and the first fusible electrical conductor is melted by electric heating of the first heat source and causes a short-circuit between the first electrode and the second electrode.

21. A fuse element comprising:

a surface irregularity portion;

a low melting point metal layer; and a first high melting point metal layer layered on both front and rear surfaces of the low melting point metal layer and having a higher melting point than a melting point of the low melting point metal layer, wherein the surface irregularity portion is an embossed part provided in a layered body constituted by the low melting point metal layer and the first high melting point metal layer.

22. The fuse element according to claim 21, wherein the surface irregularity portion suppresses flowing of the low melting point metal layer that has been melted by heating from the fuse element and deformation.

23. The fuse element according to claim 21, wherein the embossed part has a substantially wave-shaped cross-section.

24. The fuse element according to claim 23, wherein the embossed part having a wave-shaped cross section includes a bent portion including a bend intersecting with a direction in which peak portions or valley portions continue.

25. The fuse element according to claim 23, wherein in the embossed part, a direction in which peak portions or valley portions continue is parallel, orthogonal, or oblique with respect to a direction in which current flows.

26. The fuse element according to claim 21, wherein the embossed part is one or more circular shapes, elliptical shapes, rounded rectangular shapes, or polygonal shapes when viewed in plan view.

27. The fuse element according to claim 21, wherein a height of the embossed part is greater than or equal to 5% of a total thickness of the fuse element.

28. The fuse element according to claim 21, wherein a total surface area of the embossed part is greater than or equal to 2% of a total surface area of the fuse element.

29. A fuse element comprising:

a surface irregularity portion;

a low melting point metal layer; and a first high melting point metal layer layered on both front and rear surfaces of the low melting point metal layer and having a higher melting point than a melting point of the low melting point metal layer, wherein the surface irregularity portion is one or more groove portions provided in a layered body constituted by the low melting point metal layer and the first high melting point metal layer, and wall surfaces of the groove portions are at least partially covered by a second high melting point metal layer continuous with the first high melting point metal layer.

30. The fuse element according to claim 29, wherein the one or more groove portions include a plurality of groove portions, and the plurality of groove portions are provided in front and rear surfaces of the fuse element.

31. The fuse element according to claim 30, wherein the plurality of groove portions provided in the front and rear surfaces are formed parallel to each other and in overlapping or non-overlapping positions.

32. The fuse element according to claim 30, wherein the plurality of groove portions provided in the front and rear surfaces intersect with each other.

33. The fuse element according to claim 29, wherein the plurality of groove portions are rectangular, rounded rectangular, elliptical, polygonal, or circular when viewed in plan view.

34. A fuse element comprising:

a low melting point metal layer; and a first high melting point metal layer layered on both front and rear surfaces of the low melting point metal layer and having a higher melting point than a melting point of the low melting point metal layer, wherein one or more penetrating slits are provided in a layered body constituted by the low melting point metal layer and the first high melting point metal layer, and wall surfaces of the one or more penetrating slits are at least partially covered by a second high melting point metal layer continuous with the first high melting point metal layer.

35. The fuse element according to claim 34, wherein the one or more penetrating slits suppress flowing of the low melting point metal layer that has been melted by heating from the fuse element and deformation.

* * * * *